US007659858B2

(12) United States Patent
Abe et al.

(10) Patent No.: US 7,659,858 B2
(45) Date of Patent: Feb. 9, 2010

(54) ANTENNA AND ELECTRONIC DEVICE

(75) Inventors: Kazuaki Abe, Iruma (JP); Kaoru Someya, Kiyose (JP)

(73) Assignee: Casio Computer Co., Ltd., Tokyo (JP)

( * ) Notice: Subject to any disclaimer, the term of this patent is extended or adjusted under 35 U.S.C. 154(b) by 322 days.

(21) Appl. No.: 11/851,238

(22) Filed: Sep. 6, 2007

(65) Prior Publication Data

US 2008/0007474 A1 Jan. 10, 2008

Related U.S. Application Data

(63) Continuation of application No. 11/238,034, filed on Sep. 28, 2005, now Pat. No. 7,355,556.

(30) Foreign Application Priority Data

| | | |
|---|---|---|
| Sep. 30, 2004 | (JP) | 2004-287860 |
| Oct. 14, 2004 | (JP) | 2004-300205 |
| May 26, 2005 | (JP) | 2005-153916 |
| May 27, 2005 | (JP) | 2005-155213 |

(51) Int. Cl.
*H01Q 1/12* (2006.01)

(52) U.S. Cl. ..... 343/718; 343/788

(58) Field of Classification Search ..... 343/718, 343/702, 787, 788
See application file for complete search history.

(56) References Cited

U.S. PATENT DOCUMENTS

| | | | | |
|---|---|---|---|---|
| 5,220,339 | A | 6/1993 | Matsushita | |
| 6,134,188 | A * | 10/2000 | Ganter et al. | 368/47 |
| 6,664,936 | B2 | 12/2003 | Ieda et al. | |
| 6,825,757 | B2 * | 11/2004 | Yamada | 340/436 |
| 6,987,490 | B2 | 1/2006 | Sano | |
| 7,061,439 | B1 | 6/2006 | Minami et al. | |
| 7,167,140 | B2 | 1/2007 | Kato et al. | |
| 7,190,638 | B2 | 3/2007 | Oguchi | |
| 2002/0033777 | A1 | 3/2002 | Maruyama et al. | |
| 2003/0184489 | A1 | 10/2003 | Maruyama et al. | |
| 2006/0109188 | A1 | 5/2006 | Ikeda et al. | |
| 2007/0132648 | A1 * | 6/2007 | Abe | 343/718 |

(Continued)

FOREIGN PATENT DOCUMENTS

| | | |
|---|---|---|
| JP | 55-91237 A | 7/1980 |

(Continued)

*Primary Examiner*—HoangAnh T Le
(74) *Attorney, Agent, or Firm*—Frishauf, Holtz, Goodman & Chick, P.C.

(57) ABSTRACT

An electronic device which includes a radio wave impermeably cylindrical case, a radio wave permeable cover covering an opening in one end of the case, a radio wave impermeable cover covering an opening in the other end of the case, and a circuit board and an antenna, both arranged between the two covers in the inner space. The antenna is connected to the board and includes an elongated core and a coil wound around an intermediate portion of the core. Magnetic flux introducing portions are provided on both end portions of the core, a radio wave permeable partition plate is arranged between the permeable cover and the antenna in the inner space, and a pair of flat and magnetic members are arranged between the partition plate and the antenna in the inner space and are magnetically connected to the flux introducing portions.

15 Claims, 44 Drawing Sheets

U.S. PATENT DOCUMENTS

2008/0025152 A1* 1/2008 Yano et al. ..... 368/47

FOREIGN PATENT DOCUMENTS

| | | | |
|---|---|---|---|
| JP | 5-267922 | A | 10/1993 |
| JP | 10-172832 | A | 6/1998 |
| JP | 11-073608 | A | 3/1999 |
| JP | 2000-100613 | A | 4/2000 |
| JP | 2002-204122 | A | 7/2002 |
| JP | 2003-283231 | A | 10/2003 |
| JP | 2003-346108 | A | 12/2003 |
| JP | 2004-128956 | A | 4/2004 |
| JP | 2004-204296 | A | 7/2004 |
| JP | 2004-235701 | A | 8/2004 |
| JP | 2004-340700 | A | 12/2004 |
| JP | 2005-065151 | A | 3/2005 |
| WO | 2004/099884 | A1 | 11/2004 |

* cited by examiner

ANTENNA AND ELECTRONIC DEVICE

CROSS-REFERENCE TO RELATED APPLICATIONS

The present application is a Continuation application of U.S. application Ser. No. 11/238,034 filed Sep. 28, 2005 now U.S. Pat. No. 7,355,556, which is based upon and claims the benefit of priority from prior Japanese Patent Applications No. 2004-287860, filed Sep. 30, 2004; No. 2004-300205, filed Oct. 14, 2004; No. 2005-153916, filed May 26, 2005; and No. 2005-155213, filed May 27, 2005, the entire contents of all of which are incorporated herein by reference.

BACKGROUND OF THE INVENTION

1. Field of the Invention

The present invention relates to an antenna and an electronic device which receive radio waves.

2. Description of the Related Art

A radio-wave clock is known as an electronic device which receives a radio wave (hereinafter referred to as the "standard radio wave") carrying a standard time signal thereon with a built-in antenna and which analyzes time information by a standard radio-wave signal inside the electronic device to correct present timing and precisely keep time. Moreover, as the radio-wave clock which receives such standard radio wave, an electronic watch has broadly spread which automatically receives a standard time radio wave to correct the time.

The antenna for receiving the standard radio wave comprises a magnetic core and a coil wound around this core. Moreover, when a magnetic flux (hereinafter referred to as the "signal magnetic flux") by a magnetic field (hereinafter referred to as the "signal magnetic field") produced by the standard radio wave is passed through this coil, a current is generated in the coil to receive the standard radio wave.

As the antenna which is disposed in such electronic watch to receive the radio wave, an antenna is known which is configured by winding the coil around the core formed of a magnetic material having a satisfactory receiving sensitivity, such as ferrite or amorphous metal.

Especially, the antenna using the amorphous metal as the core is superior to that configured by the ferrite material in impact resistance and temperature characteristic, and has been noted in recent years.

As the antenna of the amorphous metal, an antenna has heretofore been known in which a plurality of thin films of amorphous metals are laminated.

However, since such antenna using the amorphous metal is formed by laminating a plurality of thin films of amorphous metals, it is technically difficult and it requires much cost to work a shape of the core into an arbitrary three-dimensional shape, and manufacture the antenna adapted to a purpose.

It is also known that metals are used in a case, a back lid, and a dial plate of a portable electronic device such as a watch. However, when the metal is used in the case or the like of the electronic device including the built-in antenna, the metal interrupts the radio wave, and the built-in antenna cannot sufficiently receive the radio wave.

To solve the problem, it is known that although the metals are used in the case and the back lid, any metal is not used in the dial plate so that the built-in antenna can receive the radio wave through the dial plate.

However, in such antenna, since a portion of the antenna capable of receiving the radio wave is limited, the radio wave cannot be sufficiently received on a side of the dial plate, Moreover, when the antenna is enlarged in order to obtain a satisfactory receiving sensitivity, restrictions are imposed on a mounting space in which another component is to be disposed, and it is difficult to miniaturize the device.

Furthermore, the receiving sensitivity of the standard radio wave by the antenna needs to be raised in order to receive the signal carrying the standard time signal thereon securely. Therefore, an antenna is known in which sectional areas of opposite end portions of the core are enlarged so that more signal magnetic fluxes can pass through the coil in order to raise the receiving sensitivity.

However, in this case, when the signal magnetic flux passes through the coil of the antenna, the current flows through the coil in a direction in which the signal magnetic fluxes are inhibited from being changed, and a magnetic flux (hereinafter referred to as the "generated magnetic flux") directed in reverse to the signal magnetic flux is generated by the current. When the generated magnetic flux passes through a metal member positioned in the vicinity of the antenna, a current called an eddy current flows in the form of a concentric circle forming right angles with respect to the magnetic flux. It is known that when the eddy current is generated in the metal member, heat is released by an electric resistance owned by the metal material, and energy is lost. Therefore, the energy is consumed as a heat loss by the eddy current generated in the case of the device when the signal magnetic flux passes through the coil, and the receiving sensitivity of the antenna drops.

BRIEF SUMMARY OF THE INVENTION

An electronic device is provided which comprises: a cylindrical case which has an inner space and both ends opened to the inner space and which is impermeable to a radio wave; a first cover which covers an opening in one end of the case and which is permeable to the radio wave; a second cover which covers an opening in the other end of the case and which is impermeable to the radio wave; a circuit board which is arranged between the first cover and the second cover in the inner space of the case; an antenna which is arranged between the first cover and the second cover in the inner space of the case, which is connected to the circuit board, and which includes an elongated core having both end portions and an intermediate portion between the both end portions, and a coil wound around the intermediate portion of the core; a pair of magnetic flux introducing portions provided on the both end portions of the core of the antenna; a partition plate which is arranged between the first cover and the antenna in the inner space of the case and which is permeable to the radio wave; and a pair of flat and magnetic members which is arranged between the partition plate and the antenna in the inner space of the case and which is magnetically connected to the pair of magnetic flux introducing portions. An electric signal entered into the inner space of the case from an outside of the case through the first cover and the partition plate is introduced into the magnetic flux introducing portions through the flat and magnetic members and then the electric signal is introduced into the intermediate portion of the core from the magnetic flux introducing portions through the both end portions of the core to act on the coil.

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described hereinafter with reference to the drawings. Additionally, the scope of the present invention is not limited to embodiments and modifications shown below.

Embodiment 1

Figure 1:
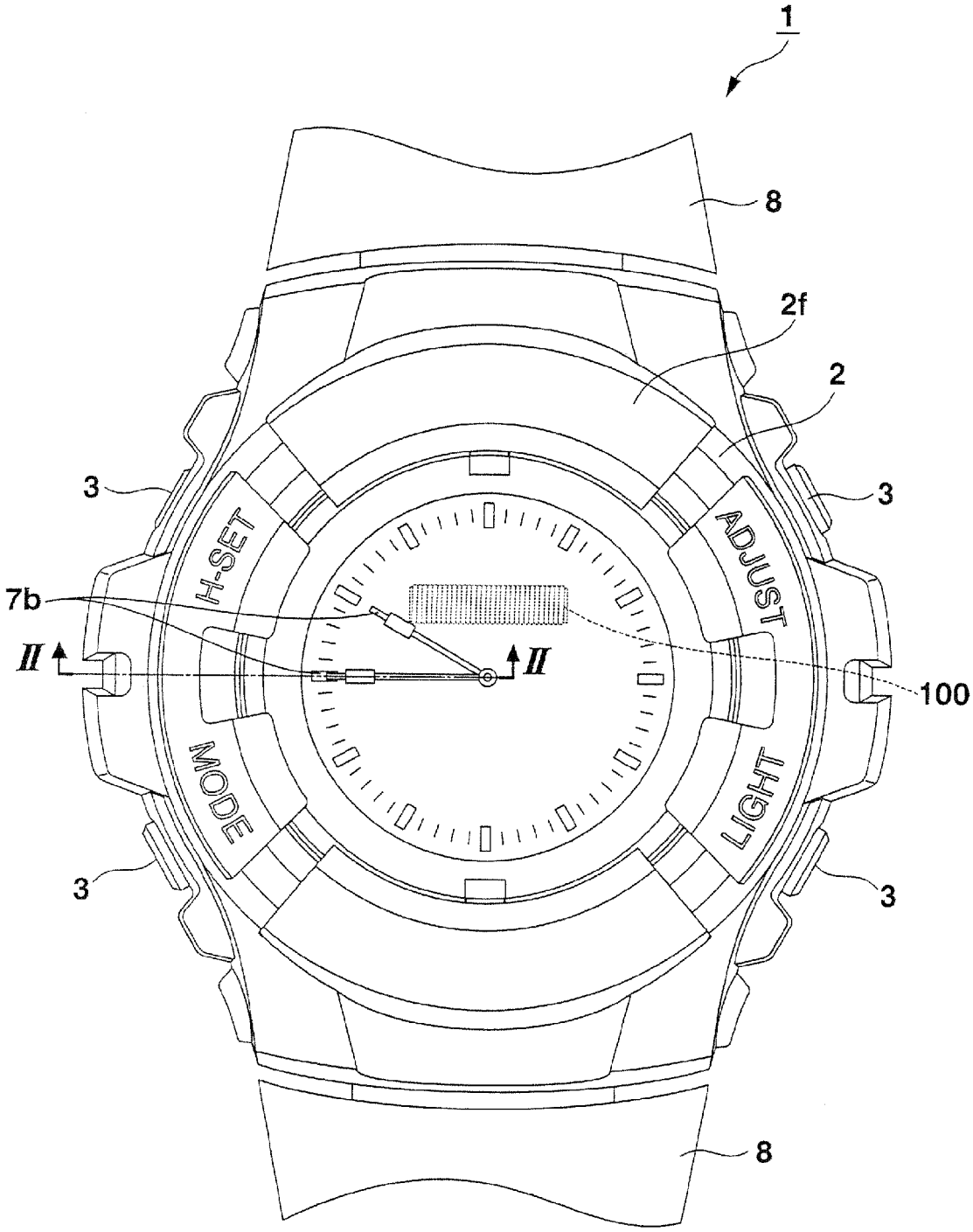
FIG. 1 is a plan view showing a watch having a built-in antenna according to Embodiment 1 of the present invention.
Figure 2:
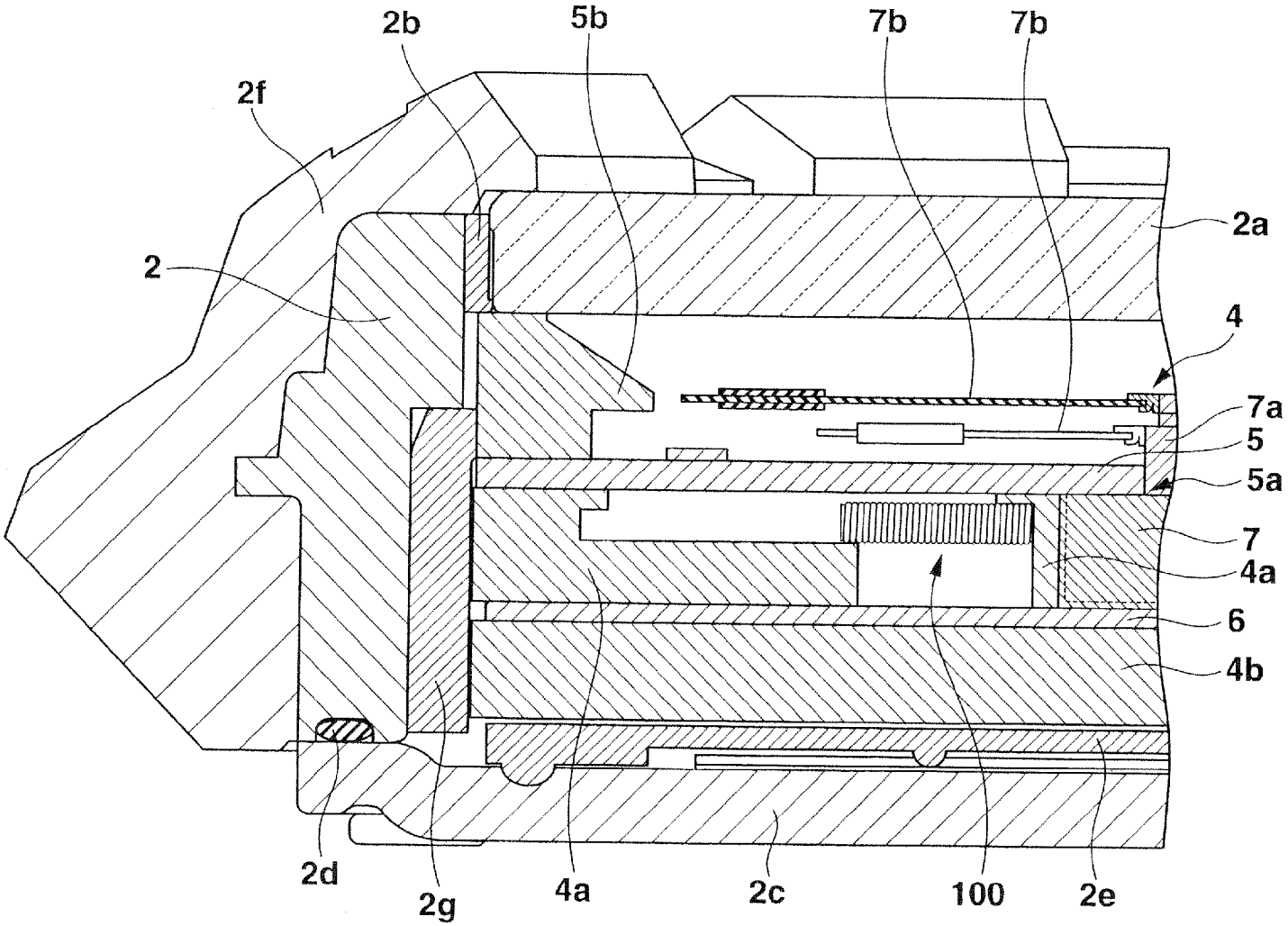
FIG. 2 is a sectional view taken along a line II-II in FIG. 1.

FIG. 1 is a plan view of a watch 1 having a built-in antenna 100 according to Embodiment 1 of the present invention, and FIG. 2 is a sectional view taken along a line II-II in FIG. 1.

As shown in FIGS. 1 and 2, the watch 1 as an electronic device comprises a watch case 2 as a device case in which a watch timing portion 4 is stored, and band members 8 for attaching the watch case to user's wrist.

A watch glass 2*a* with a packing 2*b* is fitted into an upper surface center of the watch case 2 in such a manner that a dial plate 5 is visible, and switches 3 for instructing execution of each type of function of the watch 1 are attached to a periphery of the watch case 2. A bezel 2*f* is disposed on an upper outer periphery of the watch case 2, and a back lid 2*c* molded of a metal is attached to a bottom surface of the watch case 2 with a waterproof ring 2*d*.

The watch timing portion 4 comprises: an upper housing portion 4*a*; a lower housing portion 4*b*; an analog pointer mechanism 7 which operates pointers 7*b* such as an hour pointer and a second pointer; the antenna 100 which receives a standard radio wave; and a circuit substrate 6 connected to the analog pointer mechanism 7 and the antenna 100 to control them. Peripheral edge portions of the lower housing portion 4*b*, the upper housing portion 4*a*, and the dial plate 5 are attached to an inner frame 2*g* disposed on an inner peripheral surface of the watch case 2.

The lower housing portion 4*b* is supported above a buffer member 2*e* disposed on the back lid 2*c*, and the circuit substrate 6 is disposed between the lower housing portion 4*b* and the upper housing portion 4*a*. The dial plate 5 is disposed on an upper surface of the upper housing portion 4*a*, and a frame-like member 5*b* is disposed on the upper surface peripheral edge portion of the dial plate 5 in a state in which the member abuts on a lower surface peripheral edge portion of the watch glass 2*a*.

The analog pointer mechanism 7 has a pointer shaft 7*a* extending upward from a shaft hole 5*a* formed in the dial plate 5, and pointers 7*b* such as the hour pointer and a minute pointer attached to the pointer shaft 7*a*, and operates the pointers 7*b* above the dial plate 5. A battery (not shown) for operating the analog pointer mechanism 7 is incorporated in, for example, the lower housing portion 4*b*.

The antenna 100 is supported by the upper housing portion 4*a* and disposed between the lower housing portion 4*b* and the dial plate 5.

Figure 3C:
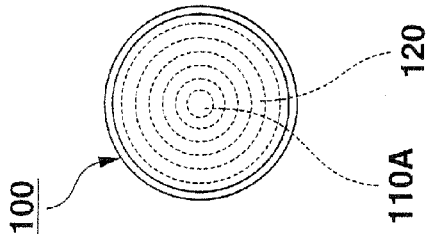
FIG. 3C is a side view showing the antenna according to Embodiment 1 of the present invention.
Figure 3A:
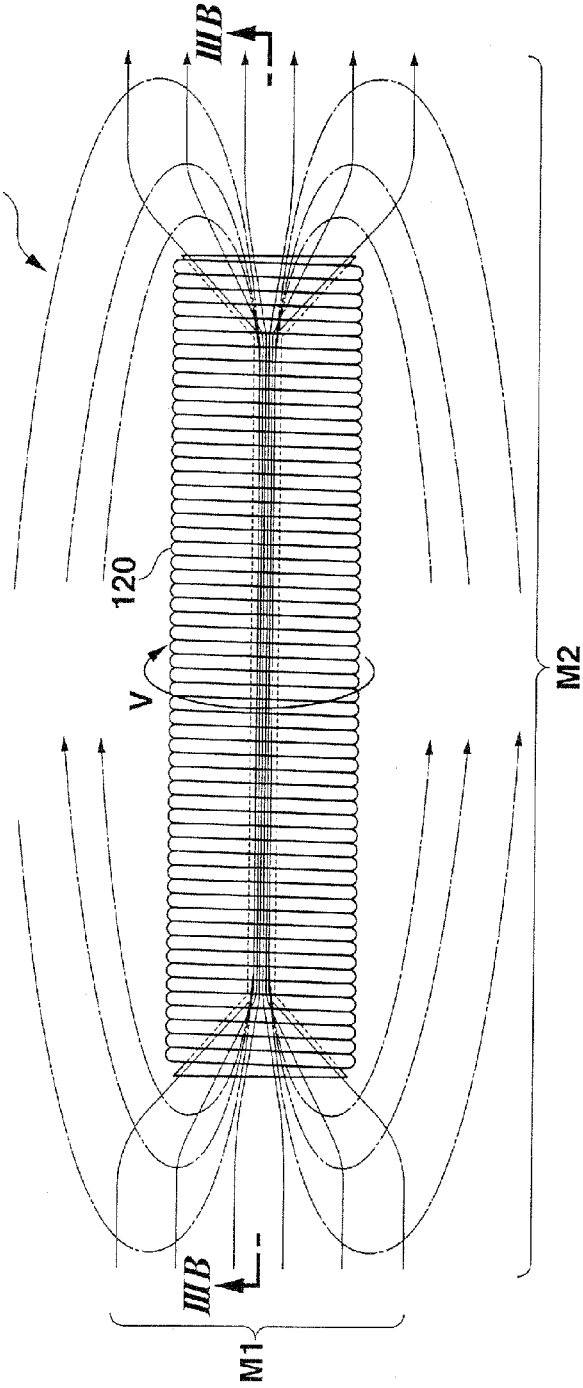
FIG. 3A is a front view showing the antenna according to Embodiment 1 of the present invention.
Figure 3B:
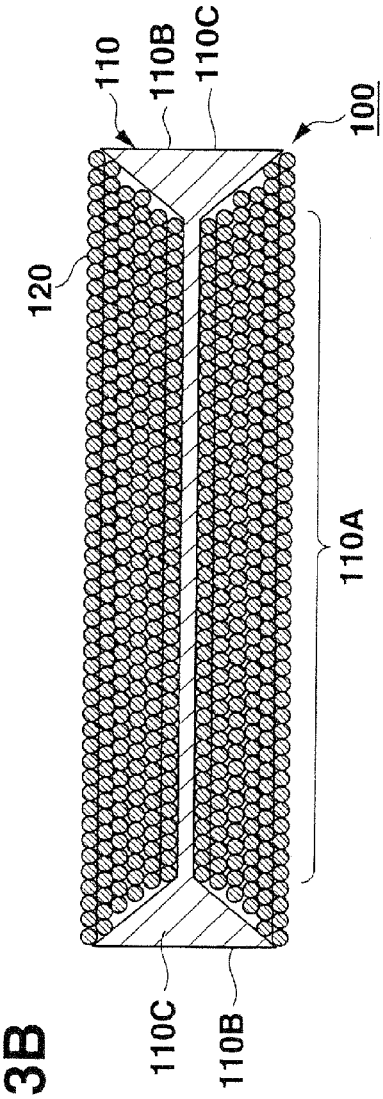
FIG. 3B is a sectional view taken along a line IIIB-IIIB in FIG. 3A and showing the antenna according to Embodiment 1 of the present invention.

FIGS. 3A to 3C are explanatory views of the antenna 100 according to Embodiment 1, FIG. 3A is a front view of the antenna 100, FIG. 3B is a sectional view taken along a line IIIB-IIIB in FIG. 3A, and FIG. 3C is a side view of the antenna 100.

As shown in FIGS. 3A to 3C, the antenna 100 comprises: a magnetic core 110; and a coil 120 wound around the core 110.

The core 110 is formed into a bulk configuration using an amorphous metal as a material. Here, the bulk configuration refers to a solid shape formed using a casting mold or a mold. Specifically, examples of the bulked amorphous metal include an Fe-based alloy, a Pd-based alloy, a Zr-based alloy, an Ni-based alloy and the like. Examples of the Fe-based alloy include an Fe—M—B (M=Cr, W, Ta, Nb, Hf, Zr)-based alloy, an Fe—Co—RE—B (RE=Nb, Sm, Tb, Dy)-based alloy and the like. More specifically, the amorphous metal is formed of a composition such as $Pd_{40}Cu_{30}Ni_{10}P_{20}$ or $Fe_{81}B_{13}Si_{14}C_2$. Moreover, when the melted alloy is worked into the bulk configuration by casting, an inner configuration is configured to be amorphous. More specifically, to manufacture the core 110, for example, the alloy as the amorphous metal is melted, poured into the mold, and thereafter sintered at a crystallization starting temperature or a lower temperature in a state in which a pressure of, for example, 200 Mpa or more is applied.

The core 110 is a rod member, and each end surface 110B is circular. Moreover, each of end portions 110C of the core 110 has a conical shape. A sectional area of the core 110 gradually decreases from each end surface 110B disposed in the end portion 110C of the core 110 toward a central portion (shaft portion) 110A, and is substantially constant in the central portion 110A of the core 110. Therefore, an area of each end surface 110B disposed in the end portion 110C of the core 110, and a sectional area of the end portion 110C are larger than the sectional area of the central portion 110A of the core 110.

Here, the core 110 is made of the amorphous metal. Therefore, for example, even when the central portion 110A is configured to be thinner than that of the core made of ferrite, an equal or more strength can be obtained. Specifically, for example, in a case where a diameter of the central portion (shaft portion) of the core made of ferrite is set to 1.5 mm, a diameter of the central portion 110A of the core using the amorphous metal can be set to 0.5 to 1.0 mm.

Moreover, the coil 120 is layered and wound around the core 110. A diameter obtained by adding up the diameters of the core 110 and the laminated coil 120 is substantially equal to the diameter of each end surface 110B of the core 110.

Furthermore, when this antenna 100 is placed in a magnetic field (hereinafter referred to as the "signal magnetic field") by a standard radio wave, the magnetic field acts on the antenna 100 as follows. It is to be noted that since a long wave having a wavelength of several kilometers is used as the standard radio wave, the magnetic field may be regarded as a parallel magnetic field in which a size of a magnetic field component does not change depending on a position in a range of an antenna size. Therefore, to simplify description, the signal magnetic field is regarded as the parallel magnetic field in the following description.

When the core 110 is placed in the signal magnetic field in such a manner that an axial line of the coil 120 is parallel to a magnetic field direction, as shown in FIG. 3A, a magnetic flux (hereinafter referred to as the "signal magnetic flux") M1 by the signal magnetic field is concentrated on the core 110 having a specific permeability which is higher than that of a surrounding space. As a result, the signal magnetic flux M1 is interlinked with the coil 120, and in the coil 120, there is generated such an induced electromotive force V as to generate a magnetic flux (hereinafter referred to as the "generated magnetic flux") M2 in a direction to inhibit a change of the signal magnetic flux M1 in the coil 120 according to Lenz's law.

It is to be noted that since the signal magnetic field is an alternating magnetic field, and a size or a direction of the signal magnetic flux M1 periodically changes, the induced electromotive force V turns to an alternating power. The generated magnetic flux M2 turns to an alternating magnetic field whose size or direction periodically changes following the change of the signal magnetic flux M1 with time.

Moreover, the induced electromotive force V generated in the coil 120 is detected by a reception circuit (not shown) connected to the coil 120. The reception circuit includes a tuning capacitor for tuning to a frequency (40 kHz or 60 kHz) of the standard radio wave to be received, or a loss resistance. The reception circuit is mounted on, for example, the circuit substrate 6 shown in FIG. 2.

Furthermore, even in the core 110, there is generated such induced electromotive force as to generate the generated magnetic flux M2 in the direction to inhibit the change of the signal magnetic flux M1. Accordingly, an eddy current is generated inside the core 110, and there is generated an eddy current loss by the eddy current in the signal magnetic flux M1.

Here, an electric resistance of the core 110 is proportional to a length of the core 110 in a longitudinal direction, and inversely proportional to the sectional area of the core 110. The central portion 110A of the core 110 formed of the amorphous metal can be configured to be thinner than that of, for example, the core formed of ferrite. The sectional area of the central portion 110A can be set to be smaller than the area of the end surface 110B, and the electric resistance of the core 110 can be increased.

Therefore, the eddy current of the signal magnetic flux M1 generated inside the core 110 is reduced, and the eddy current loss by the eddy current is inhibited.

Figure 4:
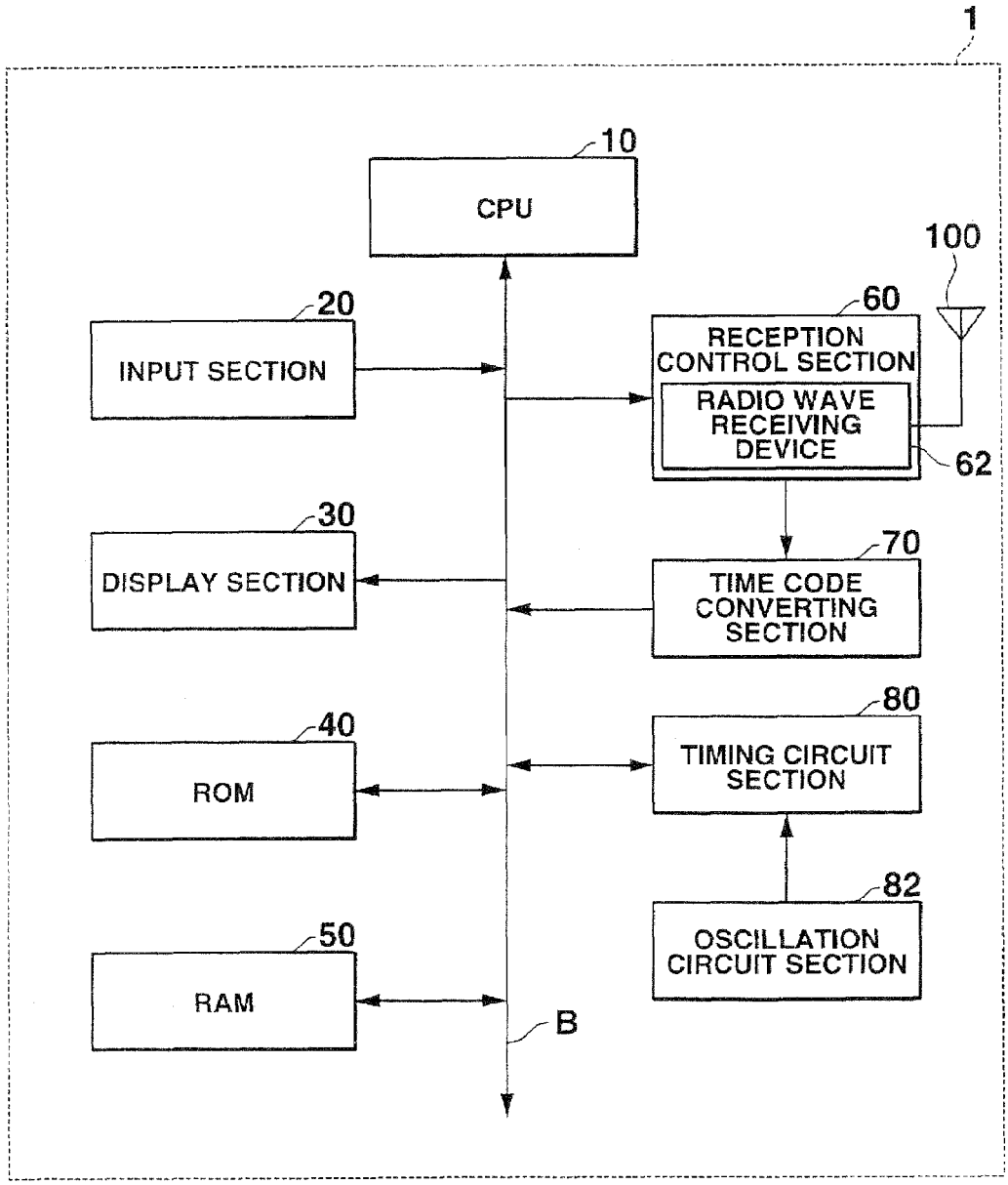
FIG. 4 is a block diagram showing an internal constitution of the watch.

FIG. 4 is a block diagram showing an internal constitution of the watch 1. According to the figure, the watch 1 comprises: a CPU (Central Processing Unit) 10; an input section 20; a display section 30; a ROM (Read Only Memory) 40; a RAM (Random Access Memory) 50; a reception control section 60; a time code converting section 70; a timing circuit section 80; and an oscillation circuit section 82. The respective sections excluding the oscillation circuit section 82 are connected to one another via a bus B, and the oscillation circuit section 82 is connected to the timing circuit section 80.

The CPU 10 reads a program stored in the ROM 40 at a predetermined timing or in response to an operation signal input from the input section 20 to develop the program in the RAM 50, and gives an instruction to each section of the watch 1 or transfers data based on the program. Specifically, the reception control section 60 is controlled to execute reception processing of the standard radio wave, for example, every predetermined time, and present time data timed by the timing circuit section 80 is corrected based on a standard time code (not shown) input from the time code converting section 70.

The input section 20 comprises the switches 3 and the like for instructing execution of each type of function of the watch 1. When these switches 3 are operated, a corresponding operation signal is output to the CPU 10.

The display section 30 includes the dial plate 5 or the analog pointer mechanism 7 controlled by the CPU 10, and displays a present time timed by the timing circuit section 80.

The ROM 40 stores a system program or an application program relating to the watch 1, and a program, data or the like for realizing the present embodiment.

The RAM 50 is used as an operation region of the CPU 10, and temporarily stores the program read from the ROM 40, the data processed by the CPU 10 or the like.

The reception control section 60 is provided with a radio wave receiving device 62. The radio wave receiving device 62 has the antenna 100, and the reception circuit (not shown), cuts an unnecessary frequency component of the standard radio wave received by the antenna 100 to extract the corresponding frequency signal, and outputs to the time code converting section 70 a signal converted into an electric signal corresponding to the frequency signal.

The time code converting section 70 converts the electric signal input from the radio wave receiving device 62 into a digital signal, generates a standard time code including data required for a clock function, such as an integration code or a week day code, and output the standard time code to the CPU 10.

The timing circuit section 80 counts signals input from the oscillation circuit section 82 to set the present time, and outputs the timed present time data to the CPU 10. The oscillation circuit section 82 is a circuit which constantly outputs a clock signal at a certain frequency.

As described above, according to the antenna 100 of Embodiment 1, the core 110 is manufactured by forming the amorphous metal into the bulk configuration. Therefore, the core 110 can be worked into an arbitrary shape, and the antenna 100 having a shape more adapted to a purpose can be manufactured. Since any thin film is not laminated as in the conventional core of the amorphous metal, working steps can be reduced, and the antenna 100 can be manufactured more easily.

Moreover, since the core 110 is made of the amorphous metal formed into the bulk configuration, and the amorphous metal has a remarkably high permeability, the sensitivity of the antenna 100 can be remarkably improved. Since the amorphous metal has a high strength, the central portion 110A of the core 110 can be configured to be remarkably thin, and a winding number of the coil 120 can be increased, the sensitivity of the antenna 100 can be improved. Since the amorphous metal is not prone to rust, and has a satisfactory temperature stability, life of the antenna 100 can be lengthened.

Furthermore, since the area of each end surface 110B of the core 110, and the section area of each end portion 110C of the corresponding core 110 are larger than the sectional area of the central portion 110A of the core 110, more standard radio waves can be received, and the sensitivity of the antenna 100 can be improved.

Additionally, since the sectional area of the central portion 110A of the core 110 is smaller than the area of each end surface 110B owned by the end portion 110C of the core 110 and the sectional area of the end portion 110C of the core 110, an induced current generated in the core 110 can be reduced, and the eddy current loss can be suppressed.

Moreover, since the watch 1 has the built-in antenna 100 manufactured by forming the amorphous metal into the bulk configuration, the antenna 100 having the shape more adapted to the purpose can be built in. A degree of freedom of design increases, and the watch 1 can be miniaturized more. Since the core 110 of the built-in antenna 100 is manufactured by molding the amorphous metal, the radio waves can be received with good sensitivity, and the watch 1 can be manufactured at a reduced cost. Since the life of the built-in antenna 100 is lengthened, the life of the watch 1 can be lengthened more.

The antenna 100 according to Embodiment 1 of the present invention may be modified as in Modifications 1 to 4.

(Modification 1)

Figure 5A:
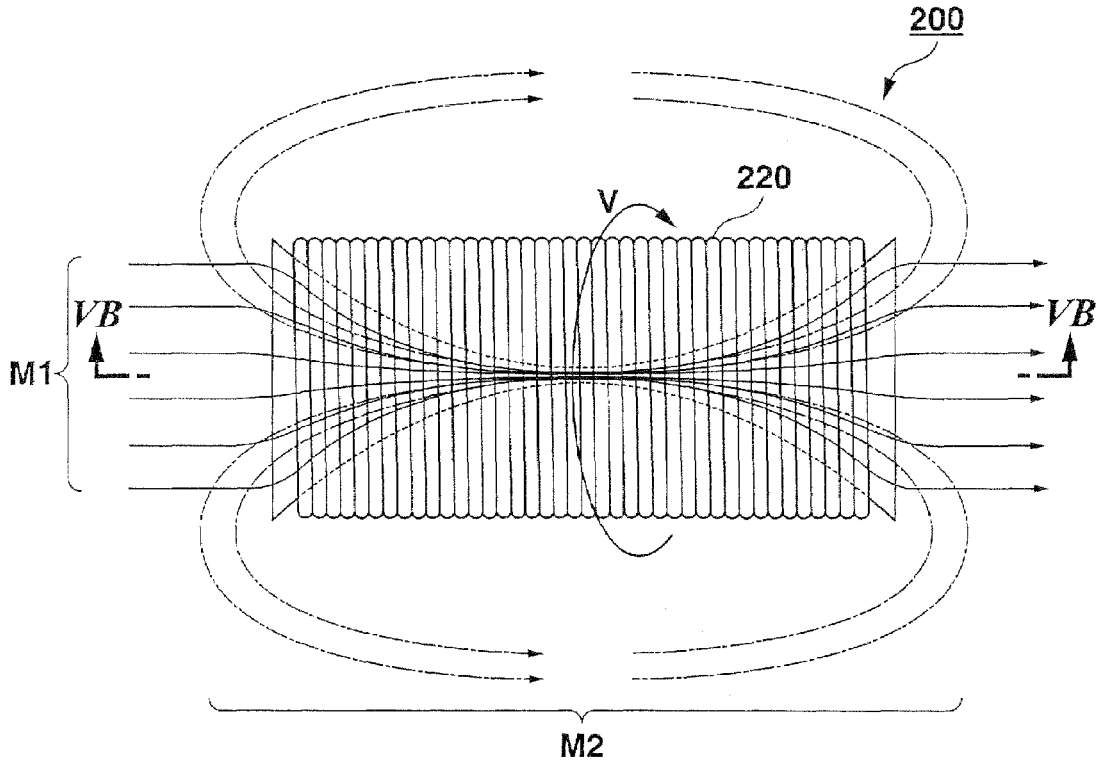
FIG. 5A is a front view showing the antenna according to Modification 1 of Embodiment 1 of the present invention.
Figure 5B:
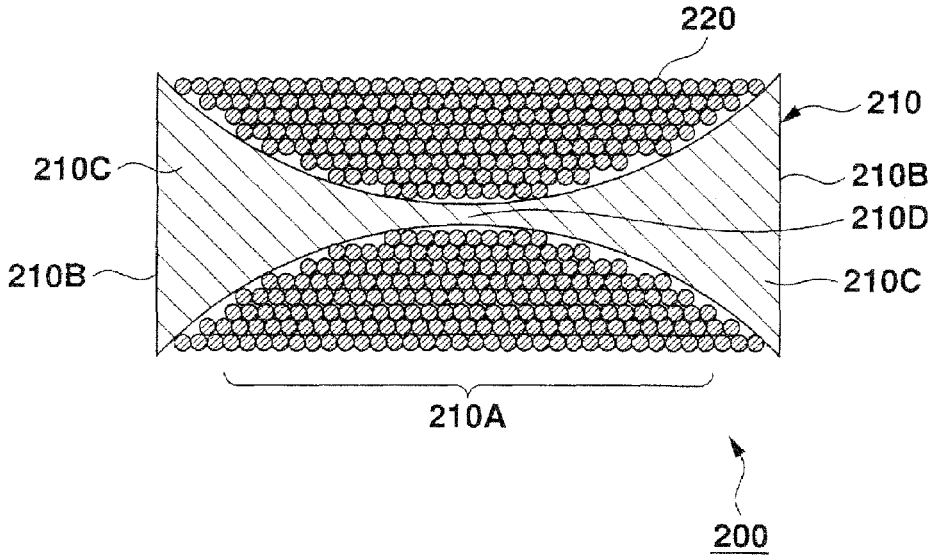
FIG. 5B is a sectional view taken along a line VB-VB in FIG. 5A.

FIGS. 5A and 5B are views for explaining an antenna 200 according to Modification 1 of Embodiment 1, FIG. 5A is a front view of the antenna 200, and FIG. 5B is a sectional view taken along a line VB-VB in FIG. 5A.

As shown in FIGS. 5A, 5B, according to Modification 1 of the antenna 100 of Embodiment 1, the antenna 200 comprises a magnetic core 210 and a coil 220 wound around the core 210.

As to the core 210, an amorphous metal is used as a material and formed into a bulk configuration in the same manner as in the core 110. As shown in FIGS. 5A and 5B, the core is a long rod member, and end surfaces 210B of end portions 210C are circular. A sectional area of the core 210 continuously decreases from each end surface 210B toward a center 210D. Specifically, the sectional area is continuously reduced from the opposite end surfaces 210B and 210B toward the center 210D. Therefore, an area of each end surface 210B owned by the end portion 210C of the core 210, and a sectional area of the end portion 210C of the core 210 are larger than the sectional area of a central portion 210A of the core 210.

Here, the core 210 is made of the amorphous metal. Therefore, for example, even when the central portion 210A is configured to be thinner than a core made of ferrite, an equal or more strength can be obtained.

Moreover, a winding number of coil 220 wound around the core 210 in the center 210D is larger than that in the opposite end portions 210C, 210C of the core 210.

Furthermore, when this antenna 200 is placed in a signal magnetic field in such a manner that an axial line of the coil 220 is parallel to a magnetic field direction, as shown in FIG. 5A, a signal magnetic flux M1 is concentrated on the core 210 having a specific permeability which is higher than that of a surrounding space. As a result, the signal magnetic flux M1 is interlinked with the coil 220, and in the coil 220, there is generated such an induced electromotive force V as to generate a generated magnetic flux M2 in a direction to inhibit a change of the signal magnetic flux M1 in the coil 220 according to Lenz's law.

In addition, the induced electromotive force V generated in the coil 220 is detected by a reception circuit (not shown) connected to the coil 220.

Moreover, even in the core 210, there is generated such induced electromotive force as to generate the generated magnetic flux M2 in the direction to inhibit the change of the signal magnetic flux M1 in the core 210. Accordingly, an eddy current is generated inside the core 210, and there is generated an eddy current loss by the eddy current in the signal magnetic flux M1.

Here, as to the central portion 210A of the core 210, since the central portion 210A of the core 210 is configured to be thinner than that of a core made of ferrite, an electric resistance of the core 210 is larger than that of the core made of the ferrite, the eddy current generated in the core 210 is reduced, and an eddy current loss by the eddy current of the signal magnetic flux M1 is inhibited.

According to the antenna 200 of Modification 1 of Embodiment 1, since the sectional area of the core 210 is continuously reduced from the opposite end surfaces 210B, 210B toward the center 210D, the electric resistance increases from the opposite end surfaces 210B, 210B toward the center 210D. An induced current generated in the core 210 can be reduced, and the eddy current loss can be suppressed.

Moreover, since the winding number of the coil 220 in the central portion 210A is larger than that in each end portion 210*c* of the core 210, a magnetic flux density increases toward the center 210D, the induced electromotive force (reception voltage) generated in the center 210D can be increased more, and a reception sensitivity of the antenna 200 can be raised.

Furthermore, since the core 210 has a smooth shape in such a manner that the sectional area of the core 210 is continuously reduced from the opposite end surfaces 210B and 210B toward the center 210D, the core can be easily molded from a mold or the like.

(Modification 2)

Figure 6B:
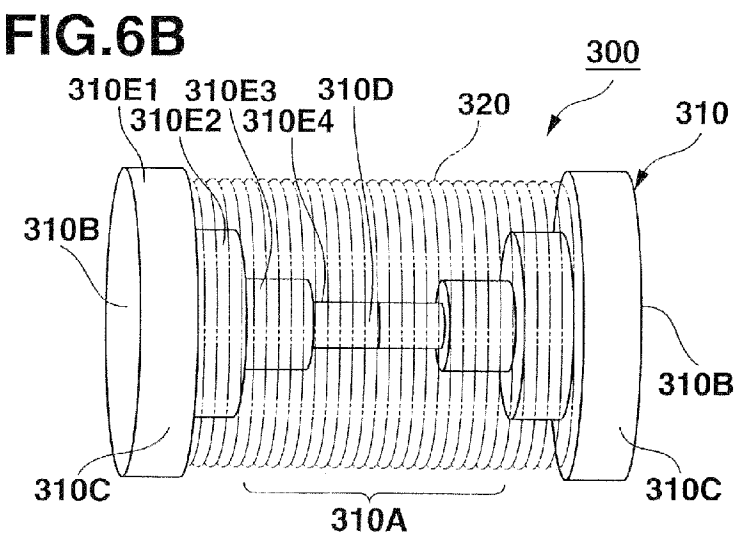
FIGS. 6A, 6B, and 6C are perspective views showing three examples of the antenna according to Modification 2 of Embodiment 1 of the present invention.
Figure 6A:
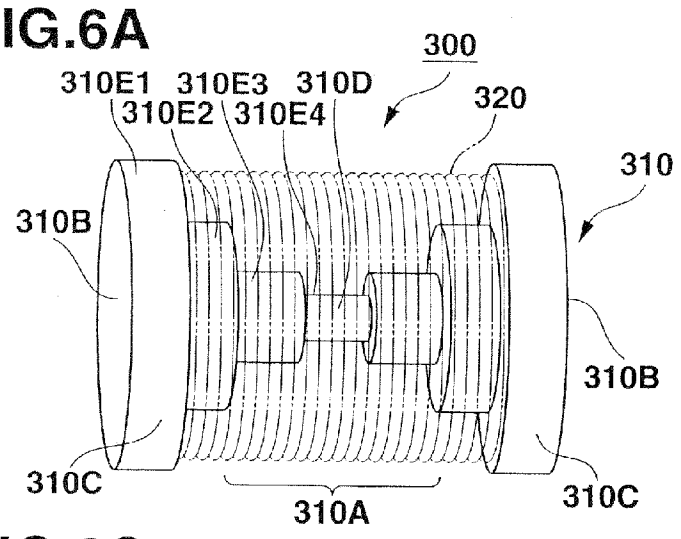
Figure 6C:
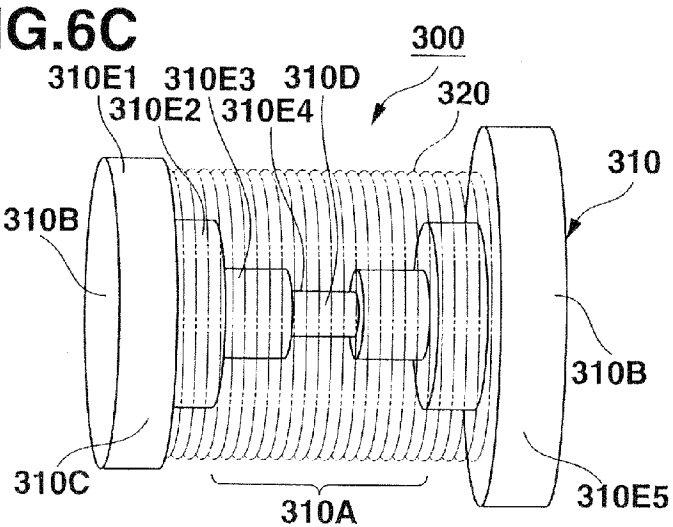

FIGS. 6A to 6C are perspective views showing three examples of an antenna 300 according to Modification 2 of Embodiment 1.

According to Modification 2 of the antenna 100 of Embodiment 1, as shown in FIGS. 6A to 6C, the antenna 300 comprises: a magnetic core 310; and a coil 320 wound around the core 310.

As to the core 310, core members 310E1 to 310E4 are formed into columnar shapes having various diameters, using amorphous metals as materials in the same manner as in the core 310, and flat surface portions of the core members 310E1 to 310E4 are connected and fixed to one another.

Specifically, in the core 310, flat surfaces of the respective core members 310E1 to 310E4 are connected and fixed to one another in such a manner that diameters of the respective core members 310E1 to 310E4 are reduced toward a center 310D of the core 310 in a stepwise manner. As a result, a sectional area of the core 310 is reduced from each end portion 310C of the core 310 toward the center 310D of the core 310. Therefore, an area of each end surface 310B owned by the end portion 310C of the core 310 is larger than a sectional area of a central portion 310A of the core 310.

Here, any adhesive may be used as an adhesive for connecting and fixing core members 310E to one another as long as the amorphous metal is bonded to another amorphous metal, and a nonconductive adhesive is preferable in respect of prevention of occurrence of an eddy current.

Moreover, the core 310 is made of the amorphous metal. Therefore, for example, even when the central portion 310A is configured to be thinner than that of a core formed of ferrite, an equal or more strength can be obtained.

Furthermore, a winding number of the coil 320 wound around the core 310 in the center 310D is larger than that in the opposite end portions 310C, 310C of the core 310.

Additionally, according to Modification 2 of Embodiment 1, since the core 310 is manufactured by the connecting of the core members 310E, a size or a shape of the antenna 300 can be changed more easily, when changing a combination of the core members 310E. For example, as shown in FIG. 6B, when the core member 310E4 configured to be thinnest is set to be longer than that shown in FIG. 6A, the length of the center 310D of the core 310 in a longitudinal direction can be lengthened. As shown in FIG. 6C, when changing a size of the core member 310E1 for use in one end portion 310C of the core 310 and that of the core member 310E5 for use in the other end portion 310C, the antenna 300 can be formed into an asymmetric shape.

According to the antenna 300 of Modification 2 of Embodiment 2, since the sectional area of the core 310 is reduced from the opposite end portions 310C, 310C of the core 310 toward the center 310D in the stepwise manner, an electric resistance of the core 310 increases from the opposite end portions 310C, 310C of the core 310 toward the center 310D of the core 310. An induced current generated in the core 310 can be reduced, and an eddy current loss can be suppressed.

Moreover, since a winding number of the coil 320 in the central portion 310A is larger than that in each end portion 310C of the core 310, a magnetic flux density increases toward the center 310D, an induced electromotive force (reception voltage) generated in the center 310D can be increased, and a receiving sensitivity of the antenna 300 can be raised.

Furthermore, the core members 310E formed into the columnar shapes having various sizes are connected and fixed to one another to thereby form the core 310. Therefore, since a combination of the core members 310E configuring the core 310 is changed, the size or the shape of the antenna 300 can be easily changed.

(Modification 3)

Figure 7B:
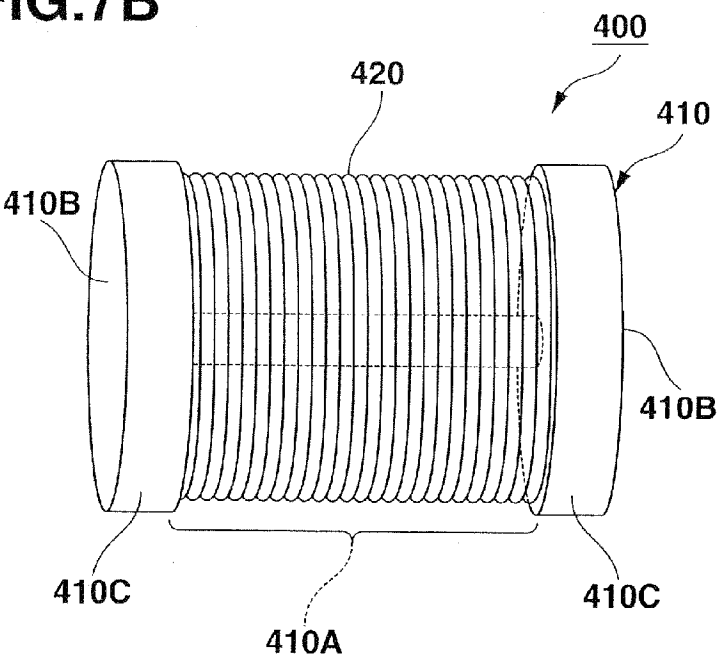
FIGS. 7A and 7B are perspective views showing two examples of the antenna according to Modification 3 of Embodiment 1 of the present invention.
Figure 7D:
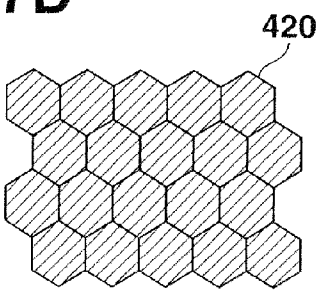
FIGS. 7C and 7D are sectional views of two examples of a coil wound around the antenna according to Modification 3 of Embodiment 1 of the present invention.
Figure 7A:
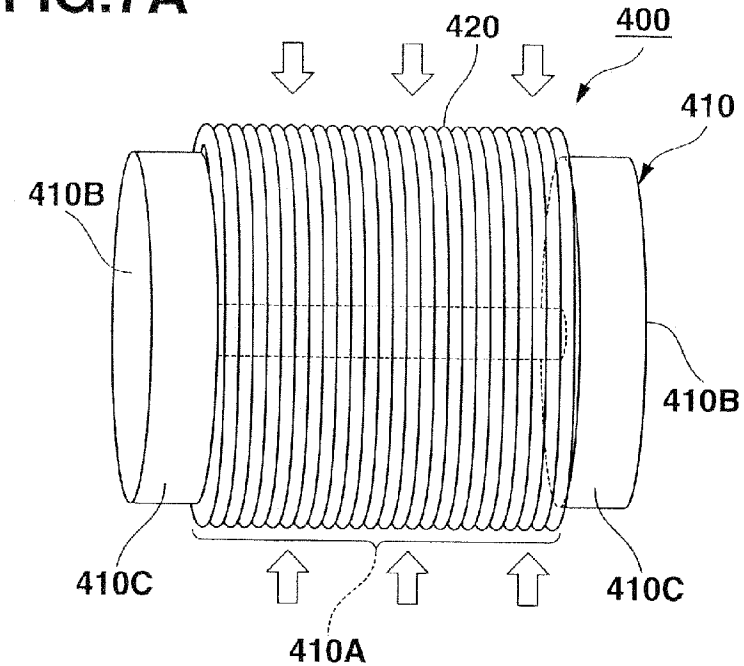
Figure 7C:
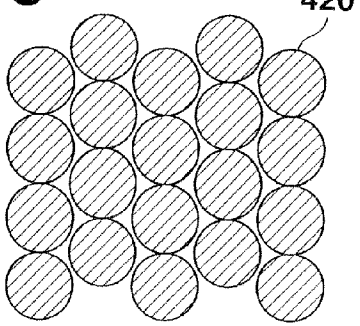

FIGS. 7A to 7D are views for explaining an antenna 400 according to Modification 3 of Embodiment 1, FIGS. 7A and 7B are perspective views showing two examples of the antenna 400, and FIGS. 7C and 7D are sectional views showing two examples of a coil 420 wound around cores 410 of the antennas 400 shown in FIGS. 7A and 7B, respectively.

According to Modification 3 of the antenna 100 of Embodiment 1, as shown in FIGS. 7A to 7D, the antenna 400 comprises the magnetic core 410 and the coil 420 wound around the core 410.

As shown in FIGS. 7A to 7D, the core 410 is formed into a bulk configuration using an amorphous metal in the same manner as in the core 110. The core 410 comprises a central portion 410A having a longitudinal round rod shape, and columnar end portions 410C. A flat surface of each end portion 410C substantially has right angles with respect to the central portion 410A. Therefore, an area of each end surface 410B of the core 410 is larger than a sectional area of the central portion 410A of the core 410.

Moreover, the core 410 is made of an amorphous metal. Therefore, for example, even when the central portion 410A of the core is configured to be thinner than that of a core formed of ferrite, an equal or more strength can be obtained.

Furthermore, the coil 420 is layered and wound around the central portion 410A of the core 410. First, the coil 420 is wound around the central portion 410A of the core 410 in such a manner that a diameter obtained by adding up a diameter of the central portion 410A and that of the laminated coil 420 is larger than that of each end portion 410C of the core 410 (FIG. 7A). Thereafter, the coil is compressed, when a pressure is applied to an outer peripheral surface of the antenna from a direction vertical to a longitudinal direction of the antenna 400. As shown in FIG. 7C, a section of the coil 420 before compressed has a circular shape, and small gaps exist among the respective coils 420. However, as to the coil 420 after compressed, as shown in FIG. 7D, the respective coils 420 are deformed and adhere to one another. Moreover, when the coil 420 wound around the central portion 410A is compressed, the diameter obtained by adding up the diameter of the central portion 410A and that of the laminated coil 420 is substantially equal to that of each end portion 410C of the core 410 (FIG. 7B).

It is to be noted that the core 410 is formed of the amorphous metal. Therefore, unlike, for example, an antenna made of ferrite, even when the pressure or the like is added to the core after winding the coil 420 therearound, the core does not break. When the pressure is added, the winding number of the coil 420 can be increased more.

(Modification 4)

Figure 8:
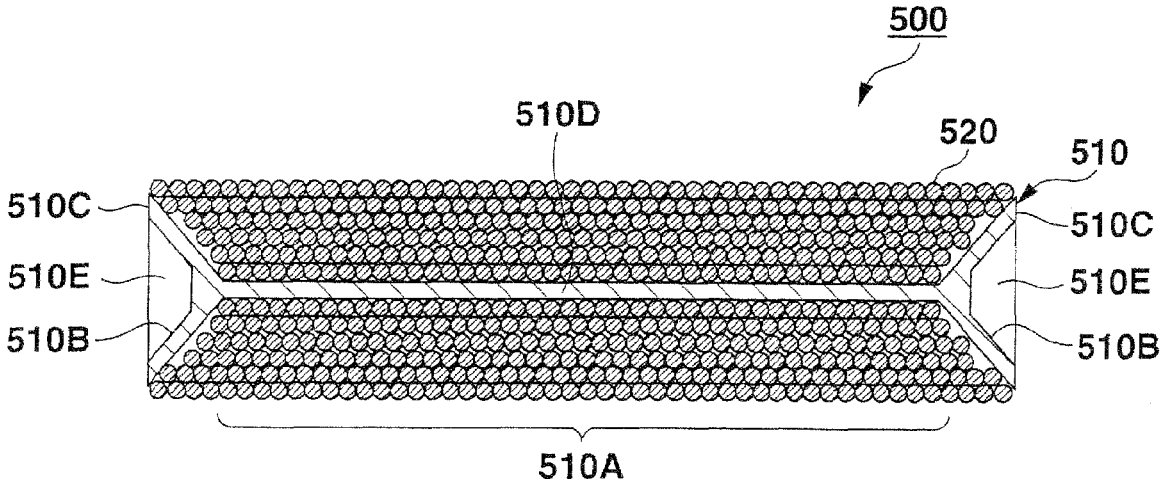
FIG. 8 is a sectional view showing the antenna according to Modification 4 of Embodiment 1 of the present invention.

FIG. 8 shows a sectional view of an antenna 500 according to Modification 4 of Embodiment 1.

According to Modification 4 of the antenna 100 of Embodiment 1, as shown in FIG. 8, the antenna 500 comprises a magnetic core 510 and a coil 520 wound around the core 510.

The core 510 is formed into a bulk configuration using an amorphous metal as a material. As shown in FIG. 8, the core is a long rod-like member, and an outer shape of an end surface 510B included each end portion 510C of the core 510 is circular. Concaves 510E, 510E opened outward in an axial direction of the core 510 are formed in the opposite end portions 510C, 510C of the core 510. Sectional areas of the end portions 510C, 510C of the core 510 are reduced as much as the formed concaves 510E, 510E. An area of each end surface 510B of the core 510 is larger than the sectional area of a central portion 510A of the core 510.

Moreover, the core 510 is made of the amorphous metal. Therefore, for example, even when the central portion 510A is configured to be thinner than that of a core formed of ferrite, an equal or more strength can be obtained.

A winding number of the coil 520 wound around the core 510 in a center 510D is larger than that in the opposite end portions 510C, 510C of the core 510.

According to the antenna 500 of Modification 4 of Embodiment 1, since the concaves 510E, 510E are disposed in the opposite end portions 510C, 510C of the core 510, a radio wave receiving sensitivity of the core 510 is not impaired, and sectional areas of the opposite end portions 510C, 510C can be reduced as much as the disposed concaves 510E. Accordingly, electric resistances of the opposite end portions 510C, 510C can be increased, and an eddy current low resulting from an induced current generated in the core 510 can be suppressed more.

(Modification 5)

Figure 9:
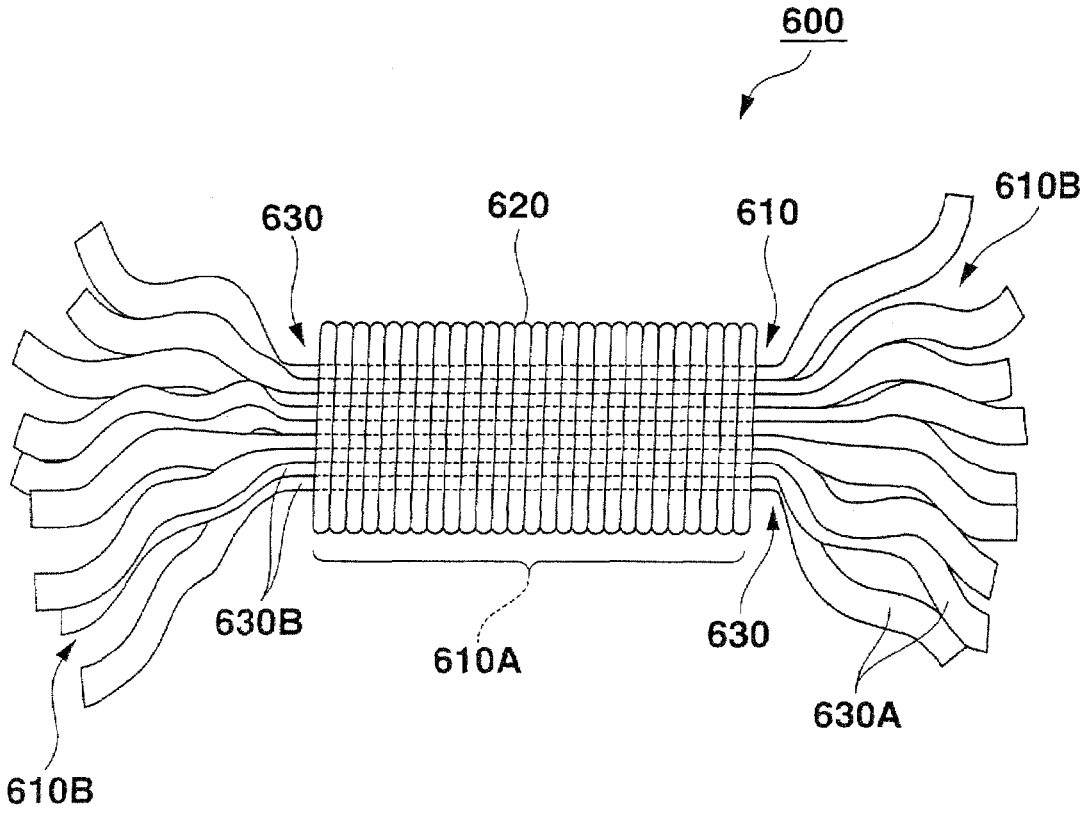
FIG. 9 is a side view showing the antenna according to Modification 5 of Embodiment 1 of the present invention.

FIG. 9 shows a side view of an antenna 600 according to Modification 5 of Embodiment 1.

According to Modification 5 of the antenna 100 of Embodiment 1, as shown in FIG. 9, the antenna 600 comprises a magnetic core 610 and a coil 620 wound around the core 610.

To form the core 610, as shown in FIG. 9, there are bundled up a large number of wire rods 630 formed using amorphous metals in the same manner as in the core 110. End portions of the wire rods 630 are formed into thin foil-like portions 630A. Moreover, when the wire rods 630 are bundled up, the foil-like portions 630A form end portions 610B of the antenna 600. Central portions 630B of the wire rods 630 sandwiched between the foil-like portions 630A form a central portion 610A of the antenna 600. The coil 620 is layered and wound around the central portion 610A of the antenna 600.

The wire rods 630 are formed using the amorphous metals. Therefore, for example, even when the wire rods are configured to be thinner than those formed of ferrite, an equal or more strength can be obtained.

Moreover, the wire rods 630 are bundled up to provide the core 610. The central portions 630B and the foil-like portions 630A of the wire rods 630 are integrally formed into a bulk configuration using the amorphous metal as a material, and flat surfaces of the foil-like portions 630A receive a signal magnetic flux (not shown).

According to the antenna 600 of Modification 5 of Embodiment 1, the wire rods 630 on end sides have the thinly formed foil-like portions 630A. Therefore, the signal magnetic flux (not shown) can be received by flat surfaces of the foil-like portions 630A, a reception area can be set to be broader than that of each wire rod 630 as such, and a receiving sensitivity can be improved.

Embodiment 2

Figure 10:
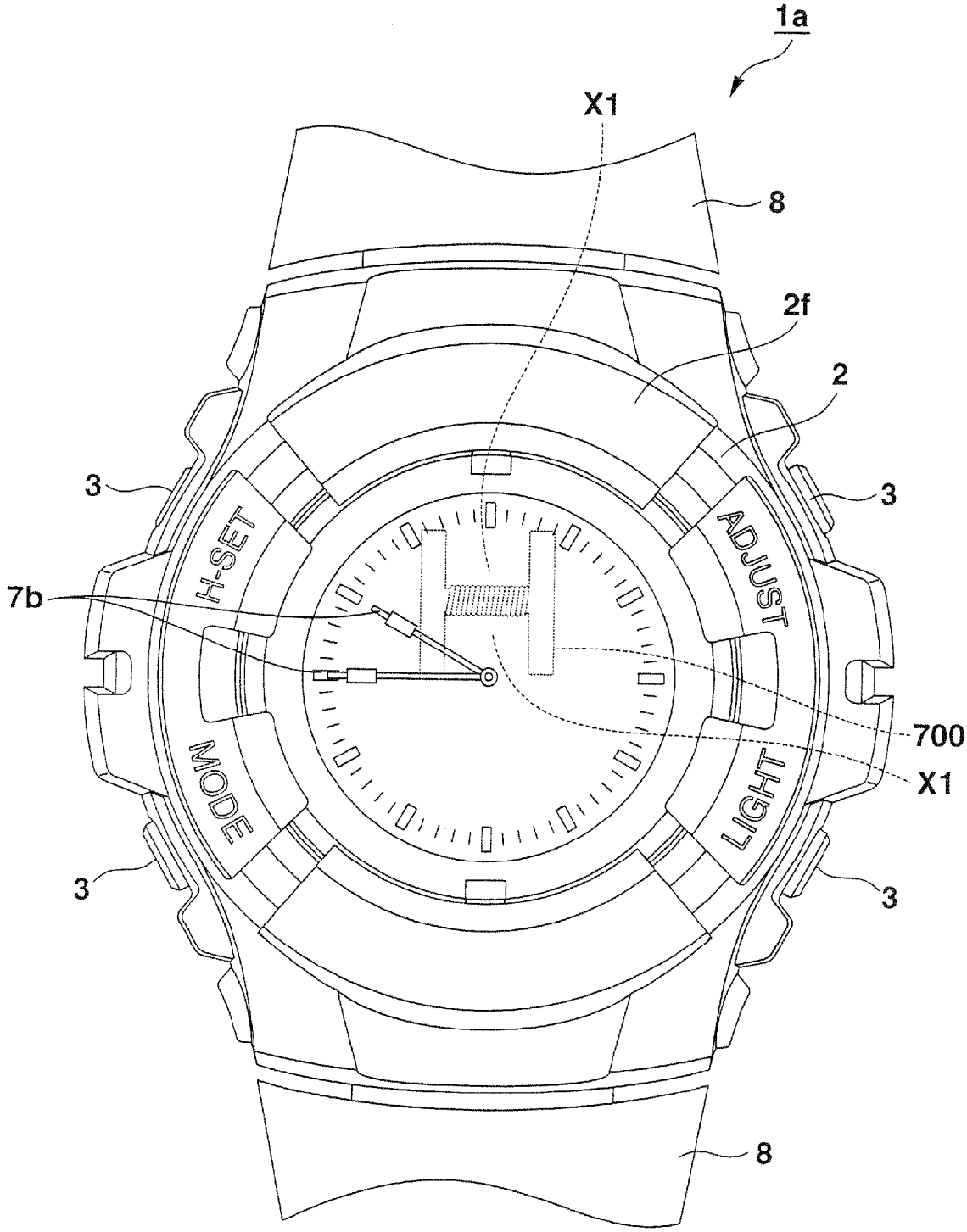
FIG. 10 is a plan view showing the watch having the built-in antenna according to Embodiment 2 of the present invention.
Figure 11:
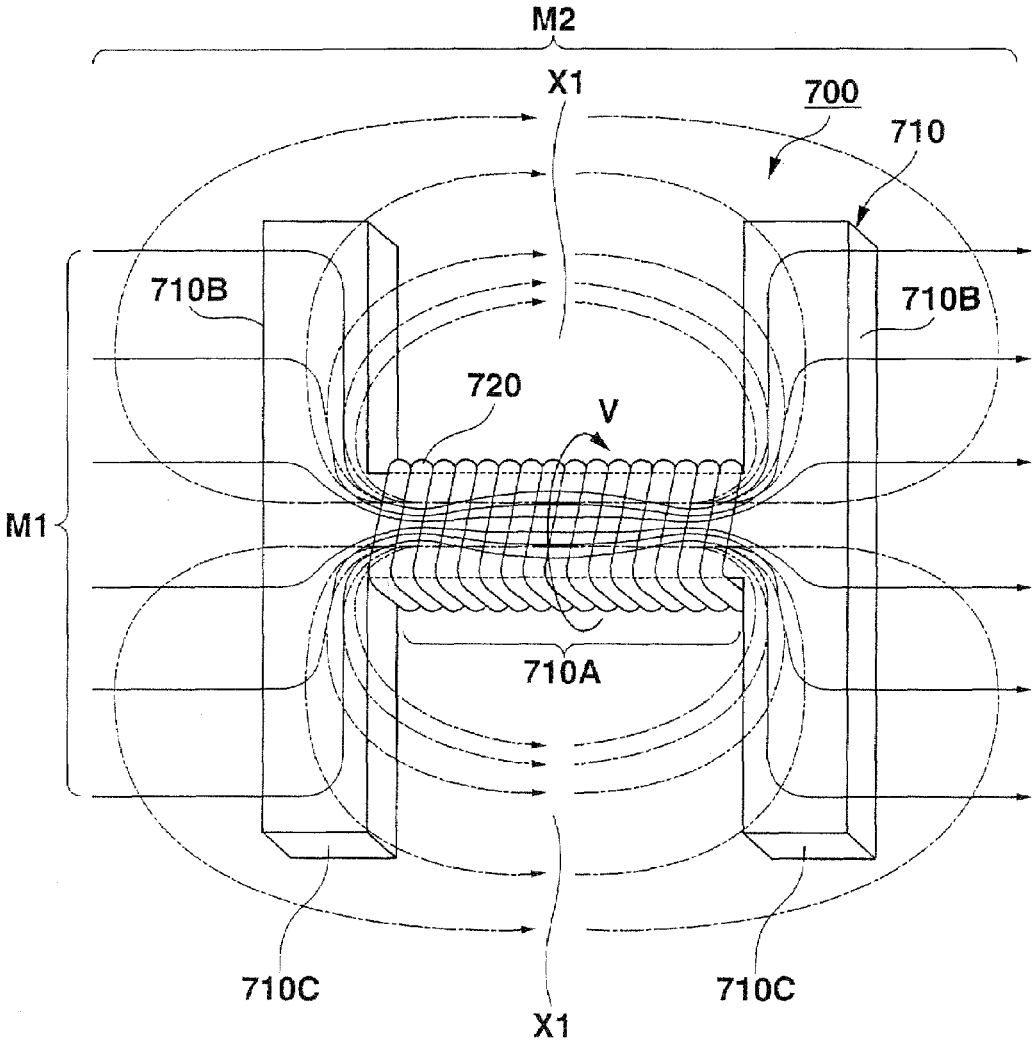
FIG. 11 is a perspective view showing the antenna according to Embodiment 2 of the present invention.

According to Embodiment 2 of the present invention, as shown in FIGS. 10 and 11, a watch 1*a* is different from that of Embodiment 1 only in a structure of an antenna 700. Therefore, a constitution similar to that of the watch 1 of Embodiment 1 is denoted with the same reference numerals, and description thereof is omitted.

FIG. 10 is a plan view of the watch 1*a* having the built-in antenna 700 according to Embodiment 2.

Moreover, according to Embodiment 2, as shown in FIG. 11, the antenna 700 comprises a core 710 which is a magnetic member, and a coil 720 wound around the core 710.

In the core 710, as shown in FIG. 11, for example, opposite end portions of a central portion 710A having a square pole shape, and a substantially central portion between end portions 710C having a square pole shape extending in a direction crossing the central portion 710A at right angles form a substantially bonded H-shape, and are integrally and three-dimensionally formed into a bulk configuration of an amorphous metal.

Therefore, an area of each end surface 710B of the core 710 is larger than a sectional area of the central portion 710A of the core 710.

Here, the core 710 is made of the amorphous metal. Therefore, for example, even when the central portion 710A of the core 710 is configured to be thinner than that of a core made of ferrite, an equal or more strength can be obtained.

It has been described that the end portions 710C and the central portion 710A of the core 710 have the square pole shapes, but corners of a square pole may be smoothened, or a columnar shape may be used.

Moreover, when the core 710 is placed in a signal magnetic field in such a manner that an axial line of the coil 720 is parallel to a magnetic field direction, as shown in FIG. 11, a signal magnetic flux M1 is concentrated on the core 710 having a specific permeability higher than that of a surrounding space. As a result, the signal magnetic flux M1 is interlinked with the coil 720, and in the coil 720, there is generated such an induced electromotive force V as to generate a generated magnetic flux M2 in a direction to inhibit a change of the signal magnetic flux M1 in the coil 720 according to Lenz's law.

Furthermore, the induced electromotive force V generated in the coil 720 is detected by a reception circuit (not shown) connected to the coil 720.

Moreover, as shown in FIG. 10, in a case where the antenna 700 according to Embodiment 2 is built in the watch 1*a* which is a type of radio-wave clock, an electronic circuit, a capacitor, a battery, a resistance and the like may be appropriately arranged in each division X1 partitioned into a substantial U-shape by the end portions 710C and the central portion 710A. In this case, a magnetic shielding material is attached to the inside of the division X1 of the end portions 710C and the central portion 710A, it is possible to reduce an influence of the generated magnetic flux M2 on the electronic circuit and the like arranged in the division X1.

Next, a method for manufacturing the core 710 of the antenna 700 according to Embodiment 2 of the present invention will be described with reference to a flowchart shown in FIG. 12.

Figure 12:
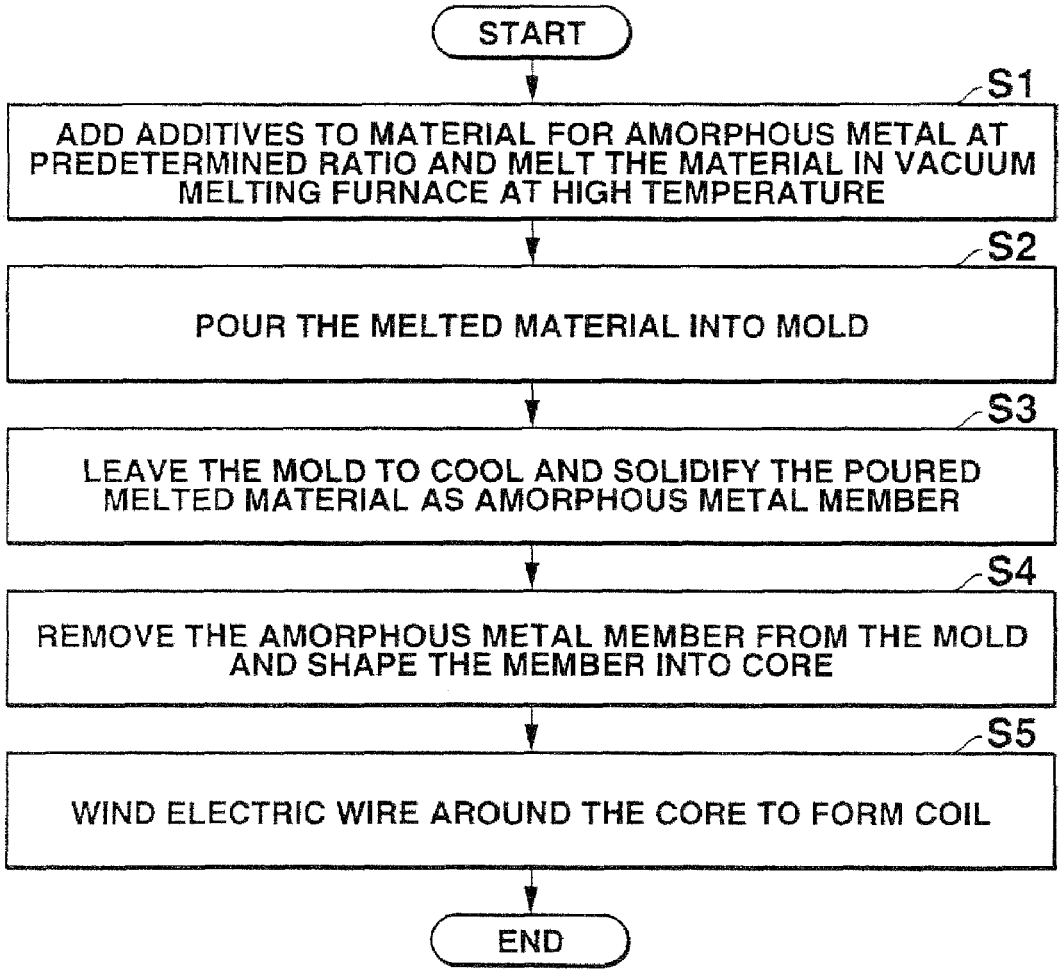
FIG. 12 is a flowchart of a method for manufacturing the antenna according to the present invention.

First, in step S1 of FIG. 12, additives are added at predetermined ratios to iron, nickel and the like which is material of amorphous metal configuring the core 710 according to the present invention to melt the material in a vacuum melting furnace at a high temperature (melting step).

Figure 13:
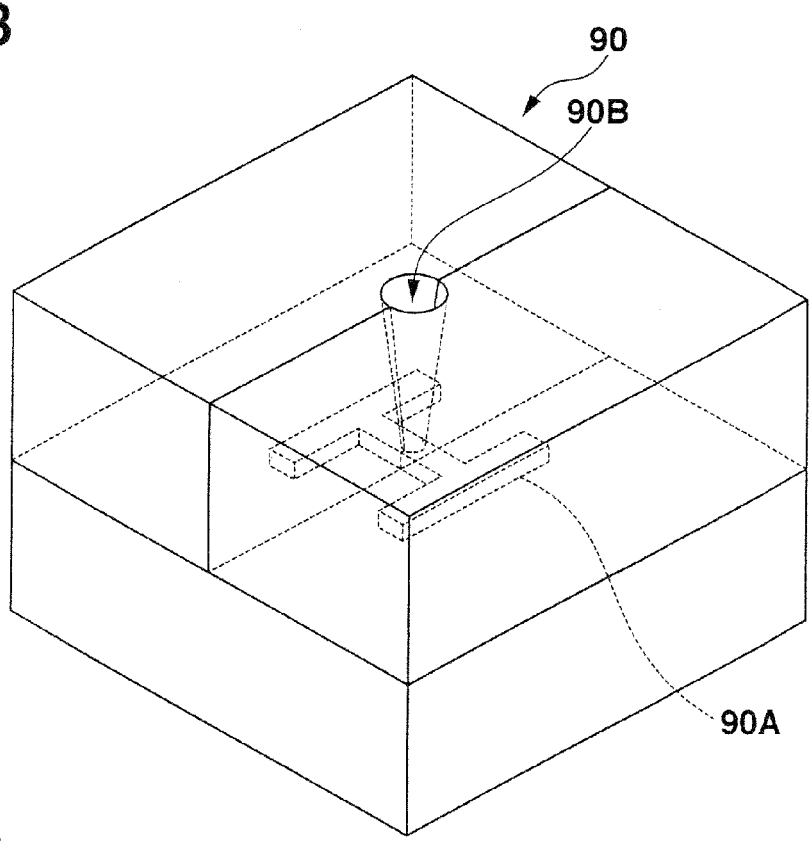
FIG. 13 is a perspective view showing a mold for manufacturing a core of the antenna according to Embodiment 2 of the present invention.

Next, in step S2 of FIG. 12, as shown in FIG. 13, the melted material is quickly poured into a space 90A of a mold 90, the space 90A adapted to the shape of the core 710 of the antenna 700, through a funnel-like inlet port 90B connected to the space 90A in the mold 90 (pouring step).

Figure 14:
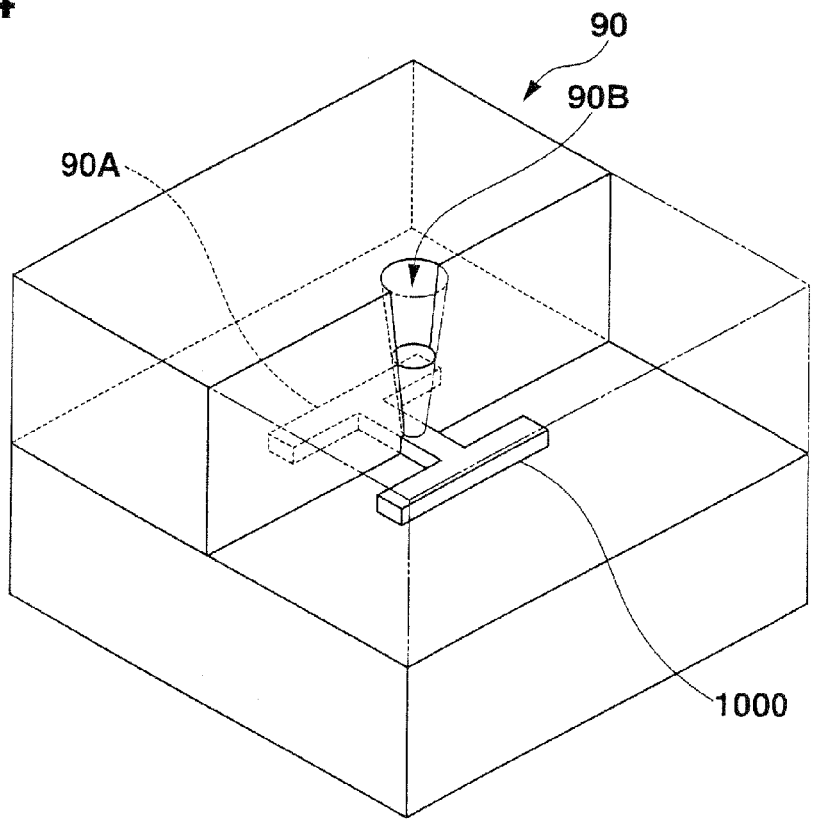
FIG. 14 is a perspective view showing the mold in FIG. 13 in a state that melted materials are poured into the mold for manufacturing a core of the antenna according to Embodiment 2 of the present invention.

Next, in step S3 of FIG. 12, as shown in FIG. 14, the mold 90 is left to cool and solidify the melted material poured therein (cooling step). In a case that the material has a usual material composition for the amorphous metal, the material needs to be overcooled at a high cooling speed of, for example, 300 K/sec to become amorphous.

Therefore, a thin film-like core only can be manufactured by using the material having the usual material composition for the amorphous metal. However, in a case that the material has the material composition for the amorphous metal described above in relation to the present invention, the material can become amorphous at a very low cooling speed of, for example, 10 K/sec. Therefore, a more cubic core can be manufactured from the above described specific material composition for the amorphous metal in such a mold casting.

Figure 15:
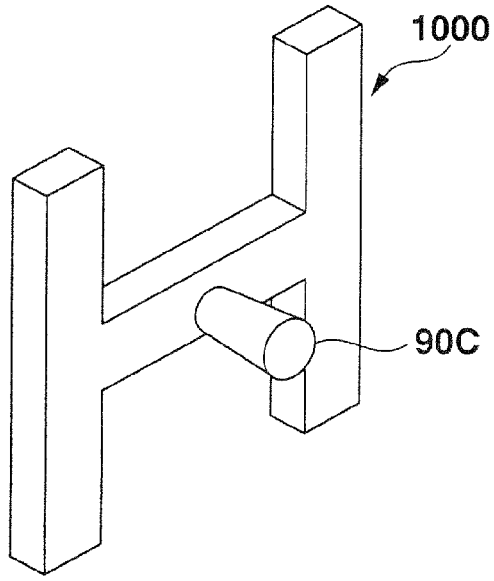
FIG. 15 is a perspective view showing a pre-shaped core removed from the mold in FIG. 13.

Subsequently, in step S4 of FIG. 12, a cooled and solidified amorphous metal member 1000 is removed from the mold. The removed amorphous metal member 1000 is shown in FIG. 15. Thereafter, after cutting off an unnecessary portion 90C cooled and solidified in the inlet port 90B, the amorphous metal member 1000 is shaped by polishing or the like (shaping process).

Figure 16:
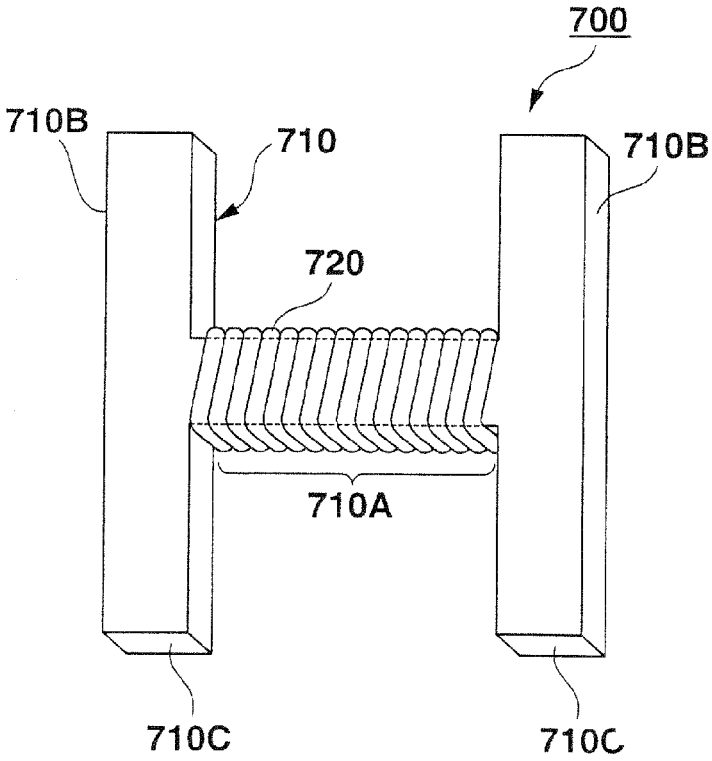
FIG. 16 is a perspective view showing the antenna according to Embodiment 2 of the present invention, which is completed by winding an electric wire around a shaped core to form a coil.

Next, in step S5 of FIG. 12, an electric wire is wound around the shaped core 710 to form the coil 720, whereby the antenna 700 is manufactured. The completed antenna 700 is shown in FIG. 16.

According to the antenna 700 of Embodiment 2 described above, since an area of each end surface 710B of the core 710 is larger than a sectional area of the central portion 710A of the core 710, more standard radio waves can be received, and a sensitivity of the antenna 700 can be enhanced.

Especially, since the core 710 is made of the bulked amorphous metal, even the core having a complicated shape such as the H-shape can be easily formed as compared with the conventional core provided by laminating a plurality of thin films of amorphous metals.

Moreover, since any thin film cannot be laminated as in the conventional core of the amorphous metal, working steps can be reduced, and the antenna 700 can be easily manufactured.

Furthermore, the electronic circuit, the capacitor, the battery, the resistance and the like can be appropriately arranged in each division X1 partitioned into the substantial U-shape by the end portions 710C and the central portion 710A of the core 710.

Even when the antenna 700 according to Embodiment 2 of the present invention is modified as follows if necessary, similar effects are obtained.

(Modification)

Figure 17:
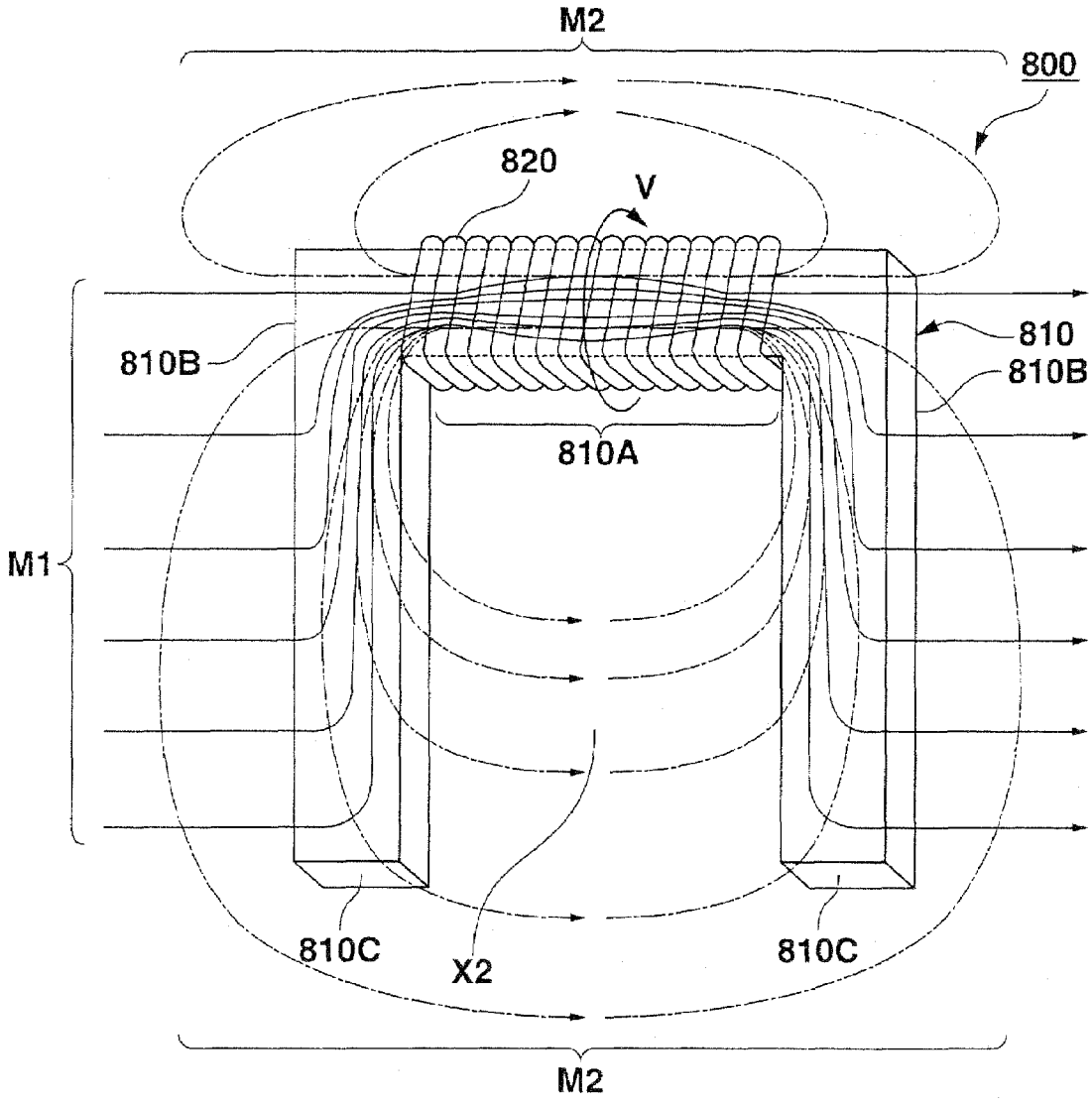
FIG. 17 is a perspective view showing the antenna according to a modification of Embodiment 2 of the present invention.

According to a modification of the antenna 700 of Embodiment 2, as shown in FIG. 17, an antenna 800 comprises: a magnetic core 810; and a coil 820 wound around the core 810.

In the core 810, as shown in FIG. 17, for example, opposite end portions of a central portion 810A having a square pole shape, and end portions 810C having a square pole shape extending in the same direction crossing the central portion 810A at right angles form a substantially bonded U-shape, and are integrally and three-dimensionally formed into a bulk configuration of an amorphous metal.

Therefore, an area of each end surface 810B of the core 810 is larger than a sectional area of the central portion 810A of the core 810 in the same manner as in the antenna 700.

Here, the core 810 is made of the amorphous metal. Therefore, for example, even when the central portion 810A is configured to be thinner than that of a core made of ferrite, an equal or more strength can be obtained.

It has been described that the end portions 810C and the central portion 810A of the core 810 have the square pole shapes, but corners of a square pole may be smoothened, or a columnar shape may be used.

Moreover, when the core 810 is placed in a signal magnetic field in such a manner that an axial line of the coil 820 is parallel to a magnetic field direction, as shown in FIG. 17, a signal magnetic flux M1 is concentrated on the core 810 having a specific permeability higher than that of a surrounding space. As a result, the signal magnetic flux M1 is interlinked with the coil 820, and in the coil 820, there is generated such an induced electromotive force V as to generate a generated magnetic flux M2 in a direction to inhibit a change of the signal magnetic flux M1 in the coil 820 according to Lenz's law.

Furthermore, the induced electromotive force V generated in the coil 820 is detected by a reception circuit (not shown) connected to the coil 820.

In addition, according to the modification, the core 810 of the antenna 800 is three-dimensionally formed in the same manner as in the method of manufacturing the core 710 of the antenna 700.

It is to be noted that in a case where the antenna 800 according to the modification is built in a watch (not shown) which is a type of radio-wave clock, an electronic circuit, a capacitor, a battery, a resistance and the like may be appropriately arranged in a division X2 partitioned into a substantial U-shape by the end portions 810C and the central portion 810A of the core 810 in the same manner as in the antenna 700 of Embodiment 2. In this case, a magnetic shielding material is attached to the inside of the division X2 by the end portions 810C and the central portion 810A, it is possible to reduce an influence of the generated magnetic flux M2 on the electronic circuit and the like arranged in the division X2.

Embodiment 3

Figure 18:
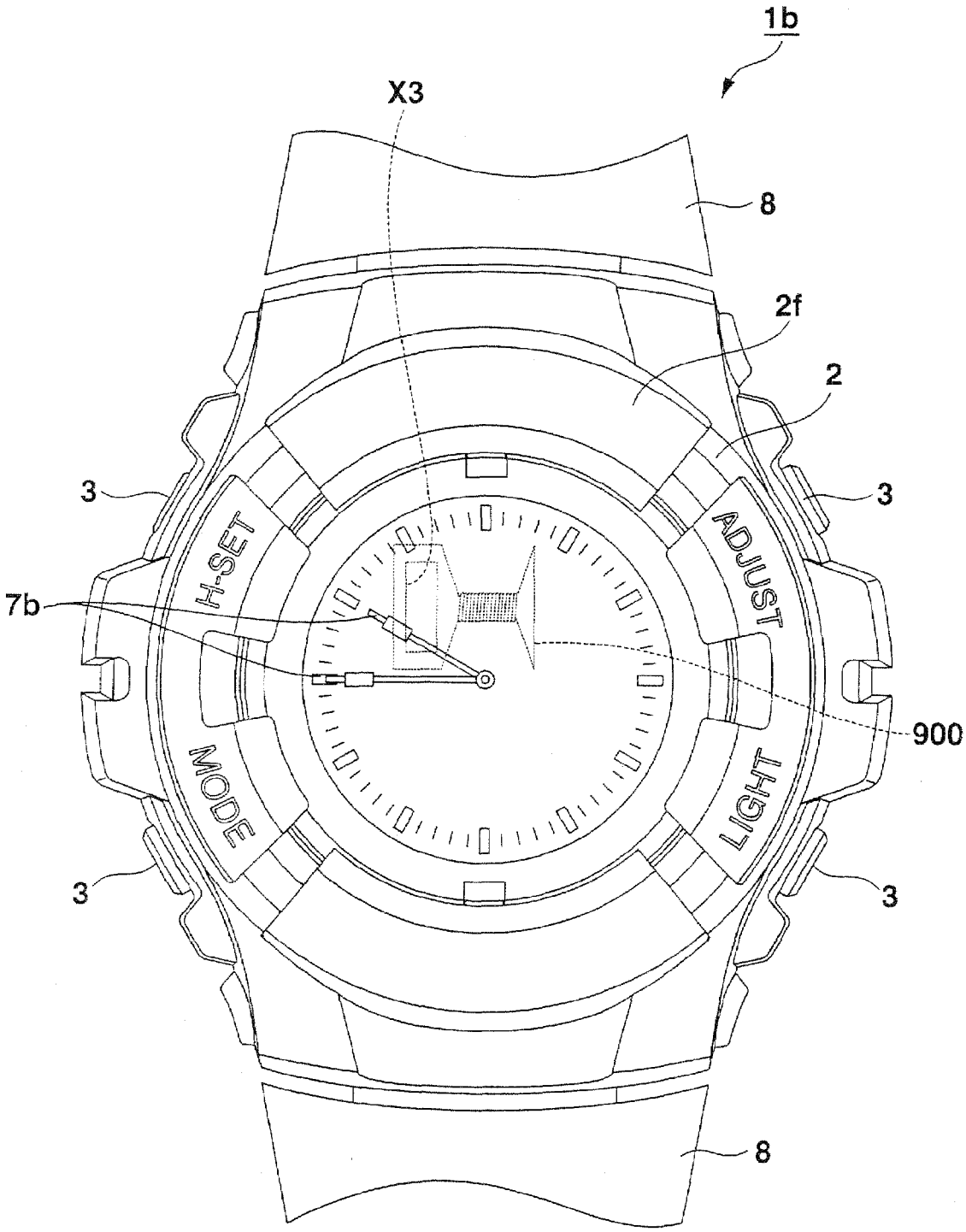
FIG. 18 is a plan view showing the watch having the built-in antenna according to Embodiment 3 of the present invention.
Figure 19:
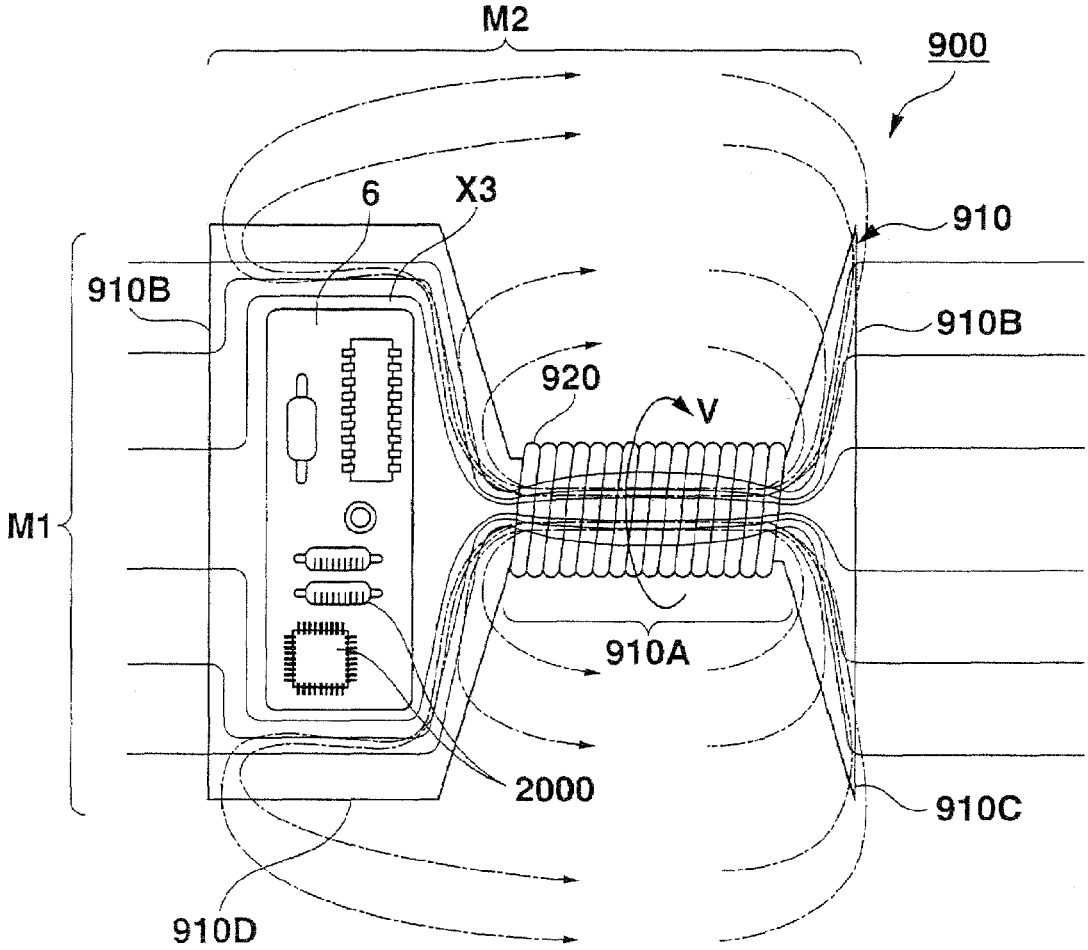
FIG. 19 is a plan view showing the antenna according to Embodiment 3 of the present invention.

According to Embodiment 3 of the present invention, as shown in FIGS. 18 and 19, in a watch 1*b*, an only structure of an antenna 900 is different from that of the antenna 100 of Embodiment 1. Therefore, a constitution similar to that of the watch 1 of Embodiment 1 is denoted with the same reference numerals, and description thereof is omitted.

FIG. 18 is a plan view of the watch 1*b* having the built-in antenna 900 according to Embodiment 3.

Moreover, according to Embodiment 3, as shown in FIG. 19, the antenna 900 comprises a core 910 as a magnetic member, and a coil 920 wound around the core 910.

As shown in FIG. 19, the core 910 comprises: for example, a central portion 910A having a square pole shape; a first end portion 910C extending from one end of the central portion 910A outwards in a longitudinal direction into a substantially triangular shape in a plan view; and a second end portion 910D extending from the other end of the central portion 910A outwards in the longitudinal direction into a substantially triangular shape in a plan view and further extending into a substantially rectangular shape in the plan view. The shape of the first end portion 910C is asymmetrical to that of the second end portion 910D. The core 910 is integrally and three-dimensionally formed of the amorphous metal.

Moreover, the second end portion 910D is provided with a substantially rectangular through hole X3 as a space in which electronic components 2000 and the like can be arranged.

Furthermore, an area of each of end surfaces 910B of the first end portion 910C and the second end portion 910D is larger than a sectional area of the central portion 910A of the core 910.

Here, the core 910 is made of the amorphous metal. Therefore, for example, even when the central portion 910A is configured to be thinner than that of a core made of ferrite, an equal or more strength can be obtained.

It has been described that the first end portion 910C, the second end portion 910D, and the central portion 910A of the core 910 have the substantially rectangular sections, but corners of the substantially rectangular section may be smoothened, or a circular section may be used.

Moreover, when the core 910 is placed in a signal magnetic field in such a manner that an axial line of the coil 920 is parallel to a magnetic field direction, as shown in FIG. 19, a signal magnetic flux M1 is concentrated on the core 910 having a specific permeability higher than that of a surrounding space. As a result, the signal magnetic flux M1 is interlinked with the coil 920, and in the coil 920, there is generated such an induced electromotive force V as to generate a generated magnetic flux M2 in a direction to inhibit a change of the signal magnetic flux M1 in the coil 920 according to Lenz's law.

Furthermore, the induced electromotive force V generated in the coil 920 is detected by a reception circuit (not shown) connected to the coil 920.

In addition, the through hole X3 disposed in the second end portion 910D of the core 910 is surrounded with a magnetic member which is the core 910, and the signal magnetic flux M1 and the generated magnetic flux M2 are concentrated and distributed in the surrounding magnetic member of the through hole X3. Therefore, there are remarkably few magnetic fluxes distributed in the through hole X3.

Moreover, according to Embodiment 3, the core 910 of the antenna 900 is three-dimensionally formed in the same manner as in the method of manufacturing the core 710 of the antenna 700 of Embodiment 2.

Furthermore, as shown in FIG. 18, in a case where the antenna 900 according to Embodiment 3 is built in the watch 1*b* which is a type of radio-wave clock, for example, an electronic circuit, a capacitor, a battery, a resistance and the like can be appropriately arranged as the electronic components 2000 in the through hole X3 disposed in the second end portion 910D of the core 910. Here, since the through hole X3 has a direction deviating from a path of the generated magnetic flux from the coil 920, the portion is not easily influenced by the magnetic flux, but a countermeasure may be preferably taken such as the attaching of a magnetic shielding material onto an inner surface of the core 910 surrounding the through hole X3.

It is to be noted that it has been described in the present embodiment that the through hole X3 has the substantially rectangular shape, but the portion may have any shape.

According to the above-described antenna 900 of Embodiment 3, since the shape of the first end portion 910C of the core 910 is asymmetrical to that of the second end portion 910D, there increases a degree of freedom in design of the watch 1*b* having the built-in antenna 900 comprising the core 910, and the watch 1*b* can be miniaturized more. Especially, since the core 910 is made of the bulked amorphous metal, the core can be easily formed into the shape as compared with a conventional core provided by laminating a plurality of thin films of the amorphous metals.

Moreover, the core 910 is provided with the substantially rectangular through hole X3 as the space in which the electronic components 2000 and the like can be arranged. Therefore, when the antenna 900 is built in the watch 1*b*, electronic components 2000 such as the electronic circuit, the capacitor, the battery, and the resistance can be appropriately arranged in the through hole X3 of the core 910. While an outer shape of the core 910 is enlarged, and a sensitivity of the antenna 900 is enhanced, the watch 1*b* can be miniaturized more.

Furthermore, since remarkably few magnetic fluxes are distributed in a through hole X3 of the core 910, it is possible to reduce remarkably influences of the magnetic fluxes on electronic components 2000 such as the electronic circuit, the capacitor, the battery, and the resistance arranged in the through hole X.

According to Embodiments 1 to 3 of the present invention, the core can be prepared by forming the amorphous metal into the bulk configuration. As compared with the conventional core provided by the laminating of a plurality of thin films of the amorphous metals, the core is easily worked into an arbitrary shape, and the antenna having a shape adapted to its purpose can be manufactured more easily. Since any thin film is not laminated as in the conventional core of the amorphous metal, working steps can be reduced.

Moreover, since the core made of the amorphous metal formed into the bulk configuration has a remarkably high permeability, the sensitivity of the antenna can be remarkably improved. Since the amorphous metal has a high strength, the core can be configured to be remarkably thin, a winding number of the coil can be increased, and the sensitivity of the antenna can therefore be improved. Since the amorphous metal is not prone to rust, and its temperature stability is satisfactory, a life of the antenna can be lengthened more.

According to Embodiments 1 to 3 of the present invention, since a sectional area of the end portion of the core is larger than that of the central portion of the core, more radio waves can be received, and the sensitivity of the antenna can be enhanced. Especially, since the core is made of the bulked amorphous metal, the core can be easily formed into the shape as compared with the conventional core provided by the laminating of a plurality of thin films of the amorphous metals.

Moreover, according to Embodiment 1 of the present invention, the sectional area of the end portion of the core is reduced from the end surface of the core toward the central portion thereof, and the sectional area is constant in the central portion of the core. Therefore, the electric resistance increases from the end surface toward the central portion, the induced current generated in the core can be reduced, and the eddy current loss can be suppressed.

According to Modifications 1 and 2 of Embodiment 1 of the present invention, since the sectional area of the core is reduced from the end surface toward the central portion of the core continuously or in the stepwise manner, the electric resistance increases from the end surface toward the central portion. The induced current generated in the core can be reduced, and the eddy current loss can be suppressed.

Moreover, according to Modifications 1 and 2 of Embodiment 1 of the present invention, since the winding number of the coil in the central portion is larger than that in each end portion of the core, the magnetic flux density increases toward the central portion, a magnitude of the induced electromotive force (reception voltage) generated in the central portion can be increased, and the sensitivity of the antenna can be raised.

Furthermore, according to Modification 4 of Embodiment 1 of the present invention, since the end portion of the core is provided with the concave, the sectional area of the end portion can be reduced as much as that of the concave without impairing the receiving sensitivity of the radio wave of the core. Consequently, the electric resistance of the end portion can be increased, and it is further possible to suppress the eddy current loss resulting from the induced current generated in the core.

Additionally, according to Embodiment 3 of the present invention, the end portion of the core is provided with the space in which the electronic components can be arranged. Therefore, for example, in a case where the antenna is built in the electronic device, electronic components such as the electronic circuit, the capacitor, the battery, and the resistance can be appropriately arranged in the space of the core. While the outer shape of the core is enlarged, and the antenna sensitivity is improved, the electronic device can be miniaturized more.

Embodiment 4

Next, Embodiment 4 of the present invention will be described.

Figure 20:
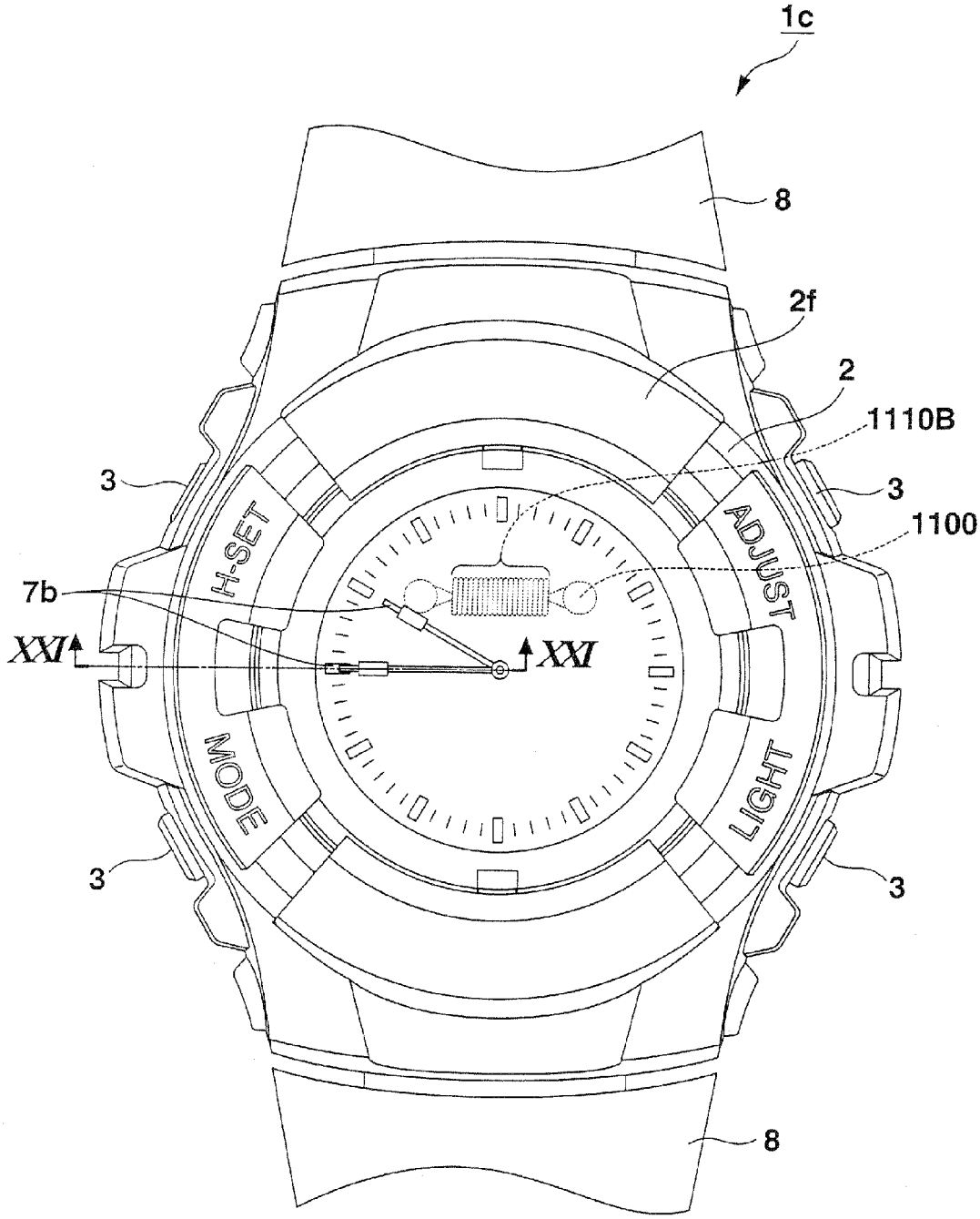
FIG. 20 is a plan view showing the watch having the built-in antenna according to Embodiment 4 of the present invention.
Figure 21:
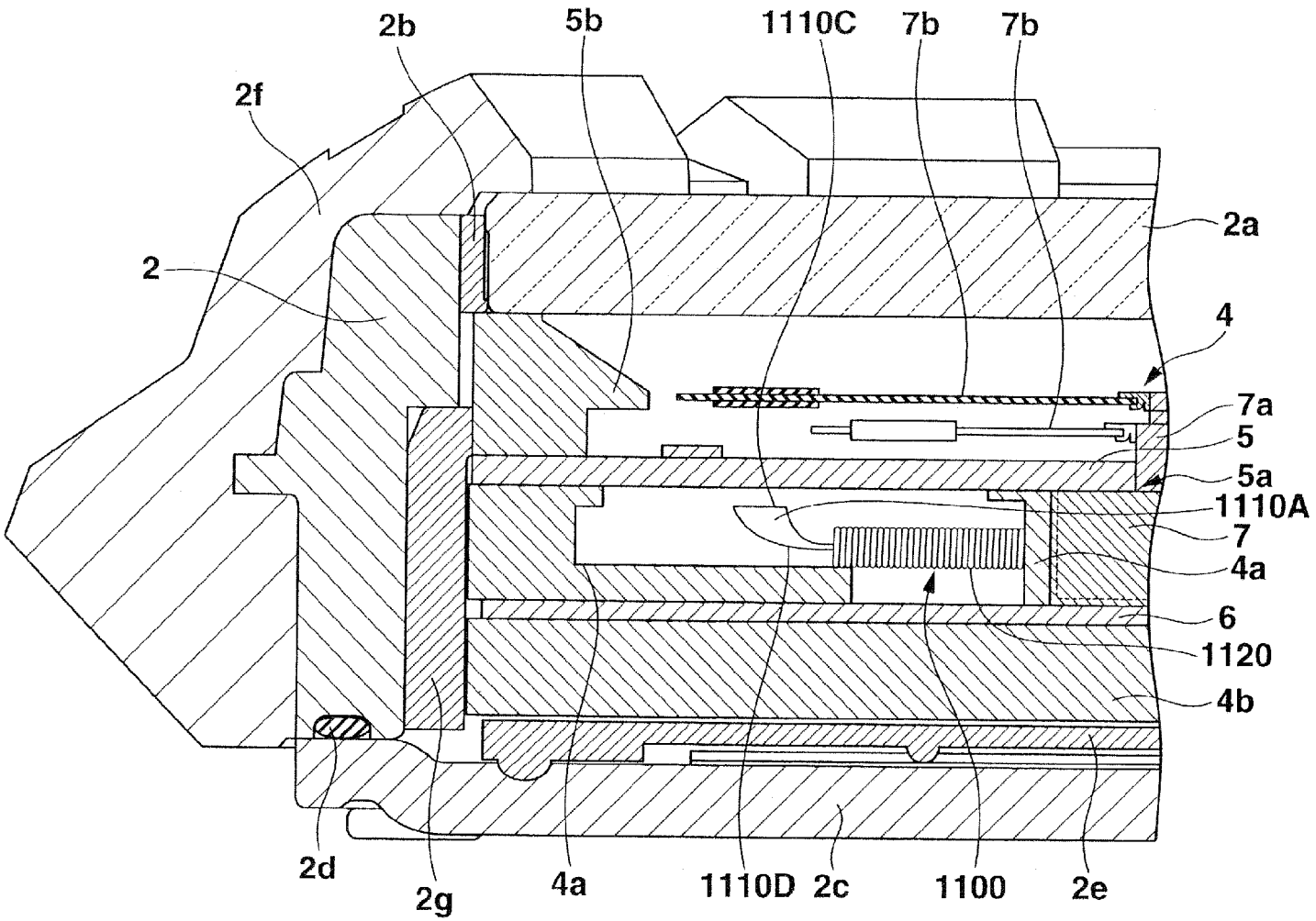
FIG. 21 is a sectional view taken along a line XXI-XXI in FIG. 20.
Figure 22:
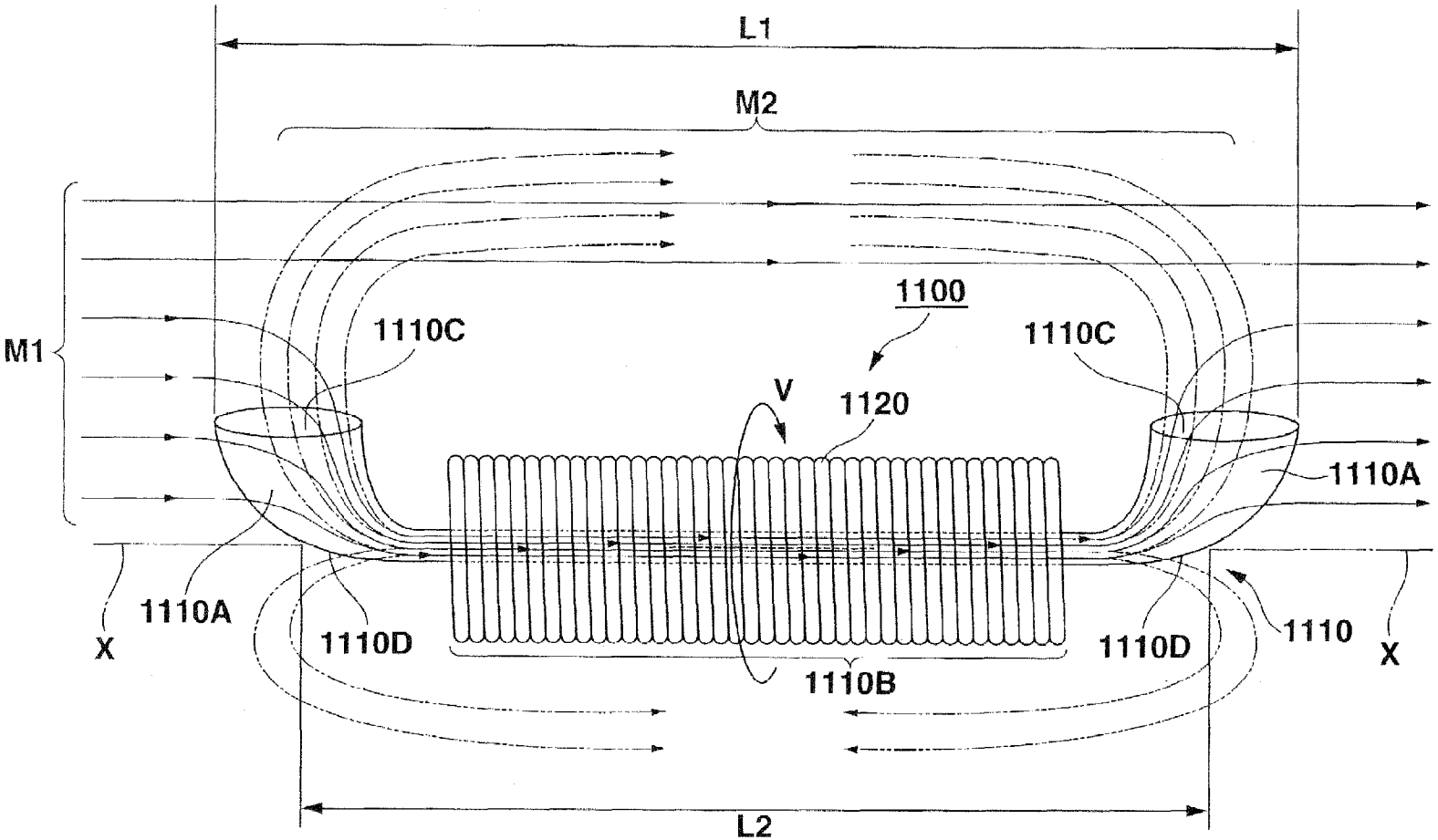
FIG. 22 is a view showing an operation of the antenna according to Embodiment 4 of the present invention.

In a watch 1*c* according to Embodiment 4 of the present invention, as shown in FIGS. 20, 21, and 22, an only structure of an antenna 1100 is different from that of the antenna 100 of Embodiment 1. Therefore, a constitution similar to that of the watch 1 of Embodiment 1 is denoted with the same reference numerals, and detailed description thereof is omitted.

FIG. 20 is a plan view of the watch 1*c* having the built-in antenna 1100 according to Embodiment 4 of the present invention, and FIG. 21 is a sectional view taken along a line XXI-XXI in FIG. 20.

As shown in FIGS. 20 and 21, the watch 1*c* as an electronic device comprises a watch case 2 as a case in which a watch timing portion 4 is contained, and band members 8 for attaching the case to user's wrist are attached to the watch case 2.

The watch case 2 has, for example, a cylindrical shape, and has openings in upper and lower portions thereof. A watch glass 2*a* with a packing 2*b* is fitted into an upper surface center of the watch case 2 in such a manner as to close the opening of the upper portion. The lower portion of the watch glass 2*a* is provided with a dial plate 5 as a decorative plate in such a manner that the dial plate is visible from the side of the upper portion of the watch glass 2*a*. Switches 3 for instructing execution of each type of function of the watch 1 are attached to a periphery of the watch case 2. A bezel 2*f* is disposed on an upper outer periphery of the watch case 2, and a back lid 2*c* with a waterproof ring 2*d* is attached to a bottom surface of the watch case 2.

The watch case 2 and the back lid 2*c* are formed of a material such as a metal which is impermeable to a radio wave.

The dial plate 5 as the decorative plate is formed of a material such as a resin which is permeable to the radio wave.

Here, the decorative plate is not limited to the dial plate 5 of the watch 1*c*, and refers to, for example, a plate which is disposed in a display portion of the electronic device or the like to produce a decorative effect through vision.

The antenna 1100 is supported by an upper housing portion 4*a*, and disposed between a lower portion of the dial plate 5 as the decorative plate and an upper portion of a lower housing portion 4*b*. Moreover, the antenna is disposed in such a manner that the dial plate 5 is parallel to an axial line X of a central portion 1110B (described later) of a core 1110 (described later) of the antenna 1100 in a longitudinal direction and that the dial plate 5 faces each facing surface 1110C (described later) of an expanded portion 1110A integrally formed on the end portion of the core 1110 in the longitudinal direction.

FIG. 22 is a view showing an operation of the antenna 1100 according to Embodiment 4.

As shown in FIG. 22, the antenna 1100 comprises the magnetic core 1110, a coil 1120 wound around the core 1110 and the like.

The core 1110 is formed into a bulk configuration by use of an amorphous metal as a material. Here, the bulk configuration refers to a solid shape made using a casting mold or a mold. That is, the core 1110 comprises a single member by use of the amorphous metal as the material. Specifically, examples of the bulked amorphous metal include an Fe-based alloy, a Pd-based alloy, a Zr-based alloy, an Ni-based alloy and the like. Examples of the Fe-based alloy include an Fe—M—B (M=Cr, W, Ta, Nb, Hf, Zr)-based alloy, an Fe—Co—RE—B (RE=Nb, Sm, Tb, Dy)-based alloy and the like. More specifically, the amorphous metal is formed of a composition such as $Pd_{40}Cu_{30}Ni_{10}P_{20}$ or $Fe_{81}B_{13}Si_{14}C_2$. Moreover, when the melted alloy is worked into the bulk configuration by casting, an inner configuration is configured to be amorphous. More specifically, to manufacture the core 1110, for example, the alloy as the amorphous metal is melted, and sintered at a crystallization starting temperature or a lower temperature in a state in which a pressure of 200 Mpa or more is applied.

The core 1110 is a long rod member, and the expanded portions 1110A formed integrally with the opposite end portions of the core 1110 in the longitudinal direction are bent from the back lid 2*c* toward the dial plate 5. As to each expanded portion 1110A, the facing surface 1110C on a side opposite to a side on which the expanded portion 1110A is formed integrally with the end portion of the core 1110 in the longitudinal direction, that is, the facing surface 1110C facing the dial plate 5 is circular. Moreover, a diameter of each expanded portion 1110A disposed on the end portion of the core 1110 in the longitudinal direction gradually decreases toward the central portion 1110B of the core 1110 in the longitudinal direction, and the diameter is substantially constant in the central portion 1110B of the core 1110 in the longitudinal direction. Therefore, an area of the facing surface 1110C owned by the expanded portion 1110A is larger than a sectional area of the central portion 1110B of the core 1110 in the longitudinal direction. A length L2 of the core 1110 in the longitudinal direction on a side of an opposite surface 1110D opposite to the facing surface 1110C with respect to the axial line X of the central portion 1110B of the core 1110 in the longitudinal direction is shorter than a length L1 of the core 1110 in the longitudinal direction on a side of the facing surface 1110C of the core 1110 facing the dial plate 5.

Here, the core 1110 is made of the amorphous metal. Therefore, for example, even when the central portion 1110B in the longitudinal direction is configured to be thinner than that of a core made of ferrite, an equal or more strength can be obtained. Specifically, for example, in a case where a diameter of the central portion 1110B of the core made of ferrite in the longitudinal direction is set to 1.5 mm, a diameter of the central portion 1110B of the core using the amorphous metal in the longitudinal direction can be set to 0.5 to 1.0 mm.

Moreover, the coil 1120 is layered and wound around the central portion 1110B of the core 1110 in the longitudinal direction.

Furthermore, when this antenna 1100 is placed in a magnetic field (hereinafter referred to as the "signal magnetic field") by a standard radio wave, the magnetic field acts on the antenna 1100 as follows. It is to be noted that since a long wave having a wavelength of several kilometers is used as the standard radio wave, the magnetic field may be regarded as a parallel magnetic field in which a size of a magnetic field component does not change depending on a position in a range of an antenna size. Therefore, to simplify description, the signal magnetic field is regarded as the parallel magnetic field in the following description.

When the core 1110 is placed in the signal magnetic field in such a manner that an axial line of the coil 1120 is parallel to a magnetic field direction, as shown in FIG. 22, a magnetic flux (hereinafter referred to as the "signal magnetic flux") M1 by the signal magnetic field is concentrated on the core 1110 having a specific permeability which is higher than that of a surrounding space. As a result, the signal magnetic flux M1 is interlinked with the coil 1120, and in the coil 1120, there is generated such an induced electromotive force V as to generate a magnetic flux (hereinafter referred to as the "generated magnetic flux") M2 in a direction to inhibit a change of the signal magnetic flux M1 in the coil 1120 according to Lenz's law.

It is to be noted that since the signal magnetic field is an alternating magnetic field, and a size or a direction of the signal magnetic flux M1 periodically changes, the induced electromotive force V turns to an alternating power. The generated magnetic flux M2 turns to an alternating magnetic field whose size or direction periodically changes following the change of the signal magnetic flux M1 with time.

Moreover, the induced electromotive force V generated in the coil 1120 is detected by a reception circuit (not shown) connected to the coil 1120. The reception circuit includes a tuning capacitor for tuning to a frequency (40 kHz or 60 kHz in Japan) of the standard radio wave to be received, or a loss resistance. The reception circuit is mounted on a circuit substrate 6 shown in, for example, FIG. 21.

Here, the expanded portions 1110A disposed on the end portions of the core 1110 in the longitudinal direction are bent from the back lid 2*c* toward the dial plate 5, the diameter of each expanded portion 1110A owned on the end portion of the core 1110 in the longitudinal direction gradually decreases toward the central portion 1110B of the core 1110 in the longitudinal direction, and the diameter is substantially constant in the central portion 1110B of the core 1110 in the longitudinal direction.

Moreover, the expanded portions 1110A face the dial plate 5 at their facing surfaces 1110C being disposed on a side opposite to a side on which the expanded portions 1110A are formed integrally with the end portions of the core 1110 in the longitudinal direction. Accordingly, a radio wave receiving area on the side of each facing surface 1110C facing the dial plate 5 is broader (larger) than that on the side of each surface 1110D opposite to the facing surface 1110C with respect to the axial line X of the central portion 1110B of the core 1110 in the longitudinal direction in the expanded portions 1110A, 1110A owned by the opposite end portions of the core 1110 in the longitudinal direction.

Therefore, the antenna 1100 is shaped in such a manner that during the receiving of the radio wave, a received radio wave amount on the side of each facing surface 1110C of the core 1110 facing the dial plate 5 is larger than that on the side of each surface 1110D opposite to the facing surface 1110C with respect to the axial line X of the antenna 1100.

Moreover, the length L1 of the core 1110 in the longitudinal direction on the side of the facing surface 1110C facing the dial plate 5 is longer than the length L2 in the longitudinal direction on the side of the surface 1110D opposite to the facing surface 1110C with respect to the axial line X of the central portion 1110B of the core 1110 in the longitudinal direction. Accordingly, a receiving sensitivity of the core 1110 in the longitudinal direction on the side of the facing surface 1110C is high as compared with a case where the length L1 on the facing surface 1110C side is equal to the length L2 on the side of the surface 1110D opposite to the facing surface 1110C with respect to the axial line X of the antenna 1100.

Furthermore, the antenna 1100 is shaped in such a manner that the received radio wave amount on the facing surface 1110C side facing the dial plate 5 in the expanded portion 1110A bent toward the dial plate 5 is larger than that on the side of the surface 1110D opposite to the facing surface 1110C with respect to the axial line X of the antenna 1100.

Additionally, the length L2 of the core 1110 in the longitudinal direction on the side of the surface 1110D opposite to the facing surface 1110C with respect to the axial line X of the central portion 1110B of the core 1110 in the longitudinal direction is shorter than the length L1 in the longitudinal direction on the side of the facing surface 1110C facing the dial plate 5. Therefore, the generated magnetic flux M2 of the facing surface 1110C of the core 1110 has a larger amount as compared with the side of the surface 1110D opposite to the facing surface 1110C.

Furthermore, the generated magnetic flux M2 is generated on the surface 1110D of the core 1110 opposite to the facing surface 1110C with respect to the axial line X of the central portion 1110B of the core 1110 in the longitudinal direction. The flux passes through the back lid 2*c*, generates an eddy current in the back lid 2*c*, and generates an eddy current loss of the signal magnetic flux M1. Since the generated magnetic flux M2 on the side of the surface 1110D opposite to the facing surface 1110C of the core 1110 is suppressed as compared with the facing surface 1110C side, the eddy current generated in the back lid 2*c* is suppressed, and the eddy current loss of the signal magnetic flux M1 is suppressed.

Since an inner constitution of the watch 1*c* is the same as that described in Embodiment 1 with reference to FIG. 4, description thereof is omitted.

As described above, according to the antenna 1100 and the watch 1*c* in which the antenna 1100 is incorporated according to Embodiment 4, the core 1110 is disposed under the dial plate 5. The expanded portions 1110A are shaped in such a manner that during the receiving of the radio wave, the received radio wave amount is larger on the side of the facing surfaces 1110C facing the dial plate 5 as compared with the side of the surfaces 1110D opposite to the facing surfaces 1110C with respect to the axial line X of the central portion 1110B of the antenna 1100 in the longitudinal directions. Therefore, the radio wave can be sufficiently received from the dial plate 5 side, and the receiving sensitivity can be improved without enlarging the whole antenna 1100 as compared with the conventional antenna.

More specifically, in the expanded portions 110A, 1110A disposed on the opposite end portions of the core 1110 in the longitudinal direction, the radio wave receiving area on the side of each facing surface 1110C facing the dial plate 5 is broader (larger) than that on the side of each surface 1110D opposite to the facing surface 1110C with respect to the axial line X of the central portion 1110B of the core 1110 in the longitudinal direction. Therefore, when the radio wave is received, more radio waves can be received from the facing surface 1110C side in the expanded portions 110A, 1110A disposed on the opposite end portions of the core 1110 in the longitudinal direction. Therefore, the radio waves can be sufficiently received from the dial plate 5 side, and the receiving sensitivity can be improved without enlarging the whole antenna 1100 as compared with the conventional antenna.

Moreover, the length L2 of the core 1110 in the longitudinal direction on the side of the surface 1110D opposite to the facing surface 1110C with respect to the axial line X of the central portion 1110B of the core 1110 in the longitudinal direction is shorter than the length L1 of the core 1110 in the longitudinal direction on the facing surface 1110C side. Therefore, the receiving sensitivity on the facing surface 1110C side in the longitudinal direction of the core 1110 increases, and the receiving sensitivity of the antenna 1100 can be improved more.

Furthermore, since the expanded portions 1110A are bent from the end portions of the core 1110 in the longitudinal direction toward the dial plate 5, the radio waves from the dial plate 5 side can be received more easily. The receiving sensitivity can be improved without enlarging the whole antenna as compared with the conventional antenna.

Additionally, as to each expanded portion 1110A, the area of the facing surface 1110C facing the dial plate 5 is larger than the sectional area of the central portion 1110B of the core 1110 in the longitudinal direction. Therefore, more radio waves can be received from the facing surfaces 1110C in the expanded portions 1110A, and the receiving sensitivity of the antenna 1100 can be improved more.

Moreover, the expanded portions 1110A bend from the end portions of the core 1110 in the longitudinal direction toward the dial plate 5. The diameters of the expanded portions 1110A gradually decrease toward the central portion 1110B of the core 1110 in the longitudinal direction, and are substantially constant in the central portion 1110B of the core 1110 in the longitudinal direction. Therefore, the radio wave received amount is large on the facing surface 1110C side facing the dial plate 5 in the expanded portion 1110A as compared with the side of the surface 1110D opposite to the facing surface 1110C with respect to the axial line X of the central portion 1110B. Therefore, the radio waves can be received sufficiently from the dial plate 5 side. The receiving sensitivity can be improved without enlarging the whole antenna 1100 as compared with the conventional antenna.

Furthermore, since the amorphous metal is formed into the bulk configuration to manufacture the core 1110, the core 1110 is easily worked into the arbitrary shape as compared with the conventional core provided by the laminating of a plurality of thin films of amorphous metals. Therefore, it is possible to manufacture the antenna 1100 having the shape adapted to its purpose more easily. Since any thin film is not laminated unlike the conventional core of the amorphous metal, working steps can be reduced.

Additionally, since the core 1110 configured by the amorphous metal configured into the bulk configuration has a remarkably high permeability, the receiving sensitivity of the antenna 1100 can be improved remarkably. Since the amorphous metal has a high strength, the core 1110 can be formed to be remarkably thin, and the winding number of the coil 1120 can be increased. Therefore, the receiving sensitivity of the antenna 1100 can be improved. Since the amorphous metal is not prone to rust, and has a satisfactory temperature stability, the life of the antenna 1100 can be lengthened.

In addition, the watch 1*c* has the built-in antenna 1100 whose receiving sensitivity has been improved more than before. Therefore, there can be provided the watch 1*c* capable of receiving the radio waves with a satisfactory sensitivity.

The antenna 1100 according to Embodiment 4 of the present invention may be modified as follows if necessary.

(Modification 1)

Figure 23:
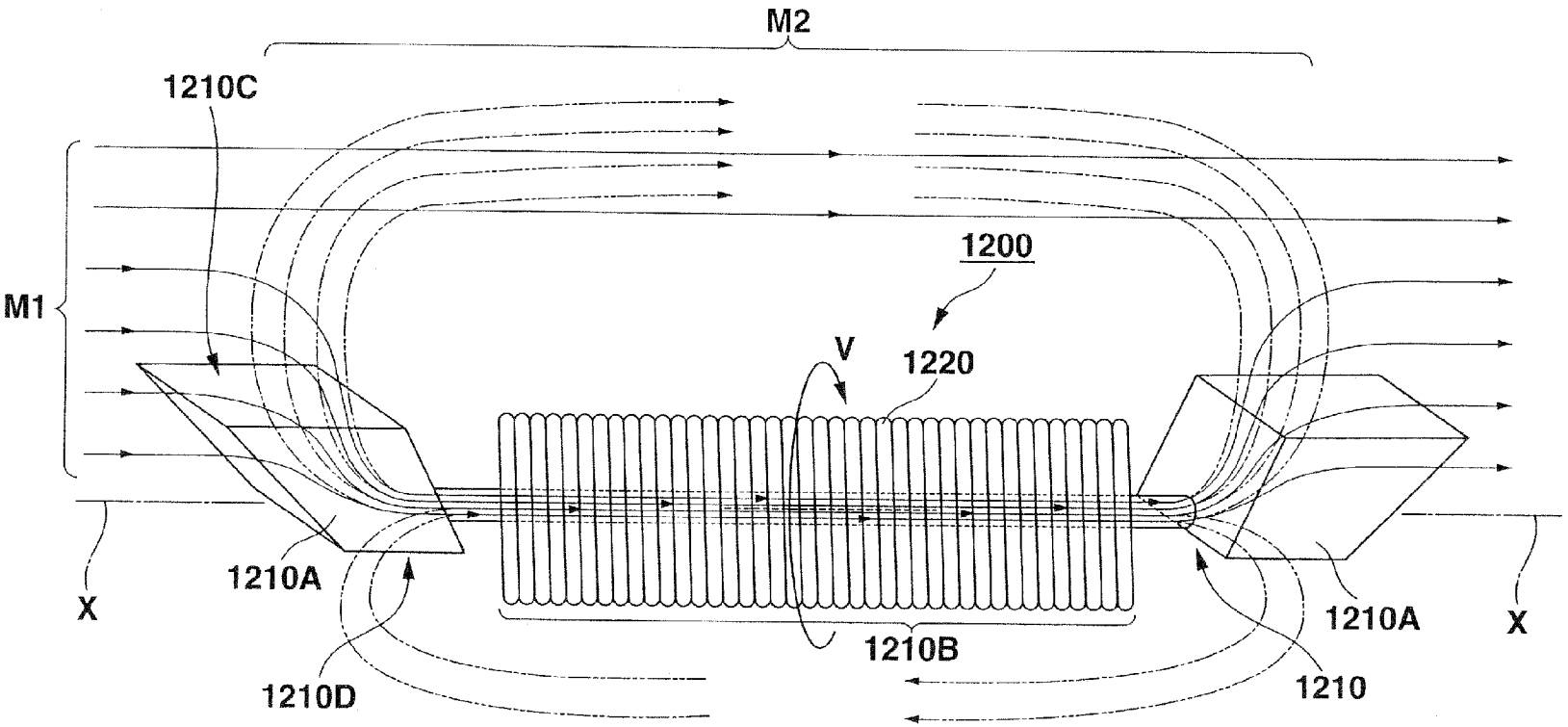
FIG. 23 is a view showing an operation of the antenna according to Modification 1 of Embodiment 4 of the present invention.
Figure 24:
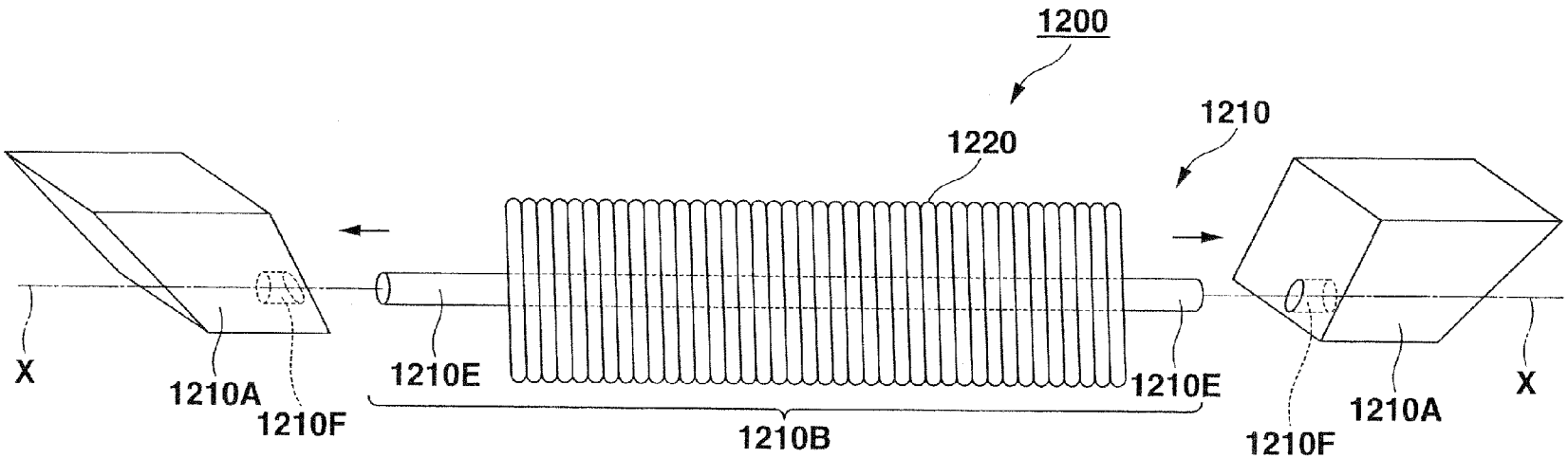
FIG. 24 is a view schematically showing a constitution of the antenna according to Modification 1 of Embodiment 4 of the present invention.

FIG. 23 is a view showing an operation of an antenna 1200 according to Modification 1 of Embodiment 4. FIG. 24 is a view schematically showing a constitution of the antenna 1200 according to Modification 1 of Embodiment 4.

As shown in FIG. 23, the antenna 1200 obtained by modifying the antenna 1100 of Embodiment 4 comprises: a magnetic core 1210; a coil 1220 wound around the core 1210 and the like.

Moreover, in the same manner as in the antenna 1100 of Embodiment 4, the antenna 1200 is disposed under a dial plate 5 in such a manner that the dial plate 5 is parallel with an axial line X of a central portion 1210B of the core 1210 (described later) of the antenna 1200 in a longitudinal direction.

The core 1210 is formed into a bulk configuration by use of an amorphous metal as a material in the same manner as in the antenna 1100 of Embodiment 4, and comprises: as shown in FIG. 23, expanded portions 1210A having two flat surfaces substantially parallel to the dial plate 5 and having a substantially rectangular parallelepiped shape; and the central portion 1210B as a long rod-like member whose section has a circular shape in the longitudinal direction. More specifically, as shown in FIGS. 23 and 24, engagement holes 1210F engaging with end portions 1210E of the core 1210 in the longitudinal direction are disposed in lower portions of the expanded portions 1210A. When the engagement holes 1210F are engaged with the end portions 1210E of the core 1210 in the longitudinal direction, the expanded portions 1210A are connected and fixed to the core 1210. An area of the flat surface of the expanded portion 1210A on a side of a facing surface 1210C of the expanded portion 1210A facing the dial plate 5 is broader (larger) than a flat surface on a side of a surface 1210D opposite to the facing surface 1210C with respect to an axial line X of the central portion 1210B of the core 1210 in the longitudinal direction. A sectional area of the central portion 1210B of the core 1210 in the longitudinal direction is smaller than that of each of the expanded portions 1210A, 1210A disposed on the opposite end portions 1210E, 1210E of the core 1210.

It is to be noted that an adhesive for connecting and fixing the expanded portions 1210A to the end portions 1210E of the core 1210 in the longitudinal direction is not limited as long as the amorphous metals are bonded to each other, and a non-conductive adhesive is preferable from a viewpoint of prevention of an eddy current loss.

Moreover, the core 1210 is made of the amorphous metal. Therefore, even when the central portion 1210B of the longitudinal direction is configured to be thinner than that of a core formed of, for example, ferrite, an equal or more strength can be obtained.

Furthermore, when the antenna 1200 is placed in a signal magnetic field in such a manner that an axial line of the coil 1220 is parallel to a magnetic field direction, as shown in FIG. 23, a signal magnetic flux M1 is concentrated on the core 1210 having a specific permeability which is higher than that of a surrounding space. As a result, the signal magnetic flux M1 is interlinked with the coil 1220, and in the coil 1220, there is generated such an induced electromotive force V as to generate a generated magnetic flux M2 in a direction to inhibit a change of the signal magnetic flux M1 in the coil 1220 according to Lenz's law.

Additionally, the induced electromotive force V generated in the coil 1220 is detected by a reception circuit (not shown) connected to the coil 1220.

Here, the end portions 1210E of the core 1210 in the longitudinal direction are connected and fixed to the lower portions of the expanded portions 1210A. The area of the flat surface of each expanded portion 1210A on the facing surface 1210C side facing the dial plate 5 is broader (larger) than that on the side of the surface 1210D opposite to the facing surface 1210C with respect to the axial line X of the central portion 1210B of the core 1210 in the longitudinal direction. Therefore, in the expanded portions 1210A, 1210A disposed on the opposite end portions 1210E, 1210E of the core 1210 in the longitudinal direction, a radio wave receiving area on the side of the facing surface 1210C facing the dial plate 5 is broader (larger) than that on the side of the surface 1210D opposite to the facing surface 1210C with respect to the axial line X of the central portion 1210B of the core 1210 in the longitudinal direction. Therefore, the antenna 1200 has such a shape that during the receiving of the radio wave, a received radio wave amount is larger on the facing surfaces 1210C of the core 1210 facing the dial plate 5 as compared with the surfaces 210D opposite to the facing surfaces 1210C with respect to the axial line X of the antenna 1200.

Moreover, the antenna 1200 has such a shape that the received radio wave amount is larger on the facing surfaces 1210C of the expanded portions 1210A facing the dial plate 5 as compared with the surfaces 1210D opposite to the facing surfaces 1210C with respect to the axial line X of the antenna 1200. Therefore, the generated magnetic flux M2 is larger on the side of the facing surfaces 1210C of the expanded portions 1210A facing the dial plate 5 as compared with the side of the surfaces 1210D opposite to the facing surfaces 1210C. The generated magnetic flux M2 is generated on the side of the surfaces 1210D of the expanded portions 1210A opposite to the surfaces 1210C facing the dial plate 5 with respect to the axial line X of the antenna 1200. The flux passes through a back lid (not shown), generates an eddy current in the back lid, and generates the eddy current loss of the signal magnetic flux M1. On the other hand, the generated magnetic flux M2 on the side of the surfaces 1210D of the expanded portions 1210A opposite to the surfaces 1210C facing the dial plate 5 with respect to the axial line X of the antenna 1200 is suppressed as compared with the facing surface 1210C side, the eddy current generated in the back lid (not shown) is suppressed, and the eddy current loss of the signal magnetic flux M1 is suppressed.

Therefore, even in the antenna 1200 of Modification 1 and a watch in which this antenna 1200 is incorporated, needless to say, effects can be obtained which are similar to those of the antenna 1100 and the watch 1*c* of Embodiment 1. The expanded portions 1210A which can be easily formed can be connected to the end portions 1210E of the core 1210 to manufacture the core 1210. Therefore, the antenna 1200 can be manufactured more easily. The antenna 1200 is manufactured by the combining of the expanded portions 1210A with the core 1210. Therefore, even an antenna having a complicates shape can be comparatively easily manufactured by the combining of expanded portions having various shapes with a central portion.

Embodiment 5

Figure 25:
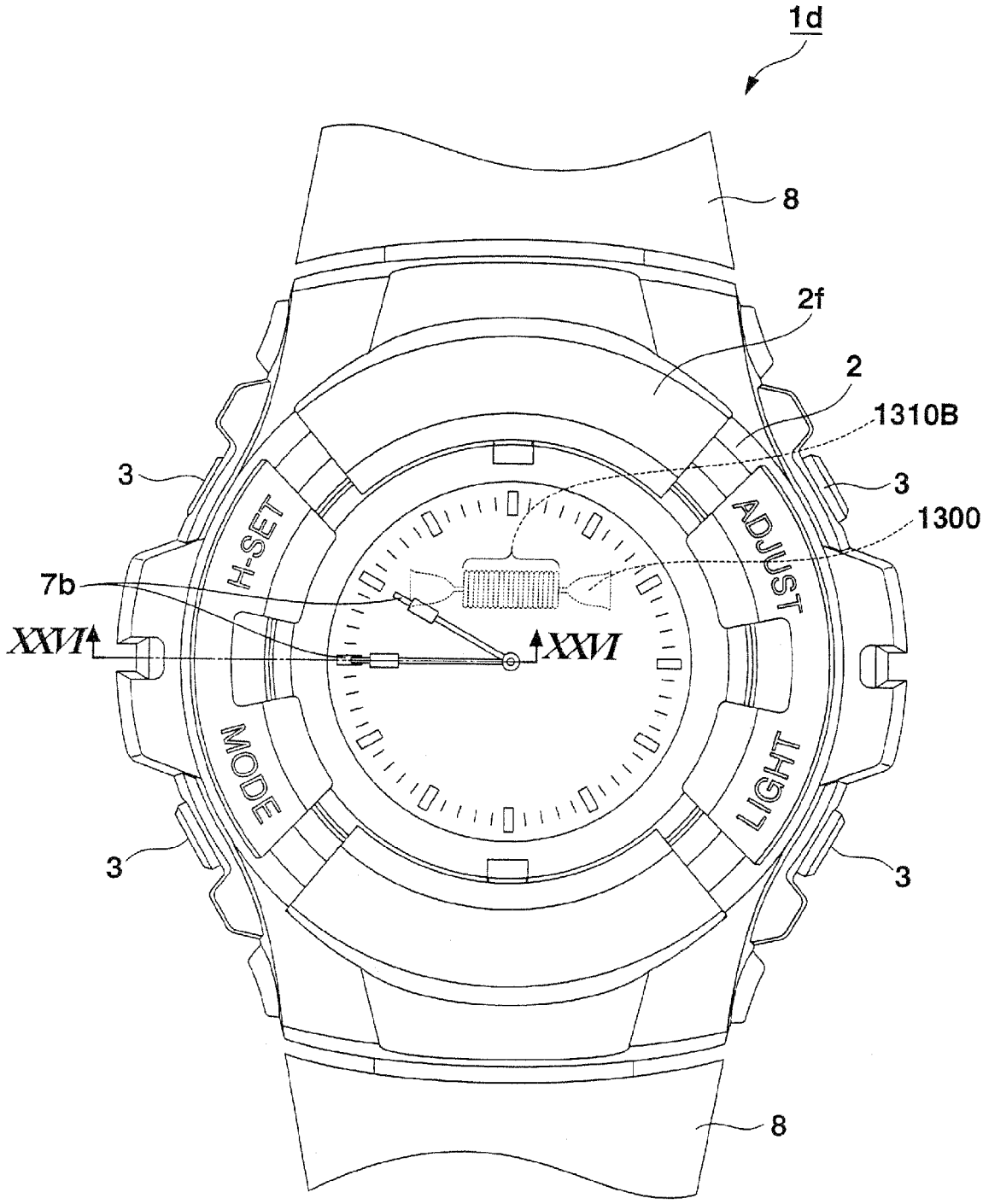
FIG. 25 is a plan view showing the watch having the built-in antenna according to Embodiment 5 of the present invention.
Figure 26:
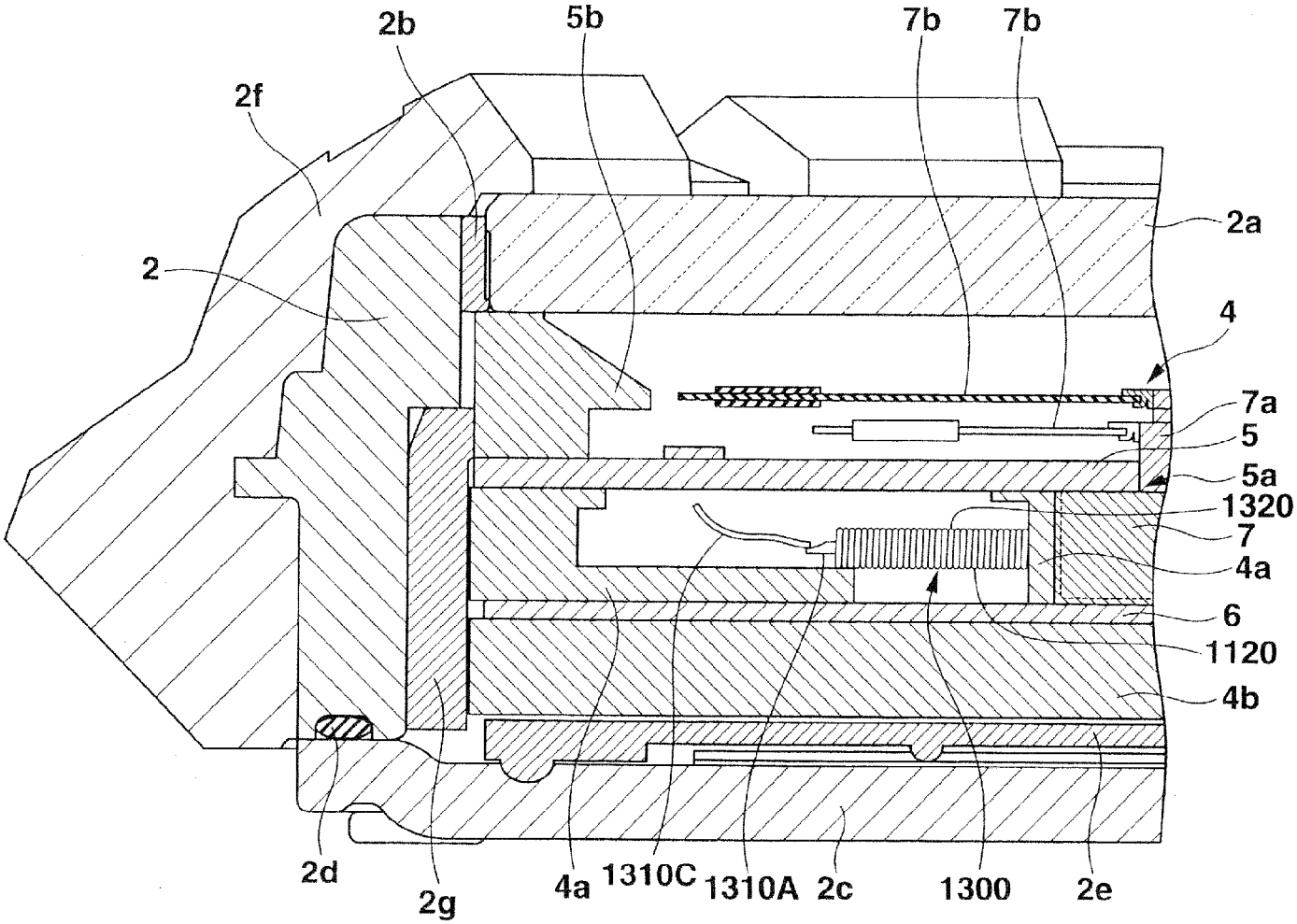
FIG. 26 is a sectional view taken along a line XXVI-XXVI in FIG. 25.
Figure 27:
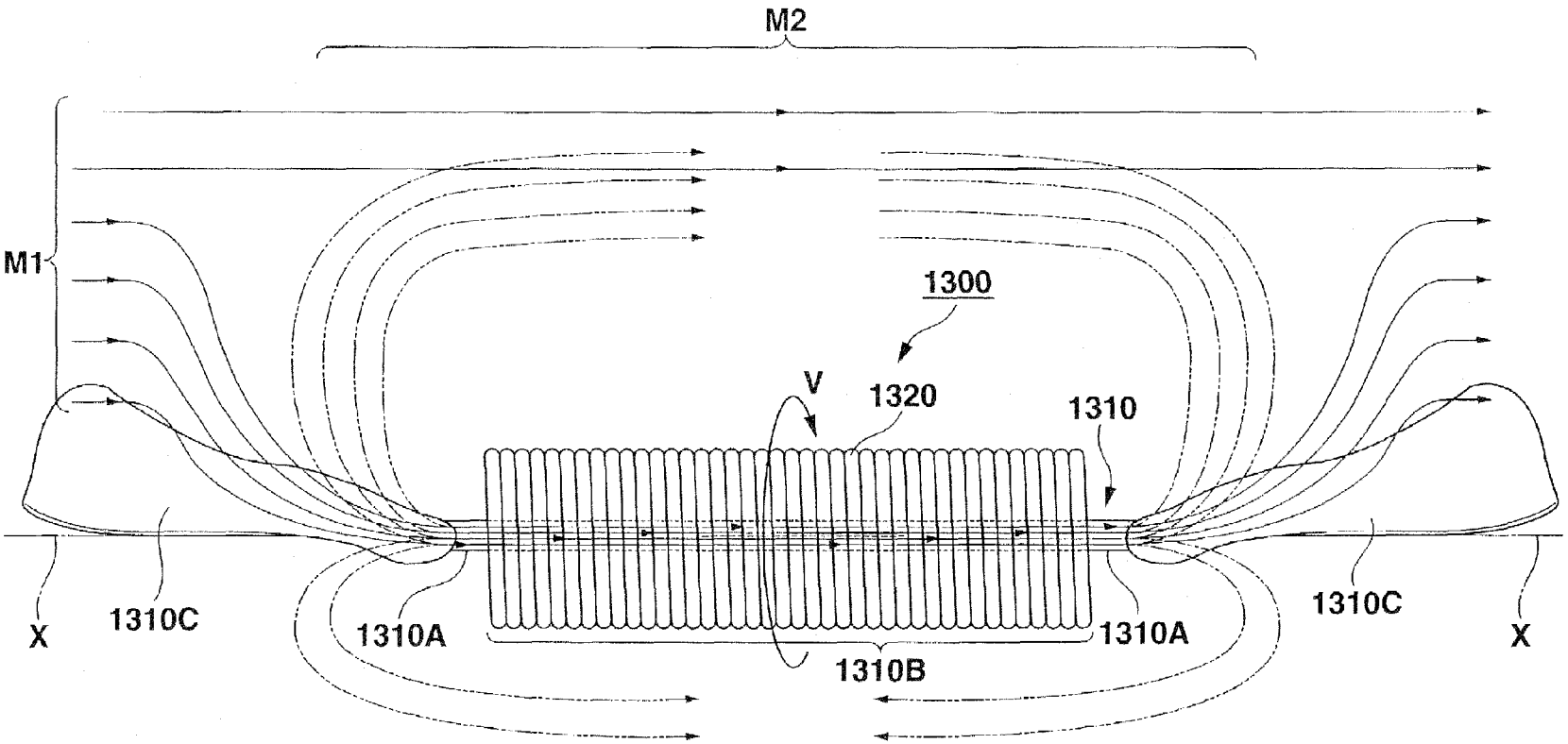
FIG. 27 is a view showing an operation of the antenna according to Embodiment 5 of the present invention.

In a watch 1*d* according to Embodiment 5 of the present invention, as shown in FIGS. 25, 26, and 27, an only structure of an antenna 1300 is different from that of the antenna 100 of Embodiment 1. Therefore, a constitution similar to that of the watch 1 of Embodiment 1 is denoted with the same reference numerals, and description thereof is omitted.

FIG. 25 is a plan view of the watch 1*d* having the built-in antenna 1300 according to Embodiment 5 of the present invention, and FIG. 26 is a sectional view taken along a line XXVI-XXVI in FIG. 25.

Moreover, FIG. 27 is a view showing an operation of the antenna 1300 according to Embodiment 5.

As shown in FIG. 26, the antenna 1300 is disposed under a dial plate 5 as a decorative plate.

Moreover, as shown in FIG. 27, the antenna 1300 according to Embodiment 5 comprises: a magnetic core 1310; a coil 1320 wound around the core 1310; magnetic sheets 1310C, 1310C attached to opposite end portions 1310A, 1310A of the core 1310 in a longitudinal direction in such a manner as to protrude outward from the core 1310 and the like.

As shown in FIG. 27, the core 1310 is, for example, a long rod-like member whose section has a circular shape. Each end portion 1310A of the core 1310 in the longitudinal direction is configured into, for example, a flat surface shape, and each magnetic sheet 1310C is attached to the end portion 1310A of the longitudinal direction in such a manner as to protrude outward from the core 1310. The core 1310 is three-dimensionally formed into a bulk configuration by use of the amorphous metal as the material in the same manner as in the core 110 of the antenna 100. Each magnetic sheet 1310C is configured into a sheet or foil shape by use of the amorphous metal or another magnetic material as the material.

Moreover, the core 1310 is made of the amorphous metal. Therefore, even when a central portion 1310B of the core 1310 in the longitudinal direction is configured to be thinner than that of a core made of, for example, ferrite, an equal or more strength can be obtained.

Furthermore, the coil 1320 is layered and wound around the central portion 1310B of the core 1310 in the longitudinal direction.

Additionally, when the core 1310 is placed in a signal magnetic field in such a manner that an axial line of the central portion 1310B of the coil 1320 in the longitudinal direction is parallel to a magnetic field direction, as shown in FIG. 27, a signal magnetic flux M1 is concentrated on the core 1310 having a specific permeability which is higher than that of a surrounding space. As a result, the signal magnetic flux M1 is interlinked with the coil 1320, and in the coil 1320, there is generated such an induced electromotive force V as to generate a generated magnetic flux M2 in a direction to inhibit a change of the signal magnetic flux M1 in the coil 1320 according to Lenz's law.

Moreover, the induced electromotive force V generated in the coil 1320 is detected by a reception circuit (not shown) connected to the coil 1320.

As described above, according to the antenna 1300 of Embodiment 5 and the watch 1*d* in which this antenna 1300 is incorporated, flat surfaces of the magnetic sheets 1310C attached to the end portions 1310A of the core 1310 in the longitudinal direction can be used as receiving surfaces of radio waves. Therefore, a broader (larger) receiving area can be secured while hardly requiring a three-dimensional space. A receiving sensitivity of the antenna 1300 can be improved.

Furthermore, since the amorphous metal has a high strength, the magnetic sheets 1310C can be thinned without being torn.

Additionally, the watch 1*d* has the built-in antenna 1300 whose receiving sensitivity has been improved, and therefore there can be provided the watch 1*d* capable of receiving the radio wave with a satisfactory sensitivity.

Embodiment 6

Figure 28:
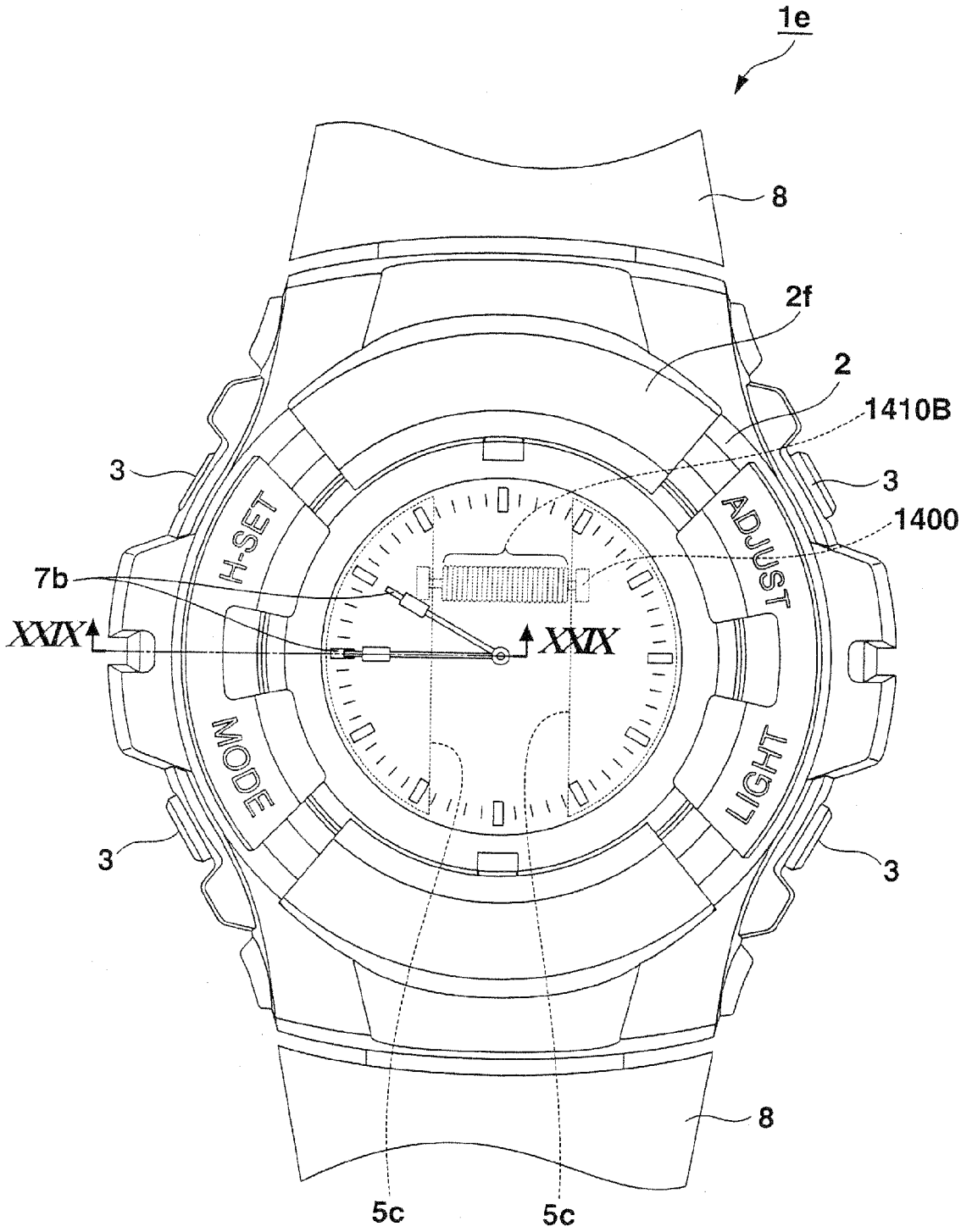
FIG. 28 is a plan view showing the watch having the built-in antenna according to Embodiment 6 of the present invention.
Figure 29:
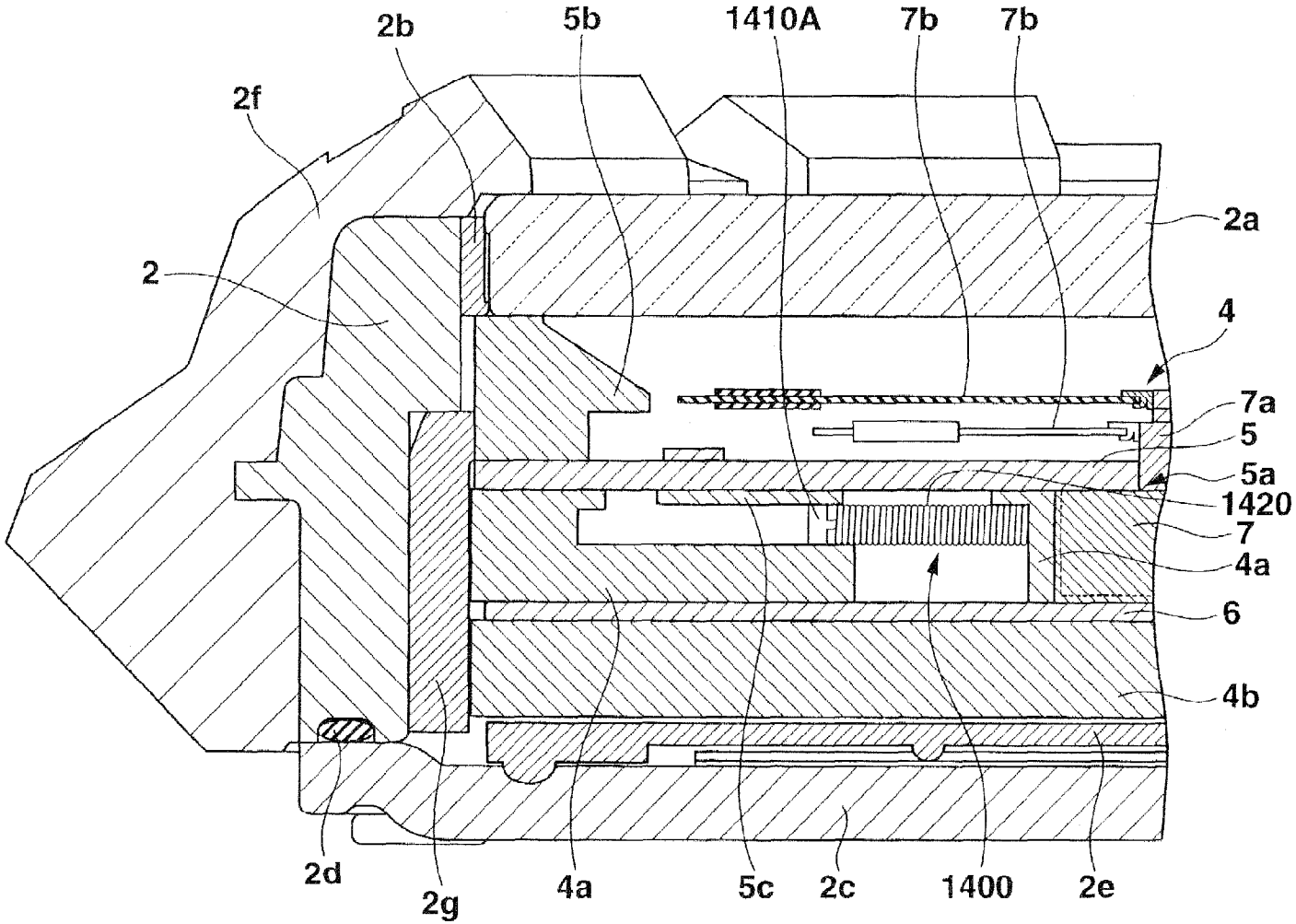
FIG. 29 is a sectional view taken along a line XXIX-XXIX in FIG. 28.
Figure 30:
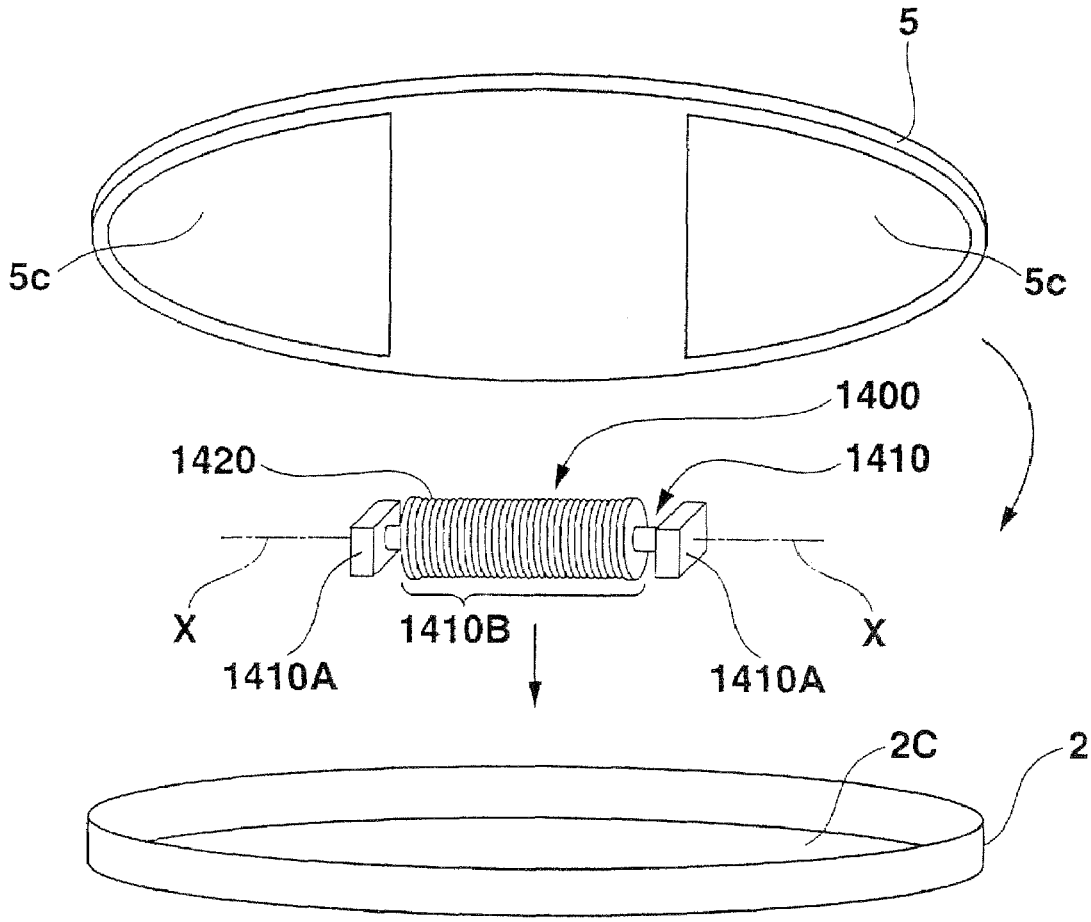
FIG. 30 is a view schematically showing a built-in process of the antenna into the watch according to Embodiment 6 of the present invention.

As shown in FIGS. 28, 29, and 30, a watch 1*e* according to Embodiment 6 of the present invention is different in magnetic sheets 5*c* as magnetic layers. An only structure of an antenna 1400 is different from that of the antenna 100 of Embodiment 1. Therefore, a constitution similar to that of the watch 1 of Embodiment 1 is denoted with the same reference numerals, and description thereof is omitted.

FIG. 28 is a plan view of the watch 1*e* having the built-in antenna 1400 according to Embodiment 6, and FIG. 29 is a sectional view taken along a line XXIX-XXIX in FIG. 28. FIG. 30 is a view schematically showing a built-in process of the antenna 1400 into the watch 1*e* according to Embodiment 6.

As shown in FIG. 29, the antenna 1400 is supported by an upper housing portion 4*a*, and disposed between a lower portion of a dial plate 5 as a decorative plate and an upper portion of a lower housing portion 4*b*. Moreover, the antenna is disposed in such a manner that the dial plate 5 is parallel to an axial line X of a central portion 1410B of a core 1410 (described later) of the antenna 1400 in a longitudinal direction.

Moreover, the magnetic sheets 5*c* are disposed on a lower surface of the dial plate 5, that is, the surface on an antenna 1400 side.

As shown in FIG. 28, the magnetic sheets 5*c* are attached to regions outside a region facing the central portion 1410B (described later) of the antenna 1400 in the longitudinal direction in the surface of the dial plate 5 on the antenna 1400 side.

Moreover, each magnetic sheet 5*c* is a sheet having a substantial fan shape surrounded with a circle slightly smaller than an outer circular shape of the dial plate 5 and straight lines connecting opposite end portions of the circle. As a magnetic material forming the magnetic sheet 5*c*, an amorphous metal, ferrite or the like is usable, but a material having a high strength is preferable from a viewpoint of prevention of breaking of the sheet, and the sheet is preferably formed of the amorphous metal.

As shown in FIG. 30, the antenna 1400 comprises: the magnetic core 1410; a coil 1420 wound around the core 1410 and the like.

For example, in the same manner as in the core 1110, the core 1410 is formed into a bulk configuration by use of an amorphous metal as a material. As shown in FIG. 30, the core comprises: expanded portions 1410A having flat surfaces substantially parallel to the dial plate 5 and having substantially rectangular parallelepiped shapes; and the central portion 1410B which is a long rod-like member having a circular section in the longitudinal direction.

Moreover, the core 1410 is made of the amorphous metal. Therefore, even when the central portion 1410B of the longitudinal direction is configured to be thinner than that of a core made of, for example, ferrite, an equal or more strength can be obtained.

Furthermore, the antenna 1400 is disposed in such a manner that the expanded portions 1410A, 1410A disposed on opposite end portions of the core 1410 are brought into contact with the magnetic sheets 5*c* attached to the dial plate 5, and the expanded portions 1410A are magnetically connected to the magnetic sheets 5*c*.

In addition, as shown in FIG. 30, the above-described antenna 1400 is disposed above a back lid 2*c* in a watch case 2, and the dial plate 5 provided with the magnetic sheets 5*c* is disposed above the antenna 1400.

According to the antenna 1400 of Embodiment 6 described above, the magnetic sheets 5*c* attached to the lower surface of the dial plate 5, that is, the surface on the antenna 1400 side are used as radio wave receiving surfaces, and radio waves can be received from the surfaces of the magnetic sheets 5*c*. That is, when the antenna 1400 is placed in a signal magnetic field in such a manner that the axial line of the coil 1420 is parallel to a magnetic field direction, a magnetic flux (not shown) by a signal magnetic field is concentrated on the core 1410 through the magnetic sheets 5*c* and the expanded portions 1410A disposed on the end portions of the core 1410. As a result, the signal magnetic flux (not shown) is interlinked with the coil 1420, and in the coil 1420, there is generated such an induced electromotive force V as to generate a magnetic flux (not shown) in a direction to inhibit a change of the signal magnetic flux (not shown) in the coil 1420 according to Lenz's law. Therefore, the radio waves from the dial plate 5 side can be received with a satisfactory efficiency.

Since the antenna 1400 can receive the radio wave through the surfaces of the magnetic sheets 5*c* having broad areas, more radio waves can be received, a receiving sensitivity of the antenna 1400 can be improved, and there can be provided the watch 1*e* capable of receiving the radio wave with a satisfactory sensitivity.

Moreover, since the amorphous metal has a high strength, the magnetic sheets 5*c* can be thinned without being broken.

Furthermore, since the amorphous metal is formed into the bulk configuration to manufacture the core 1410, the core 1410 is easily worked into the arbitrary shape as compared with the conventional core provided by the laminating of a plurality of thin films of amorphous metals. Therefore, it is possible to manufacture the antenna 1400 having the shape adapted to its purpose more easily. Since any thin film is not laminated unlike the conventional core of the amorphous metal, working steps can be reduced.

Additionally, since the core 1410 configured by the amorphous metal formed into the bulk configuration has a remarkably high permeability, the receiving sensitivity of the antenna 1400 can be improved remarkably. Since the amorphous metal has the high strength, the core 1410 can be formed to be remarkably thin, and the winding number of the coil 1420 can be increased. Therefore, the receiving sensitivity of the antenna 1400 can be improved. Since the amorphous metal is not prone to rust, and has a satisfactory temperature stability, the life of the antenna 1400 can be lengthened.

It is to be noted that in Embodiment 6, magnetic layers are provided by the magnetic sheets 5*c*, but may be disposed, for example, by chemical or physical coating with a magnetic material such as the amorphous metal.

Moreover, the antenna 1400 is disposed in such a manner as to bring the expanded portions 1410A, 1410A disposed on the opposite end portions of the core 1410 into the magnetic sheets 5*c* attached to the dial plate 5, but the antenna 1400 may be disposed in such a manner that the expanded portions 1410A face the magnetic sheets 5*c* through a magnetically connectable space.

Furthermore, a shape of each expanded portion 1410A disposed on the end portion of the core 1410 is not limited to the above-described shape, and any shape may be used as long as the expanded portion can be magnetically connected to the magnetic sheet 5*c*.

According to Embodiment 4 of the present invention, the antenna and the core are disposed under the decorative plate, and the expanded portions have such shapes that during the receiving of the radio wave, a received radio wave amount is larger on the side of the surfaces facing the decorative plate as compared with the side of the surfaces opposite to the facing surfaces with respect to the axial line of the central portion of the core in the longitudinal direction. Therefore, the radio waves from the decorative plate side can be sufficiently received, and the receiving sensitivity can be improved without enlarging the whole antenna as compared with the conventional antenna.

Moreover, according to Embodiment 4 of the present invention, since the expanded portions bend from the end portions of the core in the longitudinal direction toward the decorative plate, the radio waves from the decorative plate side can be more easily received, and the receiving sensitivity can be improved without enlarging the whole antenna as compared with the conventional antenna.

Furthermore, according to Embodiment 4 of the present invention, an area of the facing surface of each expanded portion facing the decorative plate is larger than a sectional area of the central portion of the core in the longitudinal direction, more radio waves can be received from the facing surface of the expanded portion, and the receiving sensitivity of the antenna can be improved more.

Additionally, according to Embodiment 4 of the present invention, a radio wave receiving area on the side of the facing surface of the expanded portion facing the decorative plate is larger than that on the surface opposite to the facing surface with respect to the axial line. Therefore, when the radio wave is received, more radio waves can be received from the facing surface of each expanded portion. Therefore, the radio waves can be sufficiently received from the decorative plate side, and the receiving sensitivity can be improved without enlarging the whole antenna as compared with the conventional antenna.

Moreover, according to Embodiment 4 of the present invention, each expanded portion bends from the end portion of the core in the longitudinal direction toward the decorative plate, and a diameter of the expanded portion gradually decreases toward the central portion of the core in the longitudinal direction, and is substantially constant in the central portion of the core in the longitudinal direction. Therefore, a radio wave received amount is larger on the side of the facing surface of the expanded portion facing the dial plate with respect to the axial line of the central portion as compared with the side of the surface opposite to the facing surface. Therefore, the radio waves can be sufficient received from the decorative plate, and the receiving sensitivity can be improved without enlarging the whole antenna as compared with the conventional antenna.

Furthermore, according to Embodiment 5 of the present invention, the flat surfaces of the magnetic sheets attached to the end portions of the core in the longitudinal direction can be used as the radio wave receiving surfaces. Therefore, a three-dimensional space is hardly required, a broader receiving area can be secured, and the receiving sensitivity of the antenna can be enhanced. When each magnetic sheet is made of the amorphous metal having the high strength, the magnetic sheet can be thinned.

Additionally, according to Embodiment 6 of the present invention, the flat surface of the magnetic layer disposed on the lower surface of the decorative plate is used as the radio wave receiving surface, and the radio wave can be received through the magnetic layer. Therefore, the radio wave from the decorative plate can be received with a satisfactory efficiency.

Moreover, since the antenna can receive the radio wave through the surface of the magnetic layer having a large area, more radio wave can be received, and the receiving sensitivity of the antenna can be enhanced. There can be provided the electronic device capable of receiving the radio wave with a satisfactory sensitivity.

Furthermore, according to Embodiments 4 to 6 of the present invention, since the amorphous metal is formed into the bulk configuration to manufacture the core, the core is easily worked into the arbitrary shape as compared with the conventional core provided by the laminating of a plurality of thin films of amorphous metals. Therefore, it is possible to manufacture the antenna having the shape adapted to its purpose more easily. Since any thin film is not laminated unlike the conventional core of the amorphous metal, working steps can be reduced.

Additionally, since the core configured by the amorphous metal configured into the bulk configuration has a remarkably high permeability, the receiving sensitivity of the antenna can be improved remarkably. Since the amorphous metal has the high strength, the core can be formed to be remarkably thin, and the winding number of the coil can be increased. Therefore, the receiving sensitivity of the antenna can be improved. Since the amorphous metal is not prone to rust, and has a satisfactory temperature stability, the life of the antenna can be lengthened.

It is to be noted that in the embodiment of the present invention, the core is formed of the amorphous metal, but may be formed of a magnetic material such as ferrite.

Moreover, it has been described in the present embodiment a case where the present invention is applied to the antenna built in a watch type radio-wave clock as the electronic device to receive the standard radio wave, but the application of the present invention is not limited to this. The present invention may be applied to, for example, an antenna for a device mounted in a car, a keyless entry system, an IC tag or the like.

Embodiment 7

Figure 31:
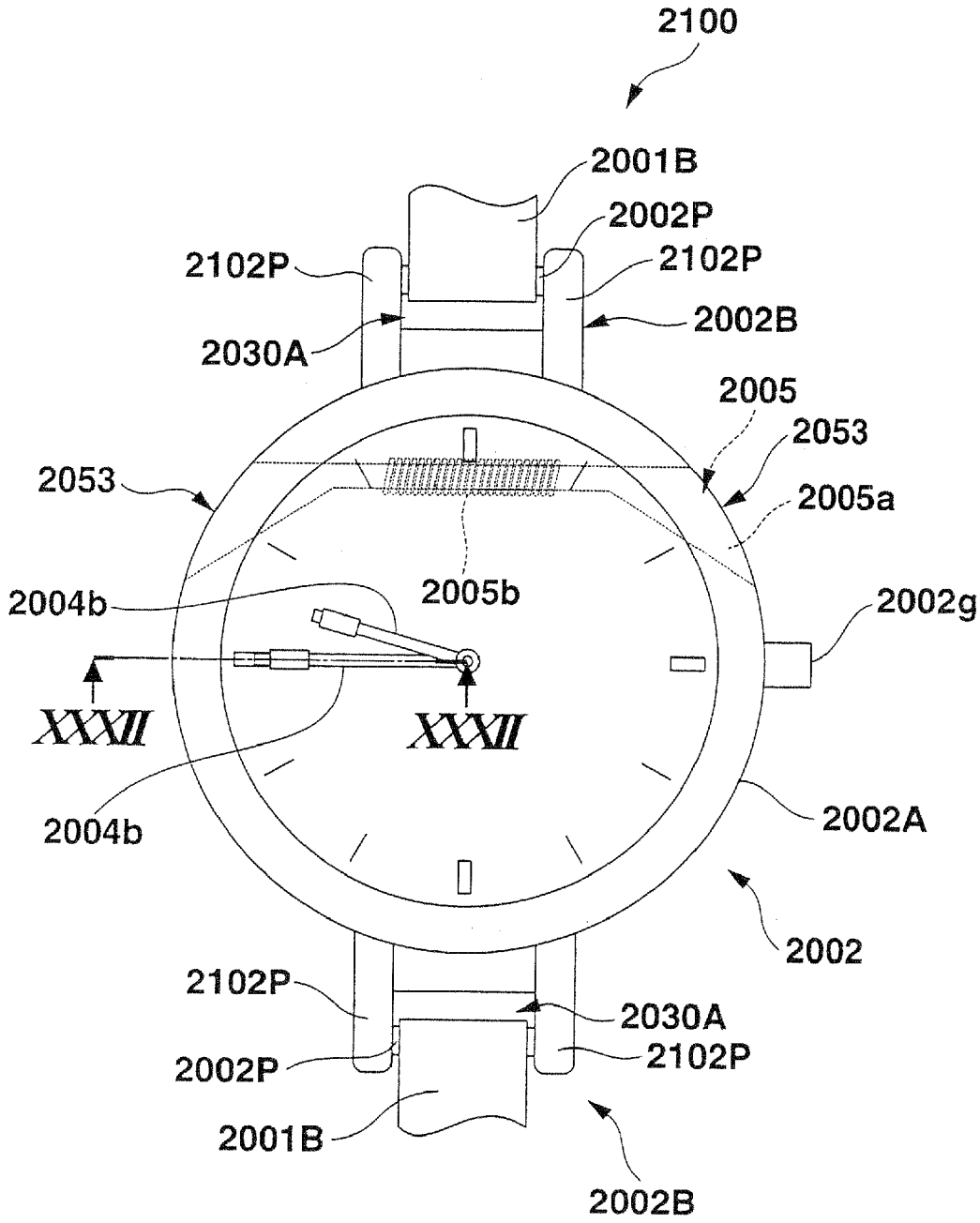
FIG. 31 is a plan view schematically showing a constitution of the watch according to Embodiment 7 of the present invention.
Figure 32:
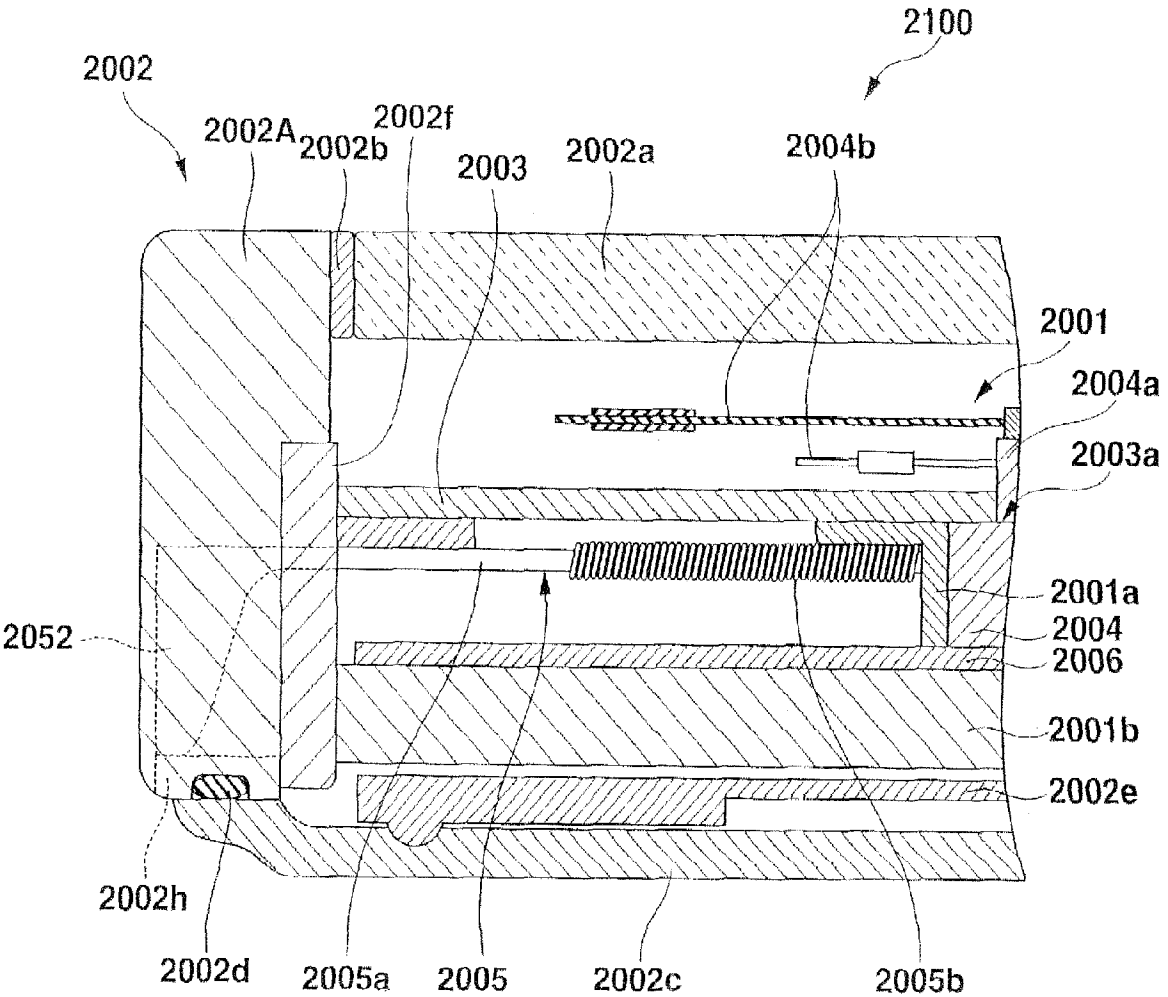
FIG. 32 is a sectional view taken along a line XXXII-XXXII in FIG. 31.
Figure 33:
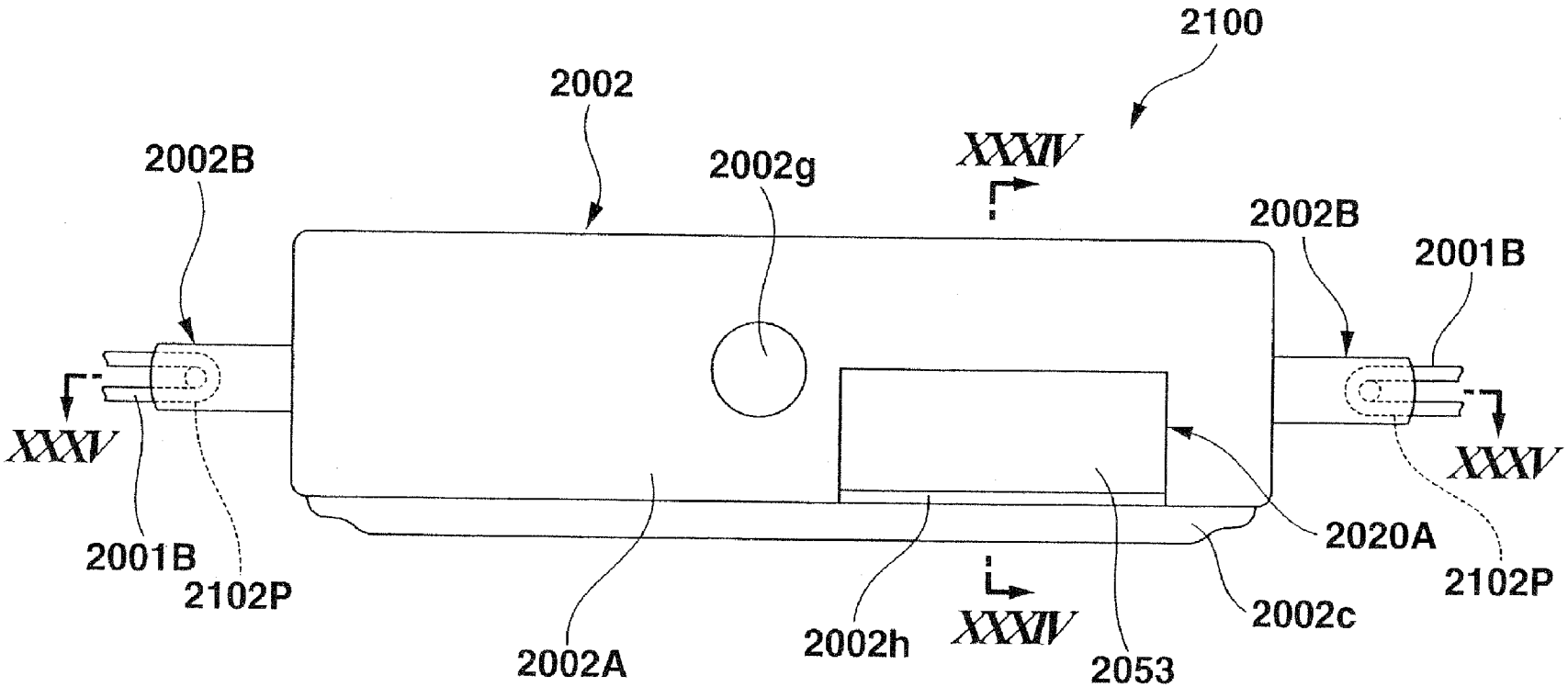
FIG. 33 is a right side view of the watch according to Embodiment 7.
Figure 34:
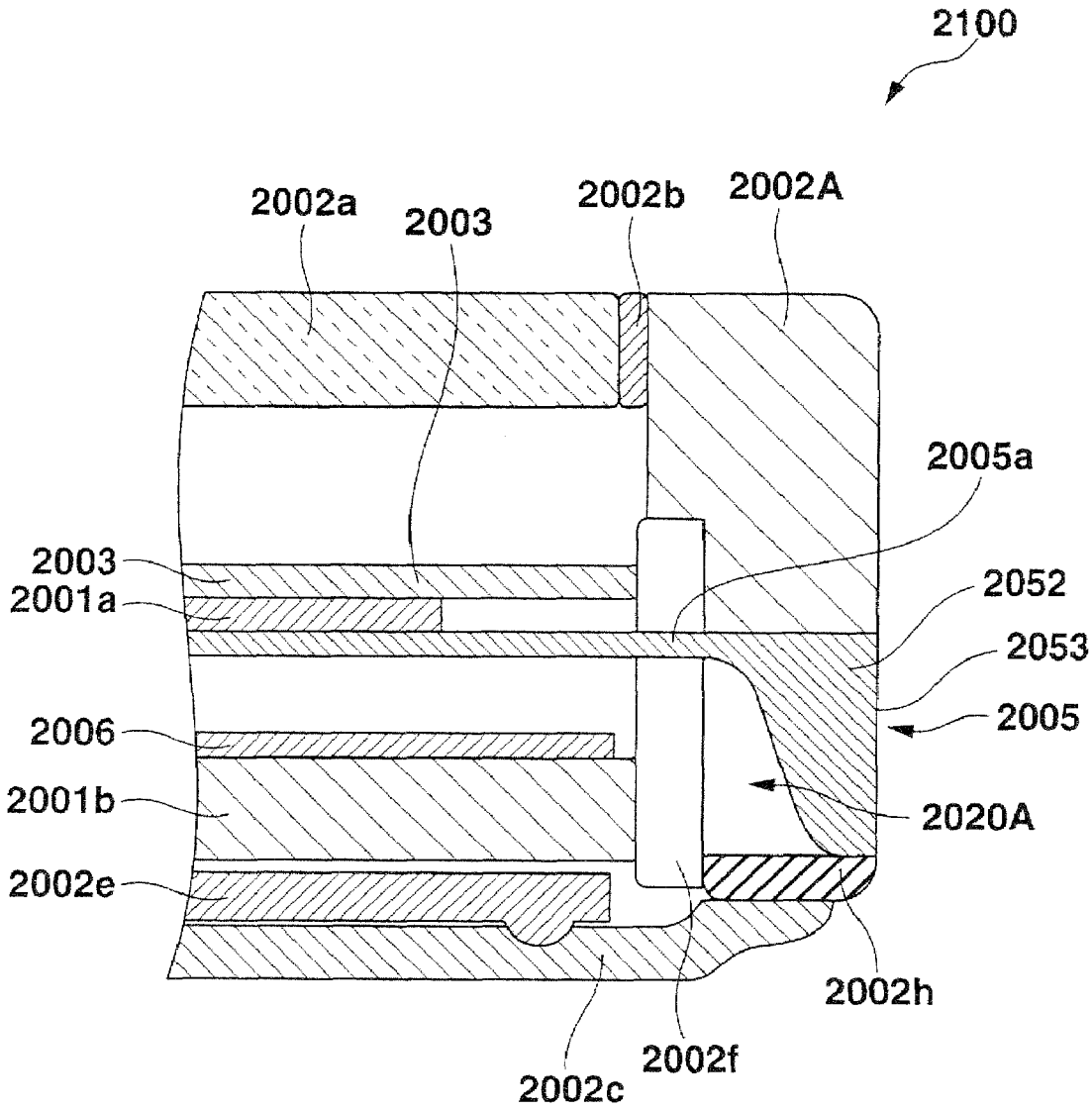
FIG. 34 is a sectional view taken along a line XXXIV-XXXIV in FIG. 33.

FIG. 31 is a plan view schematically showing a constitution of a watch 2100 according to Embodiment 7 of the present invention. FIG. 32 is a sectional view taken along a line XXXII-XXXII in FIG. 31. FIG. 33 is a right side view of the watch 2100 of FIG. 31. FIG. 34 is a sectional view taken along a line XXXIV-XXXIV in FIG. 33.

As an electronic device illustrated as Embodiment 7 to which an electronic device of the present invention is applied, as shown in FIGS. 31 and 32, the watch 2100 has a built-in antenna 2005 to receive a radio wave (hereinafter referred to as the "standard radio wave") carrying time information relating to a standard time and correct a displayed time.

The watch 2100 comprises a metal-made watch case 2002 as a device case in which a watch timing portion 2001 is stored, and a watch glass 2002*a* with a packing 2002*b* is fitted into an upper surface center of the watch case 2002.

Moreover, a back lid 2002*c* with a waterproof ring 2002*d* is attached to a lower surface of the watch case 2002, and a buffer member 2002*e* is disposed between the watch timing portion 2001 and the back lid 2002*c*.

The watch timing portion 2001 comprises: an upper housing portion 2001*a*; a lower housing portion 2001*b*; an analog pointer mechanism 2004 which operates pointers 2004*b* such as an hour pointer and a second pointer on a dial plate 2003; the antenna 2005 which receives a standard radio wave; and a circuit substrate 2006 connected to the analog pointer mechanism 2004 and the antenna 2005 to control them. Peripheral edge portions of the lower housing portion 2001*b*, the upper housing portion 2001*a*, and the dial plate 2003 are attached to an inner frame 2002*f* disposed on an inner peripheral surface of the watch case 2002. Portions of the lower housing portion 2001*b*, the upper housing portion 2001*a*, and the inner frame 2002*f* corresponding to a place where the antenna 2005 is disposed are cut out to secure a storage space of the antenna 2005.

The lower housing portion 2001*b* is supported above the buffer member 2002*e* disposed above the back lid 2002*c*, and the circuit substrate 2006 is disposed between the lower housing portion 2001*b* and the upper housing portion 2001*a*. The dial plate 2003 is disposed on an upper surface of the upper housing portion 2001*a*. The upper housing portion 2001*a* is provided with the analog pointer mechanism 2004. The analog pointer mechanism 2004 has a pointer shaft 2004*a* extending upward from a shaft hole 2003*a* disposed in the dial plate 2003, and pointers 2004*b* such as the hour pointer and a minute pointer attached to the pointer shaft 2004*a*, and operates the pointers 2004*b* above the dial plate 2003. A battery (not shown) for operating the analog pointer mechanism 2004 is incorporated in, for example, the lower housing portion 2001*b*.

The watch case 2002 comprises: a case main body 2002A having a substantially cylindrical shape; band attaching portions 2002B, 2002B disposed protruding outward from a side surface of the case main body 2002A in six o'clock and twelve o'clock directions and the like.

Two rectangular cutout portions 2020A, 2020A opened on a bottom surface side are disposed on the side surface of the case main body 2002A.

The cutout portions 2020A, 2020A are disposed in positions substantially facing each other through the band attaching portion 2002B in the side surface of the case main body 2002A. The cutout portions 2020A are disposed in positions closer to the band attaching portion 2002B in the twelve o'clock direction rather than to that in the six o'clock direction.

Each of the band attaching portions 2002B, 2002B comprises: two pin fixing portions 2102P facing each other at an interval between a three o'clock direction and a nine o'clock direction; and a band fixing pin 2002P which is disposed between the pin fixing portions 2102P and 2102P and to which a band 2001B is attached so that the watch 2100 can be attached to user's wrist. Each through opening 2030A having a substantially rectangular shape is disposed in a region surrounded with the pin fixing portions 2102P, the band fixing pin 2002P, and the case main body 2002A.

The antenna 2005 is disposed in the upper housing portion 2001*a*, and comprises: a magnetic core 2005*a*; and a coil 2005*b* wound around this core 2005*a* as shown in FIGS. 31, 32.

Figure 35:
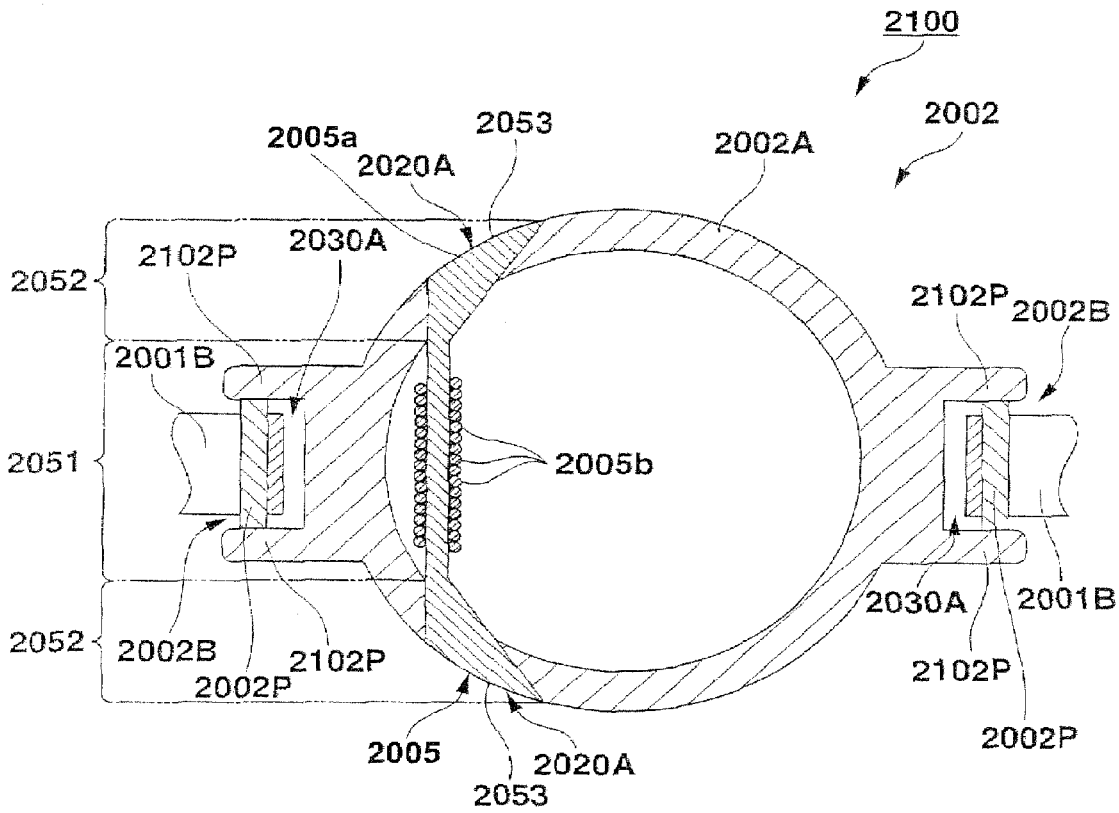
FIG. 35 is a sectional view along line XXXV-XXXV of FIG. 33.

FIG. 35 is a schematically sectional view along line V-V of FIG. 33. As shown in FIG. 35, the core 2005*a* comprises: for example, a central portion 2051 positioned in a central portion of the core 2005*a* in the longitudinal direction and having a substantial square pole shape; and end portions 2052, 2052 disposed in opposite end portions of the central portion 2051.

Each end portion 2052 has a shape whose width broadens in a longitudinal direction from a boundary surface with the central portion 2051. An outer shape of an end surface 2053 of the end portion 2052 substantially agrees with that of a cutout portion 2020A disposed in the watch case 2002. The surface of the end surface 2053 is a curved surface having a curvature which is equal to that of an outer peripheral surface of the case main body 2002A.

Moreover, as shown in FIG. 32, a portion of the end portion 2052 positioned in an inner space of the case main body 2002A in a side view has a thickness which is substantially equal to that of the central portion 2051. A portion of the end portion superimposed on the case main body 2002A thickens as the portion comes close to the end surface 2053. That is, a sectional area of the end portion 2052 is set in such a manner as to increase as the portion superimposed on the case main body 2002A comes close to the end surface 2053. Therefore, an area of the end surface 2053 of the core 2005*a* is set to be larger than a sectional area of the central portion 2051.

The antenna 2005 is disposed in the upper housing portion 2001*a* in such a manner that the axial line of the core 2005*a* is parallel to the back lid 2002*c* (or the dial plate 2003) between the lower housing portion 2001*b* and the dial plate 2003.

Furthermore, the antenna 2005 is disposed in the watch case 2002 in such a manner as to fit the end surfaces 2053 of the antenna 2005 into the cutout portions 2020A. That is, the antenna is disposed in such a manner that the opposite end surfaces 2053 of the core 2005*a* are exposed from the watch case 2002 to the outside. Moreover, an insulating material 2002*h* is disposed between the end portion 2052 positioned in the cutout portion 2020A and the back lid 2002*c*, the end surface 2053 and the case main body 2002A are prevented from being configured into a continuous curved surface. The end portion 2052 is surrounded with a conductive member configured by the case main body 2002A, and the side surface of the watch 2100 is configured in such a manner as to be prevented from being brought into a short-circuit state at a high frequency (in an alternating manner). The insulating material 2002*h* is brought into contact with the back lid 2002*c*, and has a waterproof effect. Examples of the usable insulating material 2002*h* include a vinyl chloride-based material, a polyethylene-based material, and an ethylene propylene-based material.

A ferromagnetic material having a large permeability is preferably used in the core 2005*a* from a property that a magnetic flux is concentrated on a place having a less magnetic resistance. Examples of the ferromagnetic material include ferrite, an amorphous metal and the like. Above all, the amorphous metal is more preferable because its permeability is high and its strength is also high. A plurality of thin films of amorphous metals may be laminated, and the amorphous metal formed into a bulk configuration is more preferable in respect of a degree of freedom in a shape of the core 2005*a*.

Specifically, examples of the bulked amorphous metal include an Fe-based alloy, a Pd-based alloy, a Zr-based alloy, an Ni-based alloy and the like. Examples of the Fe-based alloy include an Fe—M—B (M=Cr, W, Ta, Nb, Hf, Zr)-based alloy, an Fe—Co—RE—B (RE=Nb, Sm, Tb, Dy)-based alloy and the like. More specifically, the amorphous metal is formed of a composition such as $Pd_{40}Cu_{30}Ni_{10}P_{20}$ or $Fe_{81}B_{13}Si_{14}C_2$. Moreover, when the melted alloy is worked into the bulk configuration by casting, an inner configuration is configured to be amorphous.

Here, the core 2005*a* is made of the amorphous metal. Therefore, even when the central portion 2051 is configured to be thinner than that of a core made of, for example, ferrite, an equal or more strength can be obtained.

The coil 2005*b* is configured by a conductor which transmits electricity, and, for example, a copper wire is usable. In each figure, to simplify description, a diameter of the coil 2005*b* is increased, and a shown winding number is small, but the diameter and the winding number of the coil 2005*b* can be appropriately set.

Figure 36:
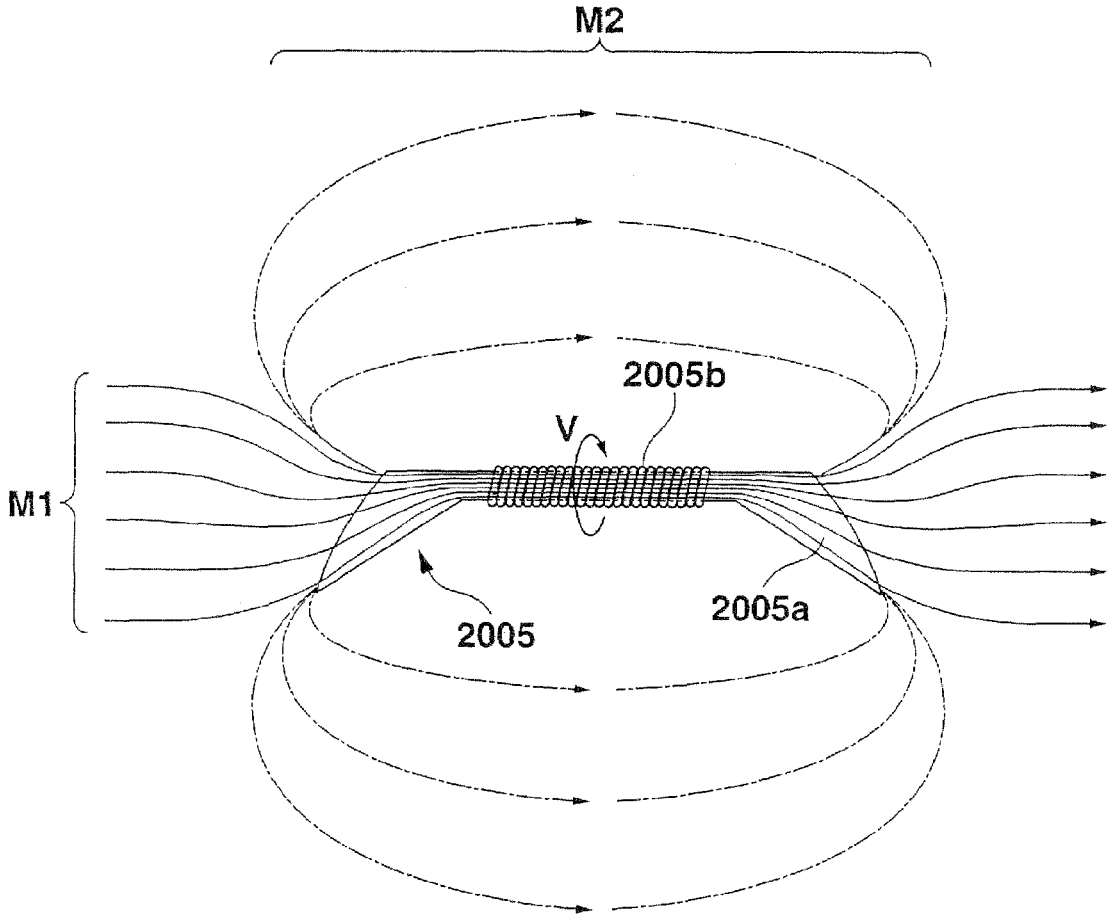
FIG. 36 is a view showing a function of a signal magnetic flux in the antenna of FIG. 35.

Next, a magnetic flux generated in the antenna 2005 will be described with reference to FIG. 36 in a case where the antenna 2005 is disposed in a magnetic field (hereinafter referred to as the "signal magnetic field") by a standard radio wave. FIG. 36 is a view showing a function of a signal magnetic flux in the antenna.

When the antenna 2005 is disposed in the signal magnetic field in such a manner that the axial line of the core 2005*a* is parallel to a signal magnetic field direction, as shown in FIG. 36, a magnetic flux (hereinafter referred to as the "signal magnetic flux") M1 by the signal magnetic field is concentrated on the core 2005*a* having a permeability higher than that of a surrounding space.

When the signal magnetic flux M1 is concentrated on the core 2005*a*, the signal magnetic flux M1 is interlinked with the coil 2005*b*, and in the coil 2005*b*, there is generated such an induced electromotive force V as to generate a magnetic flux (hereinafter referred to as the "generated magnetic flux") in a direction to inhibit generation of the signal magnetic flux M1 in the coil 2005*b* according to Lenz's law.

The induced electromotive force V generated in the coil 2005*b* is detected by a reception circuit (not shown) connected to the coil 2005*b*. The reception circuit (not shown) includes a tuning capacitor (not shown) for tuning to a frequency (40 kHz or 60 kHz in Japan) of the standard radio wave to be received, or a loss resistance (not shown). It is to be noted that the reception circuit (not shown) is mounted on, for example, the circuit substrate 2006.

The generated magnetic flux M2 generated by the induced electromotive force V generates a magnetic field around the core 2005*a*. This magnetic field reaches a metal member positioned in the vicinity of the antenna 2005, that is, the watch case 2002 to generate an eddy current in the watch case 2002.

Since an inner constitution of the watch 2100 is the same as that described with reference to FIG. 4 in Embodiment 1, description thereof is omitted.

According to the above-described watch 2100, the opposite end surfaces 2053, 2053 of the core 2005*a* which captures the standard radio wave are exposed from the watch case 2002 to the outside. Therefore, the standard radio wave can be captured directly by the opposite end surfaces 2053, 2053, and the standard radio wave can be received efficiently and securely.

Moreover, the core 2005*a* which captures the standard radio wave has such a shape that an area of each of the opposite end surfaces 2053, 2053 of the core 2005*a* is larger than a sectional area of the central portion 2051 of the core 2005*a*. Accordingly, the receiving sensitivity of the standard radio wave can be enhanced, receivable directions increase more, and therefore directivity can be relaxed.

Consequently, when the standard radio wave is received, there can be compensated for an energy loss by the eddy current generated in the vicinity of the antenna 2005, and time can be corrected with a high precision.

Furthermore, when the core 2005*a* is formed of the amorphous metal, the core 2005*a* is provided with the high strength and permeability, and the radio wave can be captured more securely. Furthermore, when the core 2005*a* is configured by the bulked amorphous metal, a degree of freedom in forming the core 2005*a* can be improved.

It is to be noted that the antenna 2005*a* is horizontally symmetric with respect to the center of a length direction, but may be horizontally asymmetric as long as the end surfaces 2053 are exposed from the watch case 2002.

Moreover, in the present embodiment, as shown in FIG. 33, a part of the watch case 2002 is cut out to expose the end surface 2053 to the outside. Moreover, the insulating material 2002*h* is disposed between the end portion 2052 positioned in the cutout portion 2020A and the back lid 2002*c*. This is because it is difficult to receive a received radio wave appropriately, when a periphery of the end portion 2052 comes in contact with a hollowed portion to cause the metal surrounding the hollowed portion to cause an alternating short circuit in a case where a part of the watch case 2002 made of the metal is hollowed to expose the end surface 2053. Therefore, in a case where the watch case is formed of a nonconductive material (e.g., a resin or the like), the watch case may be hollowed to expose the end surface 2053. Appropriate working such as prevention of the alternating short circuit may be performed to hollow the metal-made watch case 2002 and expose the end surface 2053.

Furthermore, the insulating material 2002*h* is disposed only between the end portion 2052 positioned in the cutout portion 2020A and the back lid 2002*c*, but an insulating ring may be disposed on the whole contact surface between the end portion 2052 and the watch case 2002.

Embodiment 8

Figure 37:
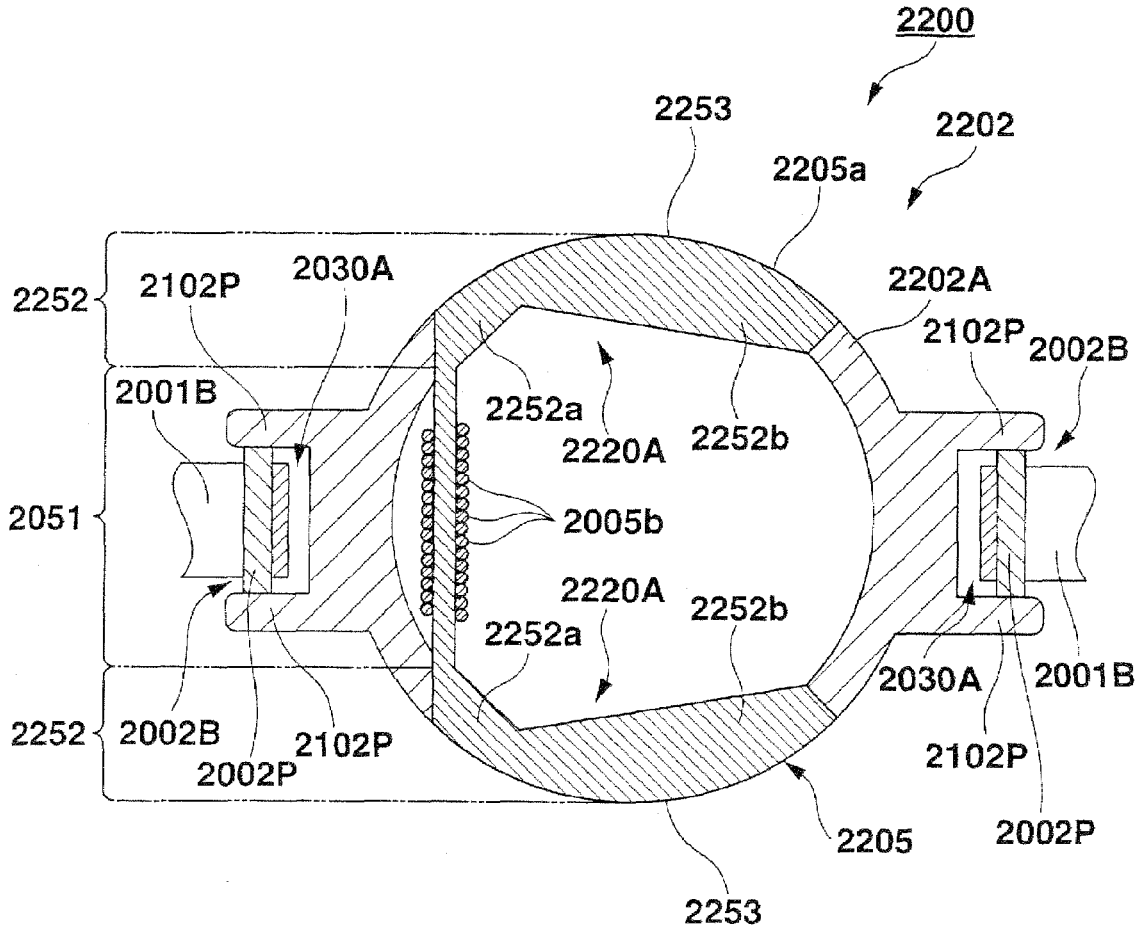
FIG. 37 is a sectional view corresponding to FIG. 35 in the watch according to Embodiment 8 of the present invention.

Next, a watch 2200 according to Embodiment 8 of the present invention will be described. FIG. 37 is a sectional view of the watch 2200 according to Embodiment 8 to which the present invention is applied. To describe the watch 2200, the same constitution as that of the watch 2100 of Embodiment 7 is denoted with the same reference numerals, and description thereof is omitted.

As shown in FIG. 37, a watch case 2202 of the watch 2200 comprises: a case main body 2202A having a substantially cylindrical shape; band attaching portions 2002B, 2002B disposed protruding outward from the side surface of the case main body 2202A in six and twelve o'clock directions and the like.

The side surface of the case main body 2202A is provided with two rectangular cutout portions 2220A, 2220A opened on a bottom surface side. The cutout portions 2220A, 2220A are disposed in positions substantially facing each other through the band attaching portion 2002B.

An antenna 2205 of the watch 2200 comprises: a magnetic core 2205*a*; and a coil 2005*b* wound around this core 2205*a*. The core 2205*a* comprises: a central portion 2051 positioned in a central portion of the core 2205*a* in the longitudinal direction and having a schematic square pole shape; and end portions 2252, 2252 disposed on opposite end portions of the central portion 2051.

Each end portion 2252 comprises: an enlarged width portion 2252*a* whose width broadens apart from a boundary surface with the central portion 2051 in a plan view in the longitudinal direction; and an extended portion 2252*b* extended from a tip of the enlarged width portion 2252*a* further in the six o'clock direction. An outer shape of an end surface 2253 of each end portion 2252 substantially agrees with a shape of the cutout portion 2220A disposed in the watch case 2202, and the surface of the end surface 2253 has a curvature which is equal to that of an outer peripheral surface of the case main body 2202A.

A sectional area of the end portion 2252 is provided in such a manner as to broaden as it departs from the central portion 2051, that is, it comes close to the end surface 2253. Therefore, an area of the end surface 2253 of the core 2205*a* is provided in such a manner as to be larger than a sectional area of the central portion 2051.

The antenna 2205 is disposed in such a manner that the end portion 2252 of the antenna 2205 is fit into the cutout portion 2220A. That is, the antenna is disposed in such a manner that the opposite end surfaces 2253, 2253 of the core 2205*a* are exposed from the watch case 2202 to the outside. Moreover, the end surface 2253 and the case main body 2202A configure a continuous curved surface to configure the side surface of the watch 2200.

According to the watch 2200, needless to say, effects similar to those of the watch 2100 are obtained. Since the end portion 2252 of the antenna 2205 is provided with the extended portion 2252*b*, an area exposed from the case main body 2202A can be enlarged as compared with the antenna 2205 of Embodiment 7. Therefore, the area of each of the opposite end surfaces 2253 of the core 2205*a* which captures the standard radio wave is provided in such a manner as to be sufficiently larger than the sectional area of the central portion 2051. Consequently, the receiving sensitivity of the antenna 2205 can be improved more. Additionally, a receivable direction largely broadens, and directivity can be relaxed.

Embodiment 9

Figure 38:
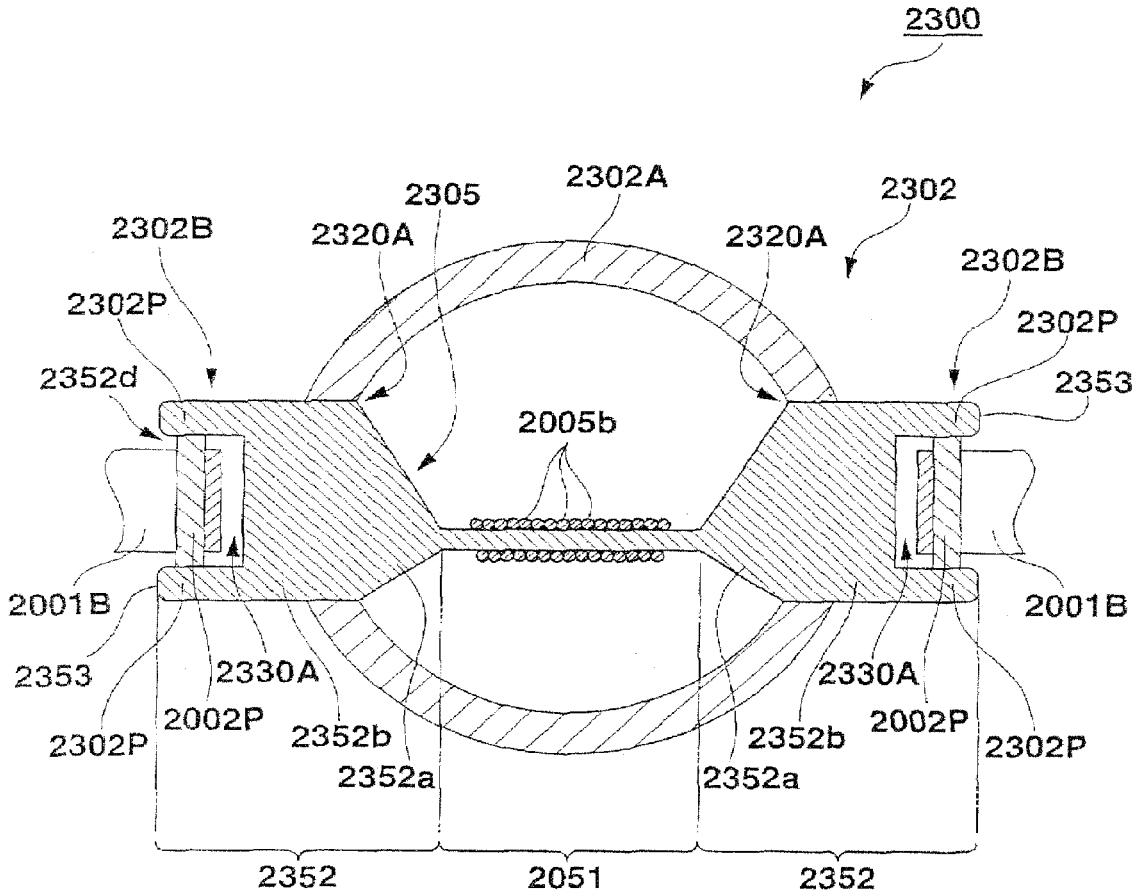
FIG. 38 is a sectional view corresponding to FIG. 35 in the watch according to Embodiment 9 of the present invention.

Next, a watch 2300 according to Embodiment 9 of the present invention will be described. FIG. 38 is a sectional view of the watch 2300 according to Embodiment 9 to which an electronic device of the present invention is applied. To describe the watch 2300, the same constitution as that of the watch 2100 of Embodiment 7 is denoted with the same reference numerals, and description thereof is omitted.

As shown in FIG. 38, a watch case 2302 of the watch 2300 comprises: a case main body 2302A having a substantially cylindrical shape.

A side surface of the case main body 2302A is provided with two rectangular cutout portions 2320A, 2320A opened on a bottom surface side. The cutout portions 2320A, 2320A are disposed in positions in band attaching directions including six and twelve o'clock directions in the case main body 2302A.

An antenna 2305 of the watch 2300 comprises: a magnetic core 2305*a*; and a coil 2005*b* wound around this core 2305*a*. The core 2305*a* comprises: a central portion 2051 positioned in a central portion of the core 2305*a* in the longitudinal direction and having a schematic square pole shape; and end portions 2352, 2352 disposed on opposite end portions of the central portion 2051.

Each end portion 2352 comprises: an enlarged width portion 2352*a* whose width broadens in a substantially triangular shape in a plan view extending outward from each end of the central portion 2051 in a longitudinal direction; a rectangular portion 2352*b* having a substantially rectangular shape in a plan view extending outward from this enlarged width portion 2352*a* in a longitudinal direction of the core 2305*a*; and two pin fixing portions 2302P, 2302P protruding outward from the rectangular portion 2352*b* in the longitudinal direction of the core 2305*a* and facing each other at an interval in three and nine o'clock directions. A vertically sectional shape in the rectangular portion 2352*b* substantially agrees with a shape of the cutout portion 2320A. Therefore, an area of each end surface 2353 of the core 2305*a* is provided to be larger than a sectional area of the central portion 2051.

Moreover, between the pin fixing portions 2302P, 2302P, there is attached the band fixing pin 2002P through which a band 2001B is attached so that the watch 2300 can be attached to user's wrist. The pin fixing portions 2302P and the band fixing pin 2002P configure a band attaching portion 2302B. A through opening 2330A having a schematically rectangular shape is formed in a region surrounded with the pin fixing portions 2302P, the band fixing pin 2002P, and the case main body 2302A.

The antenna 2305 is disposed in a position inside the watch case 2302, in which the end portions 2352 of the antenna 2305 are fit into cutout portions 2320A, and the rectangular portions 2352*b* of the end portions 2352 protrude from the case main body 2302A. That is, the antenna is disposed in such a manner that the opposite end surfaces 2353, 2353 of the core 2305*a* are exposed from the watch case 2302 toward the outside.

Figure 39:
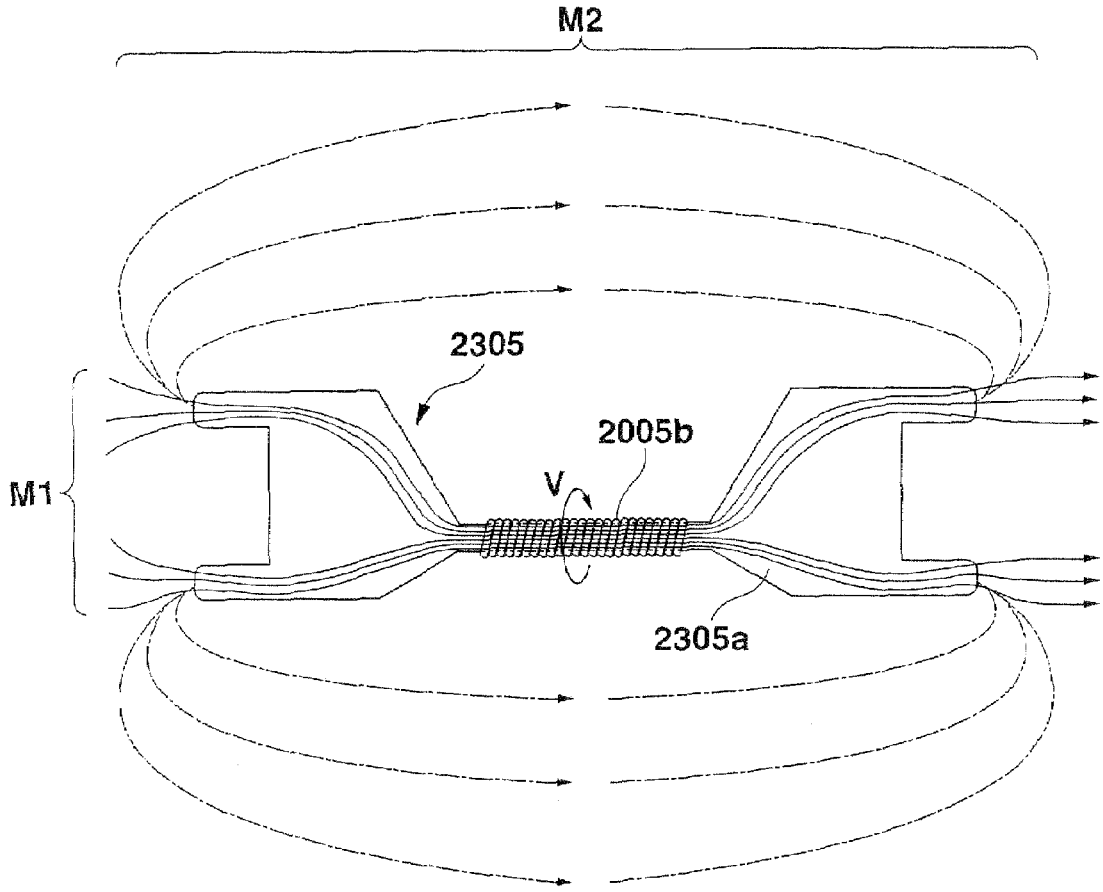
FIG. 39 is a view showing a function of the signal magnetic flux in the antenna of FIG. 38.

FIG. 39 shows a function of a signal magnetic flux which passes through the core 2305*a* of the antenna 2305. A signal magnetic flux M1 enters the core 2305*a* through the end surfaces 2353 to pass through the core 2305*a*. In this case, a generated magnetic flux M2 is generated in the core 2305*a* by an induced electromotive force V generated in the coil 2005*b*. Moreover, an eddy current is generated by the generated magnetic flux M2 in the vicinity of in the watch case 2302.

According to the watch 2300, needless to say, effects similar to those of the watch 2100 can be obtained. Since the band 2001B can be connected to the band fixing pins 2002P disposed on the opposite ends of the core 2305*a* of the antenna 2305, the exposed portions of the core 2305*a* can be recognized as the band attaching portions 2302B by a user. Even in a case where an appearance of the core 2305*a* is different from that of the watch case 2302, the difference is not conspicuous. While the appearance is secured, a high receiving sensitivity can be realized.

Embodiment 10

Figure 40:
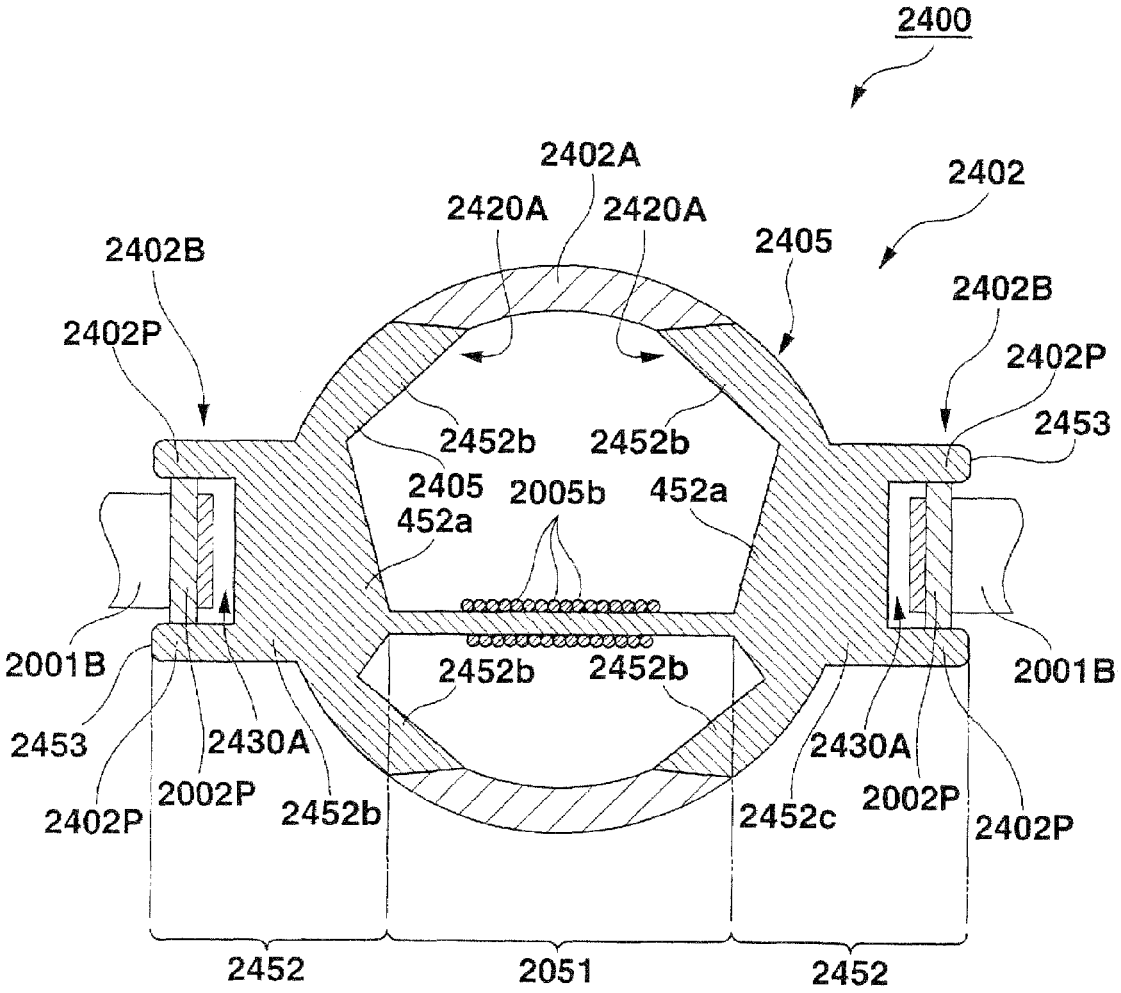
FIG. 40 is a sectional view corresponding to FIG. 35 in the watch according to Embodiment 10 of the present invention.

Next, a watch 2400 will be described according to Embodiment 10 for carrying out the present invention. FIG. 40 is a sectional view of the watch 2400 according to Embodiment 10 to which an electronic device of the present invention is applied. To describe the watch 2400, the same constitution as that of the watch 2300 of Embodiment 9 is denoted with the same reference numerals, and description thereof is omitted.

As shown in FIG. 40, a watch case 2402 of the watch 2400 comprises: a case main body 2402A having a substantially cylindrical shape.

A side surface of the case main body 2402A is provided with two rectangular cutout portions 2420A, 2420A opened on a bottom surface side. The cutout portions 2420A, 2420A are disposed in positions in six and twelve o'clock directions in the case main body 2402A.

An antenna 2405 of the watch 2400 comprises: a magnetic core 2405*a*; and a coil 2005*b* wound around this core 2405*a*. The core 2405*a* comprises: a central portion 2051 positioned in a central portion of the core 2405*a* in the longitudinal direction and having a schematic square pole shape; and end portions 2452, 2452 disposed on opposite end portions of the central portion 2051.

Each end portion 2452 comprises: an enlarged width portion 2452*a* whose width broadens in a substantially triangular shape in a plan view extending outward from each side of the central portion 2051 in a longitudinal direction; extended portions 2452*b*, 2452*b* extending from a tip of the enlarged width portion 2452*a* in three and nine o'clock directions, respectively; a rectangular portion 2452*c* having a substantially rectangular shape extending outward from the enlarged width portion 2452*b* in a longitudinal direction; and two pin fixing portions 2402P, 2402P protruding outward from the rectangular portion 2452*b* in the longitudinal direction of the core 2405*a* and facing each other at an interval in three and nine o'clock directions. Therefore, an area of each end surface 2453 of the core 2405*a* is configured to be larger than a sectional area of the central portion 2051.

Outer shapes of the extended portions 2452*b*, 2452*b* substantially agree with a shape of the cutout portion 2420A disposed in the watch case 2402. An outer surface of each of the extended portions 2452*b*, 2452*b* is a curved surface having a curvature equal to that of an outer peripheral surface of the case main body 2402A.

Moreover, a band fixing pin 2002P is attached between the pin fixing portions 2402P, 2402P to fix a band 2001B to the pin fixing portions 2402P, 2402P, so that the watch 2400 can be attached to user's wrist by the bands 2001B. The pin fixing portions 2402P and the band fixing pin 2002P configure a band attaching portion 2402B. A through opening 2430A having a schematically rectangular shape is formed in a region surrounded with the pin fixing portions 2402P, the band fixing pin 2002P, and the case main body 2402A.

The antenna 2405 is disposed in a position inside the watch case 2402 in which the extended portions 2452*b* of the end portions 2452 of the antenna 2405 are fit into the cutout portions 2420A, the extended portions 2452*b* and the side surface of the case main body 2402A continuously configure a curved surface, and the rectangular portions 2452*c* protrude from the case main body 2402A.

According to the watch 2400, needless to say, effects similar to those of the watch 2100 can be obtained. Since the band 2001B can be connected to the band fixing pins 2002P in the antenna 2405, the exposed portions of the core 2405*a* can be recognized as the band attaching portions 2402B by a user. Even in a case where an appearance of the core 2405*a* is different from that of the watch case 2402, the difference is not conspicuous. While the appearance is secured, a high receiving sensitivity can be realized.

Furthermore, since the end portions 2452 of the antenna 2405 are provided with the extended portions 2452*b*, an area exposed from the case main body 2402A can be enlarged as compared with the antenna 2305 of Embodiment 3. Therefore, an area of each of the opposite end surfaces 2453 of the core 2405*a* which captures a standard radio wave is provided in such a manner as to be sufficiently larger than a sectional area of the central portion 2051. A receiving sensitivity of the antenna 2405 can be improved more, a receivable direction largely spreads, and directivity can be relaxed more.

Embodiment 11

Figure 41:
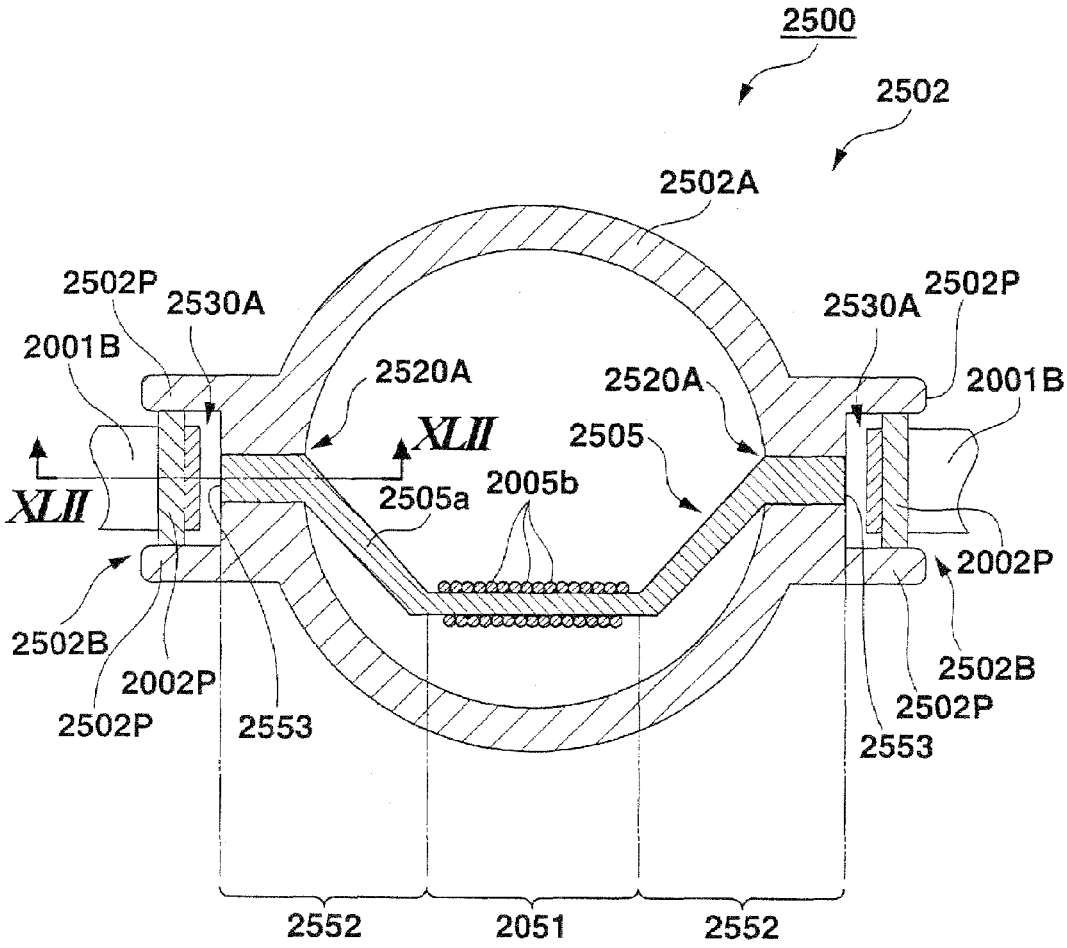
FIG. 41 is a sectional view corresponding to FIG. 35 in the watch according to Embodiment 11 of the present invention.
Figure 42:
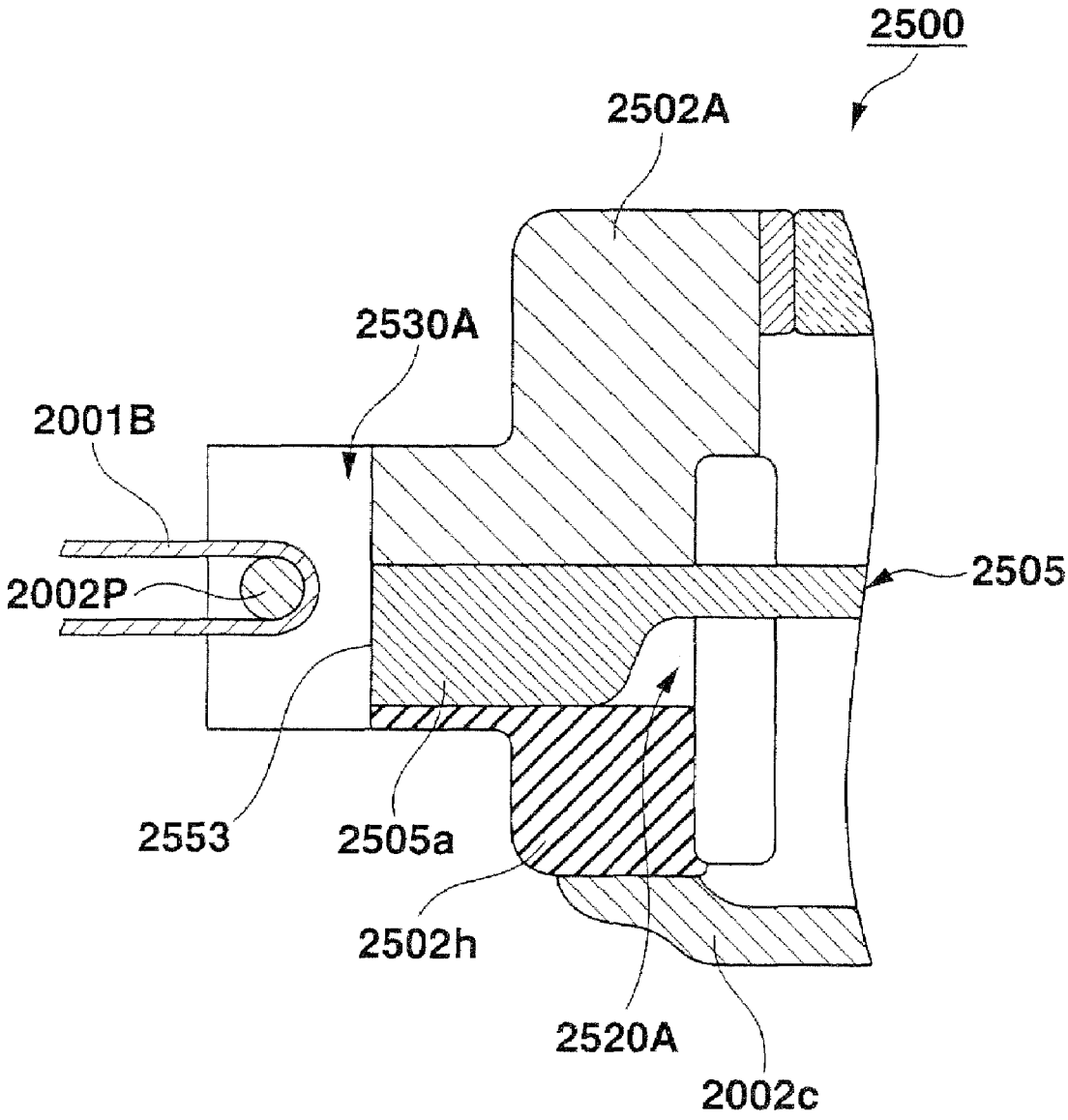
FIG. 42 is a sectional view taken along a line XLII-XLII in FIG. 41.

Next, a watch 2500 will be described according to Embodiment 11 for carrying out the present invention. FIG. 41 is a sectional view of the watch 2500 according to Embodiment 11 to which an electronic device of the present invention is applied. FIG. 42 is a sectional view taken along a line XLII-XLIII in FIG. 41. To describe the watch 2500, the same constitution as that of the watch 2100 of Embodiment 7 is denoted with the same reference numerals, and description thereof is omitted.

As shown in FIGS. 41 and 42, a watch case 2502 of the watch 2500 comprises: a case main body 2502A having a substantially cylindrical shape; band attaching portions 2502B disposed protruding from a side surface of the case main body 2502A in six and twelve o'clock directions and the like.

Two rectangular cutout portions 2520A, 2520A opened on a bottom surface side are disposed in the side surface of the case main body 2502A.

Each of the band attaching portions 2502B, 2502B comprises: two pin fixing portions 2502P facing each other at an interval in three and nine o'clock directions; and a band fixing pin 2002P which is disposed between the pin fixing portions 2502P and 2502P and to which a band 2001B is attached so that the watch 2500 can be attached to user's wrist. Each through opening 2530A having a substantially rectangular shape is disposed in a region surrounded with the pin fixing portions 2502P, the band fixing pin 2002P, and a case main body 2502A. Each cutout portion 2520A is provided in a root portion of the band attaching portion 2502B in the case main body 2502A, and disposed in such a manner as to face the opening 2530A of the band attaching portion 2502B.

An antenna 2505 comprises: a magnetic core 2505*a*; and a coil 2005*b* wound around this core 2505*a*. The core 2505*a* comprises: a central portion 2051 positioned in a central portion of the core 2505*a* in the longitudinal direction and having a substantial square pole shape; and end portions 2552, 2552 disposed in opposite end portions of the central portion 2051.

Each end portion 2552 slightly bends in a three o'clock direction in a boundary surface with respect to the central portion 2051, and bends in a direction substantially parallel to an axial direction of the coil 2005*b* in a root portion of the band attaching portion 2502B. An area of an end surface 2553 of the end portion 2552 is formed to be larger than a sectional area of the central portion 2051. An insulating material 2502*h* is disposed between the end portion 2552 positioned in the cutout portion 2520A and a back lid 2002*c*. Accordingly, the end surface 2553 and the case main body 2502A are prevented from being configured into a continuous curved surface. The end portion 2552 is surrounded with a conductive member configured by the case main body 2502A, and the side surface of the watch 2500 is configured in such a manner as to be prevented from being brought into a short-circuit state at a high frequency (in an alternating manner). The insulating material 2502*h* is brought into contact with the back lid 2002*c*, and has a waterproof effect. Examples of the usable insulating material 2502*h* include a vinyl chloride-based material, a polyethylene-based material, and an ethylene propylene-based material.

The antenna 2505 is disposed in such a manner that the end portions 2552 are fitted into the cutout portions 2520A of the watch case 2502 and the end surface 2553 are exposed in the openings 2530A.

Therefore, when the band 2001B is attached to the band fixing pins 2002P of the band attaching portions 2502B, the band 2001B face the end surfaces 2553 exposed facing the openings 2530A.

According to the watch 2500, needless to say, effects similar to those of the watch 2100 are obtained. The end surfaces 2553 of the antenna 2505 face the bands 2001B attached to the band fixing pins 2002P. Therefore, when the bands 2001B are attached to the band fixing pins 2002P, the opposite end surfaces 2553, 2553 of the core 2505*a* are obstructed by the bands 2001B so that they are not easily seen from the outside. Even if an appearance of the core 2505*a* is different from that of the watch case 2502, the difference is not conspicuous. Without impairing the appearance, the core 2505*a* can be exposed.

Embodiment 12

Figure 43:
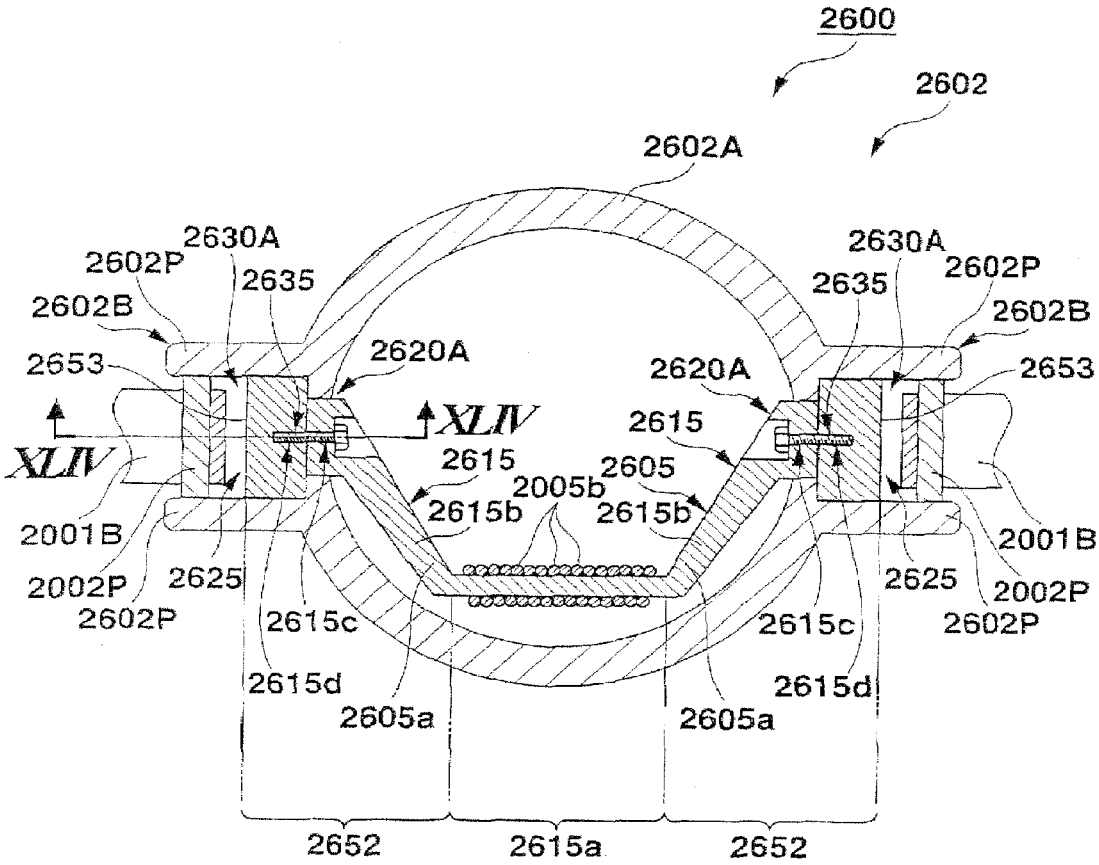
FIG. 43 is a sectional view corresponding to FIG. 35 in the watch according to Embodiment 12 of the present invention.
Figure 44:
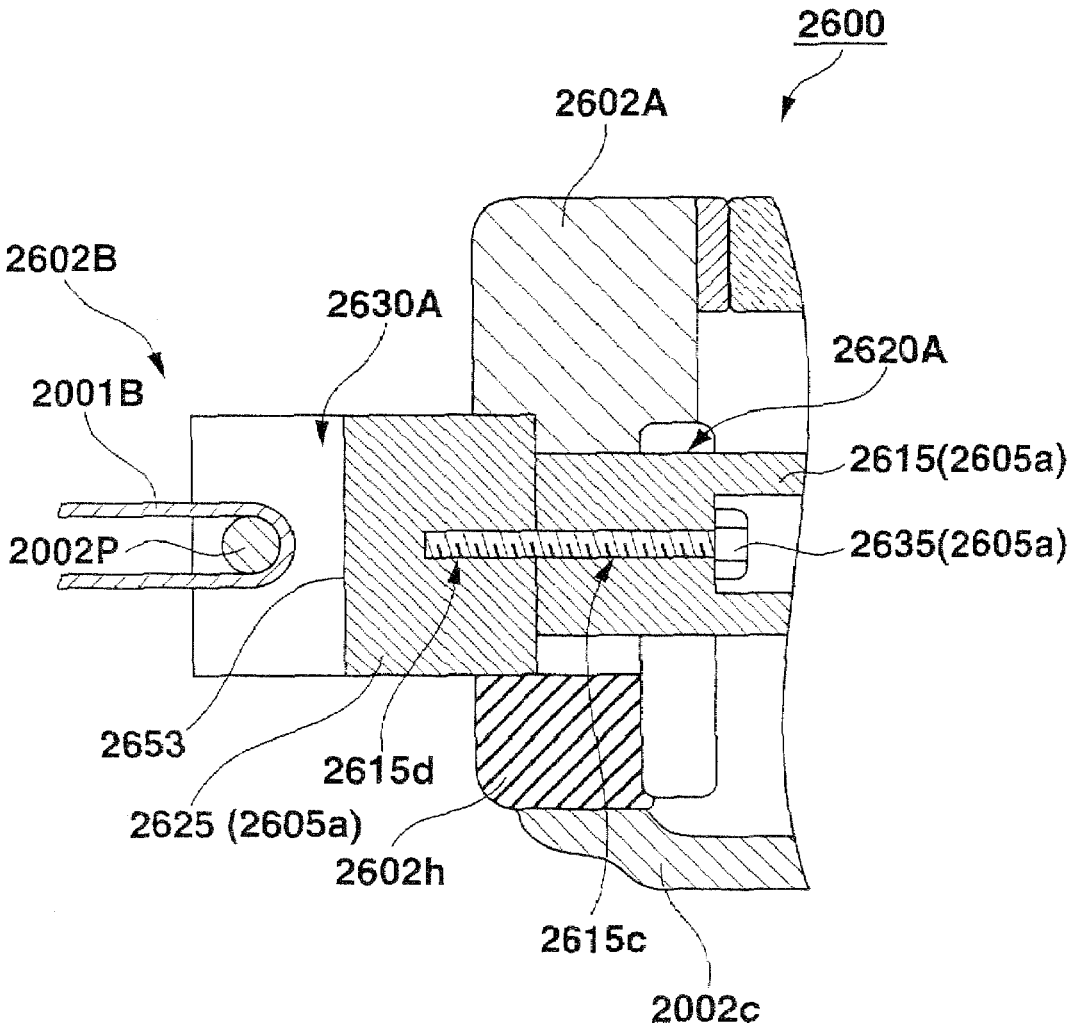
FIG. 44 is a sectional view taken along a line XLIV-XLIV in FIG. 43.

Next, Embodiment 12 for carrying out the present invention will be described. FIG. 43 is a sectional view of a watch 2600 as Embodiment 12 to which an electronic device of the present invention is applied. FIG. 44 is a sectional view taken along a line XLIV-XLIV in FIG. 43. To describe the watch 2600, the same constitution as that of the watch 2100 of Embodiment 7 is denoted with the same reference numerals, and description thereof is omitted.

As shown in FIGS. 43 and 44, a watch case 2602 of the watch 2600 comprises: a case main body 2602A having a substantially cylindrical shape; band attaching portions 2602B disposed protruding from a side surface of the case main body 2602A in six and twelve o'clock directions and the like.

Two rectangular cutout portions 2620A, 2620A opened on a bottom surface side are provided in a side surface of the case main body 2602A.

Each of the band attaching portions 2602B, 2602B comprises: two pin fixing portions 2602P, 2602P facing each other at an interval in three and nine o'clock directions; and a band fixing pin 2002P which is disposed between the pin fixing portions 2602P and 2602P and to which a band 2001B is attached so that the watch 2600 can be attached to user's wrist. Each through opening 2630A having a substantially rectangular shape is disposed in a region surrounded with the pin fixing portions 2602P, the band fixing pin 2002P, and the case main body 2602A.

An antenna 2605 comprises: a magnetic core 2605*a*; and a coil 2005*b* wound around this core 2605*a*.

Furthermore, the core 2605*a* comprises: first magnetic members 2615 disposed inside the watch case 2602; second magnetic members 2625 exposed from the watch case 2602; and connecting members 2635 which are configured by magnetic materials and which connect the first magnetic members 2615 to the second magnetic members 2625 abutting on the first magnetic members.

The first magnetic members 2615 comprise: a central portion 2615*a* positioned substantially in a central portion and substantially having a square pole shape; and bent portions 2615*b*, 2615*b* which are disposed on opposite end portions of the central portion 2615*a* and which obliquely bend in a three/nine o'clock direction in boundary surfaces with respect to the central portion 2615*a* and which bend in a direction substantially parallel to a longitudinal direction of the central portion 2615*a* in root portions of the band attaching portions 2602B. End portions of the bent portions 2615*b* are provided with screw holes 2615*c* for passing the connecting members 2635.

Each of the second magnetic members 2625 has a substantially rectangular parallelepiped shape, and a sectional area of the member is configured to be larger than a sectional area of the bent portion 2615*b* of the first magnetic member 2615. A screw hole 2615*d* corresponding to the screw hole 2615*c* of the bent portion 2615*b* is disposed in an abutment surface of the second magnetic member 2625 which abuts on the first magnetic member 2615 which faces the opening 2630A. Moreover, the connecting members 2635 are passed through the screw holes 2615*c* in the first magnetic members 2615, and inserted into the screw holes 2615*d* of the second magnetic members 2625. Accordingly, the first magnetic members 2615 are connected to the second magnetic members 2625 in a state in which they abut on each other.

That is, each end portion 2652 of the core 2605*a* comprises: the bent portion 2615*b* of the first magnetic member 2615; the second magnetic member 2625; and the connecting member 2635. An end surface 2653 of each end portion 2652 comprises an outer surface of the second magnetic member 2625 which faces the opening 2630A. Therefore, an area of the end surface 2653 is provided in such a manner as to be larger than a sectional area of the central portion 2615*a*.

Moreover, an insulating material 2602*h* is disposed between the end portion 2652 positioned in the cutout portion 2620A and a back lid 2002*c*. Accordingly, the end surface 2653 and the case main body 2602A are prevented from being configured into a continuous curved surface. The end portion 2652 is surrounded with a conductive member configured by the case main body 2602A, and the side surface of the watch 2600 is configured in such a manner as to be prevented from being brought into a short-circuit state at a high frequency (in an alternating manner). The insulating material 2602*h* is brought into contact with the back lid 2002*c*, and has a waterproof effect. Examples of the usable insulating material 2602*h* include a vinyl chloride-based material, a polyethylene-based material, and an ethylene propylene-based material.

Any of the first magnetic members 2615, the second magnetic members 2625, and the connecting members 2635 may be a magnetic member, or may be different types of members having, for example, different permeability. As the connecting member, for example, a bolt, a screw or the like is usable, and another member having a preferable connecting function can be appropriately used.

According to the watch 2600, needless to say, effects similar to those of the watch 2100 are obtained. The first magnetic members 2615 are connected to the second magnetic members 2625 by the connecting members 2635 to form the core 2605*a* with the watch case 2602 being sandwiched between the first magnetic members 2615 and the second magnetic members 2625.

Therefore, a degree of freedom in structure design can be enhanced as compared with a core as a single member. A design property is improved, or the watch can be structured in such a manner as to keep air tightness with respect to the watch case 2602.

(Modification)

Figure 45:
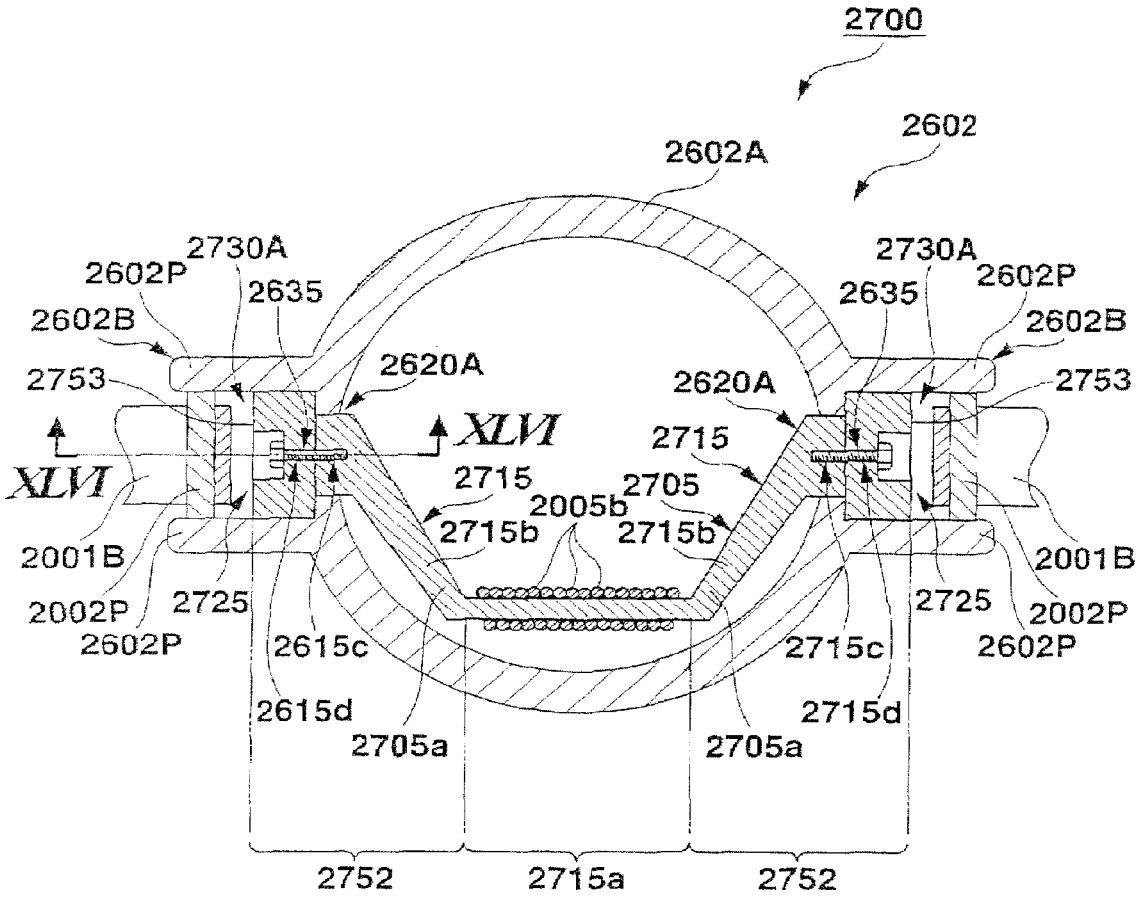
FIG. 45 is a sectional view corresponding to FIG. 35 in the watch according to a modification of Embodiment 12.
Figure 46:
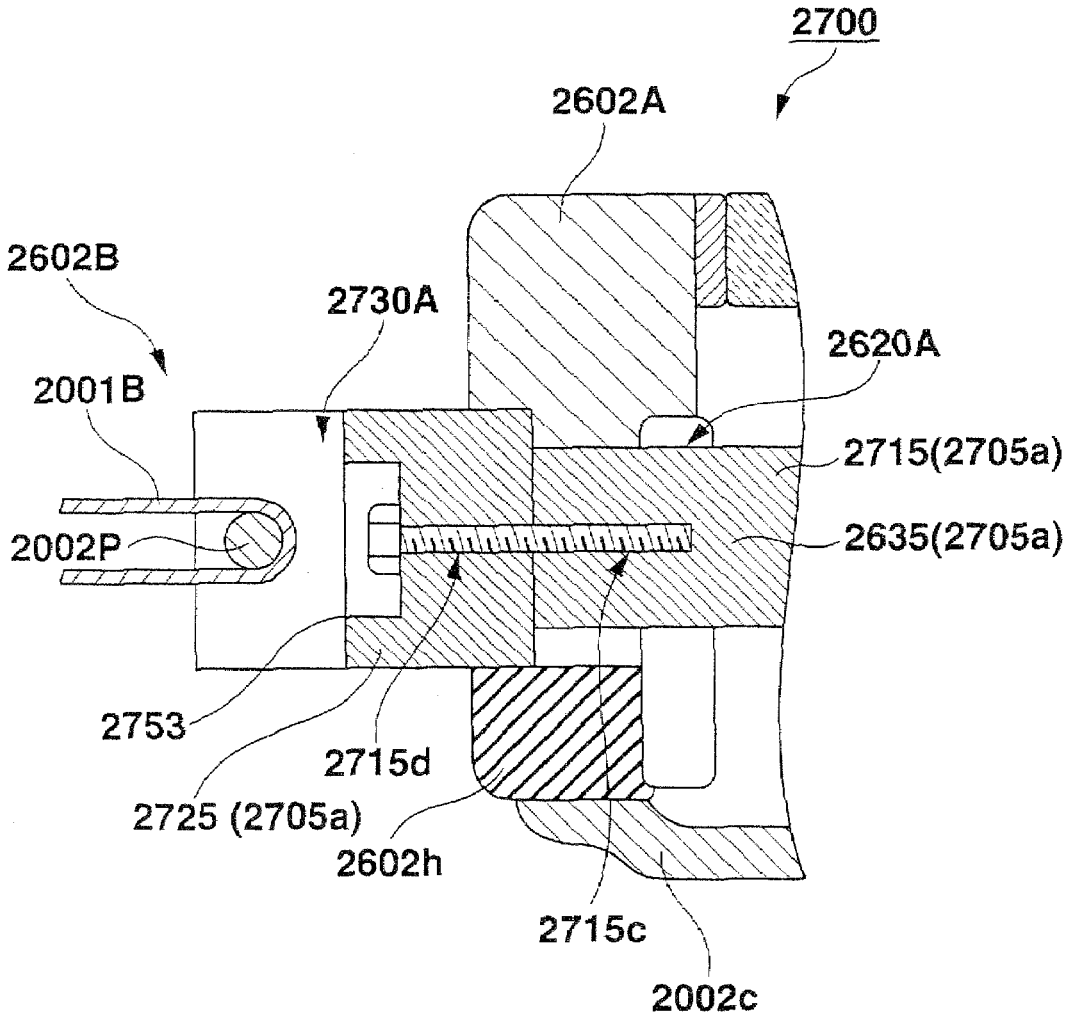
FIG. 46 is a sectional view taken along a line XLVI-XLVI in FIG. 45.

A watch 2700 as a modification of Embodiment 12 is shown in FIGS. 45 and 46. FIG. 45 is a sectional view of the watch 2700. FIG. 46 is a sectional view taken along a line XLVI-XLVI in FIG. 45. A constitution similar to that of Embodiment 12 is denoted with the same reference numerals, and description thereof is omitted.

An antenna 2705 comprises: a magnetic core 2705*a*; and a coil 2005*b* wound around this The core 2705*a* comprises: a first magnetic member 2715 disposed inside a watch case 2602; a second magnetic member 2725 exposed from the watch case 2602; and a connecting member 2635 configured by a magnetic material for connecting the first magnetic member 2715 to the second magnetic member 2725 in a state in which the first magnetic member abuts on the second magnetic member.

The first magnetic member 2715 is formed of: a central portion 2715*a* positioned substantially in a central portion and substantially having a square pole shape; and bent portions 2715*b* which are disposed in opposite end portions of the central portion 2715*a* and which obliquely bend in a three/nine o'clock direction in boundary surfaces between the bent portions and the central portion 2715*a* and which bend in a direction substantially parallel to a longitudinal direction of the central portion 2715*a* in root portions of band attaching portions 2602B. Screw holes 2715*c* for passing the connecting members 2635 are disposed in end portions of the bent portions 2715*b*.

Screw holes 2715*d* corresponding to the screw holes 2715*c* of the bent portions 2715*b* are disposed in abutment surfaces of the second magnetic members 2725 which abut on the first magnetic member 2715 facing openings 2730A. Moreover, when the connecting members 2635 are passed through the screw holes 2715*d* of the second magnetic member 2725, and inserted into the screw holes 2715*c* of the first magnetic members 2715, the first magnetic member 2715 is connected to the second magnetic member 2725 in an abutting state.

That is, each end portion 2752 of the core 2705*a* comprises the bent portion 2715*b* of the first magnetic member 2715, the second magnetic member 2725, and the connecting member 2635. An end surface 2753 of the end portion 2752 comprises an outer surface of the second magnetic member 2725 disposed in the opening 2730A. Therefore, an area of the end surface 2753 is provided in such a manner as to be larger than that of the central portion 2715*a*.

Moreover, an insulating material 2602*h* is disposed between the end portion 2752 positioned in a cutout portion 2620A and a back lid 2002*c*. Accordingly, the end surface 2753 and a case main body 2602A are prevented from being configured into a continuous curved surface. The end portion 2752 is surrounded with a conductive member configured by the case main body 2702A, and the side surface of the watch 2700 is configured in such a manner as to be prevented from being brought into a short-circuit state at a high frequency (in an alternating manner). Examples of the usable insulating material 2602*h* include a vinyl chloride-based material, a polyethylene-based material, and an ethylene propylene-based material.

According to the watch 2700, needless to say, effects similar to those of the watch 2600 are obtained. Since the connecting members 2635 can be tightened from the side of the second magnetic member 2725 configuring the core 2705*a*, an operation of fastening the second magnetic members 2625 can be performed more easily.

It has been described in the embodiments of the present invention that the present invention is applied as the electronic device to the watch type radio-wave clock, but the present invention is not limited to this application. The present invention may be applied to, for example, an electronic device to be mounted in a car, a portable radio terminal or the like.

Moreover, the materials of the cores in Embodiments 8 to 12 are the same as those in Embodiment 7.

According to the above-described inventions described in Embodiments 7 to 12, the opposite end surface of the core which captures the radio wave are exposed from the device case to the outside. Therefore, the radio wave can be captured directly by the opposite end surfaces without being interrupted by the device case, and the radio wave can be received efficiently and securely. Accordingly, it is possible to enhance the receiving sensitivity of the antenna in the device case.

Moreover, since the core is made of the amorphous metal, the core is provided with the high strength and permeability, and the radio wave can be captured more securely.

Furthermore, the area of each end surface of the core which captures the radio wave is larger than the sectional area of the central portion of the core. According to this shape, the receiving sensitivity of the radio wave can be improved more, and the receivable directions increase. Therefore, the directivity can be relaxed, and the radio wave can be received more efficiently and securely.

Additionally, according to the inventions described in Embodiments 9 and 10, even in a case where the band attaching portion of the core is connected to the band, and the appearance of the core is different from that of the device case, the difference is not conspicuous, and the core can be exposed without impairing the appearance.

Moreover, according to the invention described in Embodiment 11, the opposite end surfaces of the core exposed from the device case to the outside face the band attached to the band attaching portion. Therefore, in a case where the band is attached to the band attaching portion, the opposite end surfaces of the core are accordingly obstructed by the band and are not easily seen from the outside, and the appearance of the core is different from that of the device case, the difference is not conspicuous, and the core can be exposed without impairing the appearance.

Furthermore, according to the invention described in Embodiment 12, the first magnetic member is connected to the second magnetic member by the connecting member to configure the core with the device case being sandwiched between the first magnetic member and the second magnetic member. Therefore, the degree of freedom in structure design can be enhanced as compared with the single-member core. The core can be structured in such a manner as to improve its design property and keep the air tightness with respect to the device case.

Additional advantages and modifications will readily occur to those skilled in the art. Therefore, the invention in its broader aspects is not limited to the specific details and representative embodiments shown and described herein. Accordingly, various modifications and may be made without departing from the spirit or scope of the general inventive concept as defined by the appended claims and their equivalents.

What is claimed is:

1. An electronic device comprising:

a cylindrical case which has an inner space and both ends opened to the inner space and which is impermeable to a radio wave;

a first cover which covers an opening in one end of the case and which is permeable to the radio wave;

a second cover which covers an opening in the other end of the case and which is impermeable to the radio wave;

a circuit board which is arranged between the first cover and the second cover in the inner space of the case;

an antenna which is arranged between the first cover and the second cover in the inner space of the case, which is connected to the circuit board, and which includes an elongated core having end portions and an intermediate portion between the both end portions, and a coil wound around the intermediate portion of the core;

a pair of magnetic flux introducing portions provided on the both end portions of the core of the antenna;

a partition plate which is arranged between the first cover and the antenna in the inner space of the case and which is permeable to the radio wave; and a pair of flat and magnetic members which is arranged between the partition plate and the antenna in the inner space of the case and which is magnetically connected to the pair of magnetic flux introducing portions, wherein an electric signal entered into the inner space of the case from an outside of the case through the first cover and the partition plate is introduced into the magnetic flux introducing portions through the flat and magnetic members and then the electric signal is introduced into the intermediate portion of the core from the magnetic flux introducing portions through the both end portions of the core to act on the coil.

2. The electronic device according to claim 1, wherein each flat and magnetic member is configured by one of a sheet and a foil.

3. The electronic device according to claim 2, wherein each flat and magnetic member is made of amorphous metal.

4. The electronic device according to claim 1, wherein:

a housing is housed in the inner space of the case, and the housing supports the circuit board and the antenna, and the flat and magnetic members are arranged between the partition plate and the housing in the inner space of the case.

5. The electronic device according to claim 1, wherein:

a watch timing portion is housed in the inner space of the case, the watch timing portion includes the circuit board and the antenna, the first cover is permeable to light, and the partition plate includes a decorative plate.

6. The electronic device according to claim 5, wherein:

a housing is housed in the inner space of the case, the housing supports the circuit board and the antenna, and the flat magnetic members are arranged between the partition plate and the housing in the inner space of the case.

7. The electronic device according to claim 1, wherein:

a surface area of each flat and magnetic member is set to be larger than a surface area of each magnetic flux introducing portion.

8. The electronic device according to claim 7, wherein:

a dimension of each flat and magnetic member in a direction which is along the partition plate and which crosses a longitudinal direction of the core of the antenna is set to be larger than a dimension of each magnetic flux introducing portion in that direction.

9. The electronic device according to claim 7, wherein:

each flat and magnetic member is attached on the partition plate.

10. The electronic device according to claim 9, wherein:

a dimension of each flat and magnetic member in a direction which is along the partition plate and which crosses a longitudinal direction of the core of the antenna is set to be larger than a dimension of each magnetic flux introducing portion in that direction.

11. The electronic device according to claim 1, wherein:

each magnetic flux introducing portion has a rectangular cross section, and one long side in the cross section extends along the partition plate.

12. The electronic device according to claim 11, wherein:

a surface area of each flat and magnetic member is set to be larger than a surface area of each magnetic flux introducing portion.

13. The electronic device according to claim 12, wherein:

a dimension of each flat and magnetic member in a direction which is along the partition plate and which crosses a longitudinal direction of the core of the antenna is set to be larger than a dimension of each magnetic flux introducing portion in that direction.

14. The electronic device according to claim 12, wherein:

each flat and magnetic member is attached on the partition plate.

15. The electronic device according to claim 14, wherein:

a dimension of each flat and magnetic member in a direction which is along the partition plate and which crosses a longitudinal direction of the core of the antenna, is set to be larger than a dimension of each magnetic flux introducing portion in that direction.

* * * * *